US007713034B2

(12) United States Patent
Ogawa

(10) Patent No.: US 7,713,034 B2
(45) Date of Patent: May 11, 2010

(54) DIAPHRAGM PUMP AND MANUFACTURING DEVICE OF ELECTRONIC COMPONENT

(75) Inventor: Kenji Ogawa, Musashino (JP)

(73) Assignee: Neuberg Company Limited, Tokyo (JP)

( * ) Notice: Subject to any disclaimer, the term of this patent is extended or adjusted under 35 U.S.C. 154(b) by 764 days.

(21) Appl. No.: 11/568,932

(22) PCT Filed: May 2, 2005

(86) PCT No.: PCT/JP2005/008659

§ 371 (c)(1),
(2), (4) Date: Nov. 10, 2006

(87) PCT Pub. No.: WO2005/111423

PCT Pub. Date: Nov. 24, 2005

(65) Prior Publication Data

US 2008/0050256 A1 Feb. 28, 2008

(30) Foreign Application Priority Data

| | | |
|---|---|---|
| May 13, 2004 | (JP) | 2004-143776 |
| Jun. 1, 2004 | (JP) | 2004-163114 |
| Jun. 17, 2004 | (JP) | 2004-179769 |
| Dec. 21, 2004 | (JP) | 2004-369886 |

(51) Int. Cl.
*F04B 17/03* (2006.01)
*F04B 27/04* (2006.01)
*F04B 45/047* (2006.01)

(52) U.S. Cl. ..... 417/413.1

(58) Field of Classification Search ..... 417/413.1
See application file for complete search history.

(56) References Cited

U.S. PATENT DOCUMENTS

| | | | | |
|---|---|---|---|---|
| 3,783,748 | A * | 1/1974 | Cunningham | 92/249 |
| 4,199,307 | A | 4/1980 | Jassawalla | |
| 4,236,880 | A | 12/1980 | Archibald | |

(Continued)

FOREIGN PATENT DOCUMENTS

| | | |
|---|---|---|
| DE | 10118086 | 7/2002 |

(Continued)

*Primary Examiner*—Devon C Kramer
*Assistant Examiner*—Bryan Lettman
(74) *Attorney, Agent, or Firm*—Rankin, Hill & Clark LLP

(57) ABSTRACT

A diaphragm pump 1 has a base block 2, a diaphragm 8 and a drive unit for driving the diaphragm to reciprocate. The base block 2 has three or more liquid flow paths, each having three recesses 23 through 25 or more recesses. The diaphragm 8 and the respective recesses 23 through 25 define a plurality of valve chambers and the metering chamber. The drive unit includes: pressing rods 73 through 75 arranged corresponding to the respective recesses with the diaphragm interposed therebetween; and a pressing member drive controller adapted to execute a liquid discharging operation and a liquid sucking operation at a predetermined timing defined for each of the pressing rods, in which in the liquid discharging operation, each of the pressing rods is moved toward the respective recesses so as to gradually decease the volume of the respective valve chambers and the metering chamber and eventually hermetically seal the metering chamber; while in the liquid discharging operation, each of the pressing rods is moved away from the respective recesses so as to gradually decease the volume of the respective valve chambers and the metering chamber.

13 Claims, 27 Drawing Sheets

U.S. PATENT DOCUMENTS

| | | | | | |
|---|---|---|---|---|---|
| 4,322,201 | A | | 3/1982 | Archibald | |
| 5,344,292 | A | * | 9/1994 | Rabenau et al. | 417/413.1 |
| 5,593,290 | A | | 1/1997 | Greisch et al. | |
| 5,993,174 | A | * | 11/1999 | Konishi | 417/413.1 |

FOREIGN PATENT DOCUMENTS

| | | |
|---|---|---|
| GB | 2257478 | 1/1993 |
| JP | 2003-042069 | 2/2003 |

* cited by examiner

DIAPHRAGM PUMP AND MANUFACTURING DEVICE OF ELECTRONIC COMPONENT

TECHNICAL FIELD

The present invention relates to a diaphragm pump for transferring a predetermined volume of liquid and a manufacturing device of electronic component. The diaphragm pump according to the present invention can find applications in the field of continuously transferring (discharging) liquid, which may be selected from acidic or alkaline medicinal liquids, soldering pastes, solvents such as alcohol and adhesives with minimal pulsation. The diaphragm pump can and further find applications in manufacturing devices of electronic components such as a die bonder, in which a semiconductor chip is fixed to the substrate by the adhesives discharged from a diaphragm pump, or a manufacturing device for manufacturing light-emitting diode (LED), in which the LED chip is sealed by the resin discharged from a diaphragm pump, or the like.

BACKGROUND ART

Diaphragm pumps using a diaphragm made of synthetic resin thin film are being used in various industrial fields including the chemical industry, the pharmaceutical industry, the semiconductor industry and the printing industry because of the advantages they provide including that the liquid can be transferred without being damaged, that it is not necessary to use an anti-leakage seal member and that it can be arranged so that liquid does not contact any metal.

However, such diaphragm pumps normally generate pulsation because liquid is taken in and discharged by reciprocating the diaphragm.

Arrangements of combining a pair of diaphragm pumps and using them complementarily so as not to generate any pulsation at the liquid discharge side are proposed for the purpose of suppressing the pulsation of a diaphragm pump (see, for instance, Reference 1: Japanese Patent Laid-Open Publication No. 2003-042069).

In addition, arrangements of sequentially closing three chambers with diaphragms, which functions as a pump without providing a check valve, has been also proposed (see, for instance, Reference 2: specification of U.S. Pat. No. 5,593,290).

However, such combined diaphragm pumps disclosed in Reference 1 are provided with a check valve for preventing liquid from flowing backward. In other words, they are accompanied by a problem that they cannot allow liquid to flow back.

In the pump disclosed in Reference 2, since the diaphragm is deformed by a liquid, it is difficult to speed up a drive operation, and since chambers of plural systems are provided in parallel, it is difficult to reduce size and weight.

DISCLOSURE OF THE INVENTION

An object of the present invention is to provide a diaphragm pump capable of operating with minimal pulsation and liquid to flow back without necessity of the use of a check valve, size and weight of which can be easily reduced, and also to provide a manufacturing device of electronic component using the diaphragm.

A diaphragm pump according to an aspect of the present invention includes: a flow path block; a diaphragm arranged so as to closely contact the flow path block; a drive unit for reciprocating the diaphragm; and at least three liquid flow paths defined by the flow path block and the diaphragm intercommunicating a suction flow path and a discharge flow path of a liquid. The flow path block is provided with either one of the suction flow path and the discharge flow path on a central axis portion of a diaphragm-contacting surface to which the diaphragm is closely contacted, and the other one of the suction flow path and the discharge flow path on an outer circumferential side of the diaphragm-contacting surface. A suction valve chamber intercommunicating with the suction flow path, a discharge valve chamber intercommunicating with the discharge flow path, and a metering chamber formed between the suction valve chamber and the discharge valve chamber so as to intercommunicate therewith are provided respectively on the middle of the respective flow paths of the liquid. The drive unit includes: a suction pressing member arranged in correspondence with the suction valve chamber with the diaphragm interposed therebetween; a discharge pressing member arranged in correspondence with the discharge valve chamber with the diaphragm interposed therebetween; a metering-chamber pressing member arranged in correspondence with the metering chamber with the diaphragm interposed therebetween; and a pressing member drive controller for controlling drives of the respective pressing members. The pressing member drive controller includes: a rotary drive source; a cam rotated by the rotary drive source; and a biasing unit for biasing the pressing members to abut on cam faces of the cam. The pressing member drive controller performs operations by a predetermined timing set for each of the pressing members by rotating the cam with the rotary drive source to reciprocate the respective pressing members to follow the cam faces, the operations including: a suction valve chamber sealing operation for moving the suction pressing member toward the flow path block to move a portion of the diaphragm corresponding to the suction valve chamber until the portion closely contacts the flow path block to hermetically seal the suction valve chamber; a discharge valve chamber sealing operation for moving the discharge pressing member toward the flow path block to move a portion of the diaphragm corresponding to the discharge valve chamber until the portion closely contacts the flow path block to hermetically seal the discharge valve chamber; a suction valve chamber opening operation for moving the suction pressing member in a direction away from the flow path block and detaching the portion of the diaphragm corresponding to the suction valve chamber that has closely contacted the flow path block from the flow path block to open the suction valve chamber; a discharge valve chamber opening operation for moving the discharge pressing member in a direction away from the flow path block and detaching the portion of the diaphragm corresponding to the discharge valve chamber that has closely contacted the flow path block from the flow path block to open the discharge valve chamber; a volume decrease operation for moving the metering-chamber pressing member toward the flow path block to move a portion of the diaphragm corresponding to the metering chamber toward the flow path block to gradually decrease the volume of the metering chamber; and a volume increase operation for moving the metering-chamber pressing member in a direction away from the flow path block to move the portion of the diaphragm corresponding to the metering chamber away from the flow path block to gradually increase the volume of the metering chamber.

With the above-described arrangement according to the present invention, each of the valve chambers can be opened and closed, and the volume of the metering chamber can be increased and decreased by driving each of the pressing members corresponding to each of the valve chambers and the metering chamber arranged along each of the liquid flow paths to reciprocate at predetermined timings. Therefore, liquid is prevented from flowing backward without using a check valve when each of the pressing members is moved at predetermined timings while the liquid is being transferred. Thus, since no check valve is provided, each of the pressing members can be driven to move reversely so as to allow liquid to flow backward.

Additionally, since at least three liquid flow paths are formed and each of the valve chambers and the metering chamber are arranged along each of the liquid flow paths, while pressing members are provided to correspond to the respective valve chambers and metering chamber so as to set the timing of transferring liquid for each of the flow paths, a predetermined volume of liquid can be transferred continuously simply by shifting the timings of transferring liquid of the liquid flow paths by a predetermined phase, and further the pump can be operated with minimal pulsation.

Still additionally, in a diaphragm pump according to the present invention, only the portions of the single diaphragm that corresponds to the respective valve chambers and metering chamber are driven to move separately unlike conventional diaphragm pumps in which the entire diaphragm is driven to reciprocate. Therefore, only a small area of the diaphragm may be driven and hence the error in the volume of liquid to be transferred that may arise due to deformation or the like of the diaphragm is minimized. As a result, a diaphragm pump according to the present invention can accurately transfer a very small amount of liquid.

Further, the side of the drive unit for driving the pressing members and the side where the liquid flow paths, the valve chambers and the metering chamber are provided and hence liquid flows are divided simply by arranging the diaphragm. Therefore, it is not necessary to provide seal members and hence the number of components is reduced accordingly.

Furthermore, since the diaphragm is made of an elastically deformable material such as rubber, particle-containing liquid such as silver paste, solder paste, resin with silica powder contained, or the like can be discharged without crushing particles contained therein so that liquid can be transferred without being damaged.

In the present invention, since one of the suction flow path and the discharge flow path is formed on the central axis portion of the diaphragm-contacting surface, and the other one of the suction flow path and the discharge flow path is formed on the outer circumferential side of the diaphragm-contacting surface, three or more liquid paths for intercommunicating the suction flow path and the discharge flow path can be formed radially or spirally from the central axis portion toward the outer circumference. The respective pressing members provided corresponding to the respective liquid flow paths are reciprocated by following the cam face only by rotating the cam with the rotary drive source. Thus, the pressing member drive controller can be constituted with the cam having the cam face on the end surface, the rotary drive source such as a motor for rotating the cam and the biasing unit such as spring for causing the respective pressing members abut on the cam face, so that the diaphragm pump can be reduced in size and weight. Thus, when used in dispensing adhesives, various pastes and the like in production lines of various products, the diaphragm pump of the present invention can be attached to robot arms and moved by high speed and high acceleration, so that the takt time of the production lines can be shortened, which enhances productivity.

In the present invention, only by rotating the cam by the rotary drive source including a motor and the like, each of the pressing members can be repeatedly operated with a predetermined timing. Since the liquid transfer rate can be set to constant for each one cycle of operation for each of the pressing members, the liquid transfer rate per unit of time can be adjusted only by adjusting rotation speed of the cam. Thus, the liquid transfer rate of the diaphragm pump can be controlled easily, so that the diaphragm pump (dispenser) with high convenience can be realized.

Preferably, in the present invention, the suction and discharge pressing members and the metering-chamber pressing member each have a substantially semispherical recess formed on an end surface on the cam face side and a ball disposed in the recess and adapted to abut on the cam face, in which and coefficient of friction between the ball and the recess is set to be smaller than coefficient of friction between the cam face and the ball.

In the present invention described above, a cam follower that abuts on the cam face can be formed with a recess formed on each of the pressing members and a ball disposed in the recess. Thus, as compared to a conventional arrangement using a roller, the cam face and the cam follower can be downsized, resulting in downsizing the diaphragm pump itself. When the roller is used, since a roller shaft has to be outwardly projected from the pressing member with the roller rotatably provided on the roller shaft, the diameter of locus of movement of the roller rotating along the cam face becomes large, so that the diameter of the cam also needs to be enlarged in accordance with the locus of movement of the roller.

On the other hand, in the present invention, the ball can be disposed in the recess of the pressing member and the pressing member does not have a projection projecting outwardly therefrom, the diameter of locus of movement of the ball can be small, so that the diaphragm pump can be simplified in its arrangement and downsized easily.

In the present invention, since the coefficient of friction between the ball and the recess holding the ball is set to be smaller than the coefficient of friction between the cam face and the ball, even if a force in a rotary shaft direction or the like is applied to the ball in accordance with the rotation, the force is absorbed as the ball and the recess of the pressing member slide. Thus, slide slipping or the like does not occur between the cam face and the ball, and thereby the ball can be rolled relative to the cam face without sliding. Therefore, unlike the conventional arrangement in which the cam face had to be formed with an oleoresin or the like in consideration of friction, the cam face can be formed with a hard material such as metal and the ball can also formed with a hard material, so that an error in stroke amount of the pressing member can be decreased, enhancing dispensing accuracy of the liquid.

Preferably, in the diaphragm pump according to the present invention, the pressing member drive controller performs steps including: a suction step for hermetically sealing the metering chamber by moving the metering-chamber pressing member provided corresponding to the metering chamber toward the flow path block to bring the portion of the diaphragm corresponding to the metering chamber into close contact with the flow path block and sucking liquid into the suction valve chamber from the suction flow path by moving the suction pressing member provided corresponding to the suction valve chamber away from the flow path block to detach the portion of the diaphragm corresponding to the suction valve chamber from the flow path block; a first transfer step for hermetically sealing the discharge valve chamber by moving the discharge pressing member provided corresponding to the discharge valve chamber toward the flow path block to bring the portion of the diaphragm corresponding to the discharge valve chamber into close contact with the flow path block, increasing the volume of the metering chamber by moving the metering-chamber pressing member in a direction away from the flow path block to detach the portion of the diaphragm corresponding to the metering chamber from the flow path block, and decreasing the volume of the suction valve chamber by moving the suction pressing member toward the flow path block to move the portion of the diaphragm corresponding to the suction valve chamber toward the flow path block to transfer the liquid from the suction valve chamber to the metering chamber; a metering step for hermetically sealing the suction valve chamber by moving the suction pressing member toward the flow path block to bring the portion of the diaphragm corresponding to the suction valve chamber into close contact with the flow path block while keeping the discharge valve chamber hermetically sealed, and dividedly isolating the liquid in the suction valve chamber and the discharge valve chamber to meter the volume of the liquid; a second transfer step for transferring the liquid from the metering chamber to the discharge valve chamber by moving the metering-chamber pressing member toward the flow path block to decrease the volume of the metering chamber to move the discharge pressing member in a direction away from the flow path block to increase the volume of the discharge valve chamber while keeping the suction valve chamber hermetically sealed; and a discharge step for transferring the liquid from the discharge valve chamber to the discharge flow path by hermetically sealing the metering chamber and moving the discharge pressing member toward the flow path block to decrease the volume of the discharge valve chamber.

With the above-described arrangement, since the metering chamber is hermetically sealed in the suction step and the discharge step, the liquid no longer flows back from the metering chamber to the suction valve chamber in the suction step and from the discharge valve chamber to the metering chamber in the discharge step. Therefore, any liquid is prevented from flowing back simply by operating the pressing members and hence it is not necessary to provide a check valve.

Additionally, since a metering step of hermetically sealing the suction valve chamber and the discharge valve chamber and dividedly isolating the liquid between the respective valve chambers, i.e. the metering chamber portion to meter liquid is provided, the volume of liquid that is transferred through each of the liquid flow paths can be secured accurately.

Preferably, in the diaphragm pump according to the present invention, the pressing member drive controller performs the suction step and the discharge step while hermetically sealing the metering chamber, by moving the suction pressing member toward the flow path block to suck the liquid from the suction flow path into the suction valve chamber and moving the discharge pressing member toward the flow path block to transfer the liquid from the discharge valve chamber to the discharge flow path.

With the above-described arrangement, since both the suction step and the discharge step are executed simultaneously, the cycle time of the liquid transferring step is curtailed to transfer liquid efficiently.

Preferably, in the diaphragm pump according to the present invention, the pressing member drive controller performs steps including: a suction step for sucking the liquid from the suction flow path into the metering chamber via the suction valve chamber; by moving the suction pressing member provided corresponding to the suction valve chamber in a direction away from the flow path block to detach the part of the valve chamber corresponding to the suction valve chamber from the flow path block to intercommunicate the suction flow path and the metering chamber while the discharge valve chamber is kept hermetically sealed; and by moving the metering-chamber pressing member arranged corresponding to the metering chamber away from the flow path block to detach the portion of the diaphragm corresponding to the metering chamber from the flow path block to increase the volume of the metering chamber; a metering step for hermetically sealing the suction valve chamber by moving the suction pressing member toward the flow path block to bring the portion of the diaphragm corresponding the suction valve chamber into close contact with the flow path block while keeping the discharge valve chamber hermetically sealed, and dividedly isolating the liquid in the suction valve chamber and the discharge valve chamber to meter the volume of the liquid; and a discharge step for transferring the liquid from the metering chamber to the discharge flow path via the discharge valve chamber; by moving the discharge pressing member in a direction away from the flow path block to intercommunicate the metering chamber and the discharge flow path while keeping the suction valve chamber hermetically sealed; and by moving the metering-chamber pressing member provided corresponding to the metering chamber toward the flow path block to decrease the volume of the metering chamber.

With such arrangement, since the discharge valve chamber is hermetically sealed in the suction step, the suction valve chamber is hermetically sealed in the discharge step, and the respective valve chambers are hermetically sealed in the metering step, the liquid does not flow back from the discharge flow path to the suction flow path in each of the steps. Therefore, the liquid can be securely prevented from flowing back only by operations of the respective pressing members, which does not require a check valve.

Since the metering step of hermetically sealing the suction valve chamber and the discharge valve chamber and dividedly isolating the liquid between the respective valve chamber (metering chamber portion) for metering, transfer rate of the liquid in each of the liquid flow paths can be set with high accuracy. Preferably, in the diaphragm pump according to the present invention, the pressing member drive controller includes the discharge step having a discharge rate increasing step for gradually increasing the discharge rate and a discharge rate decreasing step for gradually decreasing the discharge rate and, in which the discharge valve chamber includes a plurality of discharge valve chambers, one of the plurality of discharge valve chambers being in the discharge-rate increasing step and at least other one of the plurality of discharge valve chambers being in the discharge-rate decreasing step, thereby keeping a constant discharge level.

With the above-described arrangement, when liquid transfer from one of the liquid flow paths into the discharge flow path ends, another liquid transfer from other one of the liquid flow path into the discharge flow path can be started in an overlapping manner. Thus, the operation of switching a liquid transfer operation from one of the liquid flow paths to another liquid transfer operation from other one of the liquid flow paths is conducted smoothly so that the liquid transfer operation can be continued, maintaining a constant liquid transfer rate, and thus the overall liquid transfer operation is conducted with minimal pulsation.

Preferably, in the diaphragm pump according to present invention, the suction valve chamber, the metering chamber and the discharge valve chamber formed along the respective liquid flow paths are displaced from each other by a first predefined angle in a circumferential direction around a central axis of the diaphragm-contacting surface with the respective dimensions from the central axis differentiated from each other; the suction valve chambers, the metering chambers and the discharge valve chambers arranged along the respective flow paths are respectively displaced from each other by a second predefined angle in the circumferential direction around the central axis of the diaphragm-contacting surface; and the suction valve chamber, the discharge valve chamber and the metering chamber are spirally arranged from the central axis of the diaphragm-contacting surface.

Preferably, in the diaphragm pump according to the present invention, the first predefined angle is 30° and the second predefined angle is 72°; and a total of five sets of the liquid flow paths, suction valve chambers, metering chambers and discharge valve chambers are provided.

With the above-described arrangement, since the respective valve chambers and metering chamber are arranged to extend spirally from the central axis, it is possible to down size spaces for arranging the respective valve chambers and metering chamber, resulting in downsizing the diaphragm pump.

Additionally, the respective valve chambers and metering chamber are displaced from each other by a first predetermined angle. Therefore, if the pressing members driven by the cam are arranged so as to correspond to the respective valve chambers and the metering chamber, it is not necessary to shift the phases of the cam face of the cam and each of the areas of the cam face can be arranged radially as viewed from the central axis, so that the cam can be manufactured easily.

When the cam faces are angularly shifted from each other by 90° so that a cycle of operation is performed by rotating the cam by 90°, each of the liquid flow paths can realize four cycles of liquid transfer operation when the cam is driven to make a full turn. Therefore, if five liquid flow paths are provided, for instance, a total of 5×4=20 cycles of liquid transfer operation are realized by the entire pump during a full turn of the cam. With this arrangement, the volume of transferred liquid for each full turn of the cam is increased to reduce pulsation.

Preferably, in the diaphragm pump according to the present invention, the suction valve chamber, the metering chamber and the discharge valve chamber formed along the respective liquid flow paths are linearly formed in the circumferential direction around the central axis of the diaphragm-contacting surface with the respective dimensions from the central axis differentiated from each other; the suction valve chambers, the metering chambers and the discharge valve chambers formed along the respective flow paths are respectively displaced from each other by a second predefined angle in the circumferential direction around the central axis of the diaphragm-contacting surface; and the suction valve chamber, the discharge valve chamber and the metering chamber are radially arranged from the central axis of the diaphragm-contacting surface.

With such arrangement, since the valve chambers and the metering chamber are disposed radially from the central axis, the respective valve chambers and the metering chamber can be manufactured easily.

When the cam faces are angularly shifted from each other by 90° so that a cycle of operation is performed by rotating the cam by 90°, each of the liquid flow paths can realize four cycles of liquid transfer operation when the cam is driven to make a full turn. Therefore, if five liquid flow paths are provided, for instance, a total of 5×4=20 cycles of liquid transfer operation are realized by the entire pump during one rotation of the cam, and thus the liquid transfer rate per one rotation of the cam can be increased, which reduces pulsation.

Preferably, in the diaphragm pump according to the present invention, a recessed groove is formed on the diaphragm-contacting surface of the flow path block in close contact with the diaphragm; a flow-path-block contacting surface of the diaphragm in close contact with the flow path block has a planar profile; and the flow path of the liquid is defined by the recessed groove of the flow path block and the flow path block contacting surface of the diaphragm.

As the recessed groove is formed on the flow path block side to provide the liquid flow path, the diaphragm can be formed in a simple planar profile. Thus, the diaphragm that is a consumable and needs to be replaced whenever it is worn can be provided at low cost. Additionally, if the liquid flow paths are formed on the flow path block side, a dimensional precision of the flow path can be enhanced, so that the liquid transfer rate can be controlled accurately on a stable basis to reduce fluctuations in the liquid transfer rate.

Preferably, in the diaphragm pump according the present invention, the diaphragm-contacting surface of the flow path block in close contact with the diaphragm has a planar profile; a recessed groove is formed on the flow-path-block contacting surface of the diaphragm in close contact with to the flow path block; and the liquid flow path is defined by the diaphragm-contacting surface of the flow path block and the recessed groove of the diaphragm.

When the recessed groove is formed on the diaphragm side to provide liquid flow path, diaphragm-contacting surface of the flow path block can be formed in a planar profile. When, on the other hand, the recessed groove is formed on the flow path block side that is made of metal, the flow path block needs to be manufactured by preparing a metal mold or by cutting recessed grooves. When a metal mold for producing a molded metal product is used, the cost of initial investment will be high. When, the recessed groove is formed by cutting, the processing cost will be high and it is impossible to process the respective valve chambers, the metering chamber and communication grooves to be very small, so that transfer of a very small quantity of liquid will be difficult.

On the other hand, when the recessed groove is formed on the diaphragm side, a rubber die used to mold the rubber diaphragm is relatively inexpensive, so that the cost of initial investment is reduced. In addition, the valve chambers, the metering chamber and the flow paths having the communication grooves or the like can be dimensionally reduced when the rubber die is used, so that transfer of a very small quantity of liquid without difficulty.

In the diaphragm pump according to the present invention, both the diaphragm-contacting surface of the flow path block and the flow-path-block-contacting surface of the diaphragm may be provided with the recessed grooves. Preferably, in the diaphragm pump according to the present invention, the recessed groove includes: a suction-valve-chamber recess, a metering-chamber recess and a discharge-valve-chamber recess that respectively define the suction valve chamber, the metering chamber and the discharge valve chamber; a communication groove for intercommunicating the suction-valve-chamber recess and the suction flow path; a communication groove for intercommunicating the discharge-valve-chamber recess and the discharge flow path; and a communication groove for intercommunicating the suction valve-chamber recess/discharge-valve-chamber recess and the metering chamber-recess. The recess may have a width same as or larger than the width of the respective communication grooves. The values of the widths may be selected appropriately according to the quantity of the liquid to be transferred.

Preferably, in the diaphragm pump according to the present invention, the cam face of the cam includes a plane orthogonal to a rotary shaft of the cam, the plane provided with three cam grooves concentrically arranged around the rotary shaft of the cam.

With such arrangement, movements of the respective pressing members can be controlled by changing the depth of the cam groove.

In a ball is used as a cam follower, the cam groove can be a rounded groove having a substantially arcuate cross section, which can be formed and processed by a ball end mill, thereby reducing processing cost.

According to another aspect of the present invention, a manufacturing device of an electronic component includes: the above-described diaphragm pump of the present invention, a liquid supplier for supplying the liquid to the suction flow path of the diaphragm pump, a discharge nozzle provided on the discharge flow path, and a controller for controlling the drive unit of the diaphragm pump, in which the liquid supplied by the liquid supplier is discharged from the discharge nozzle through the diaphragm pump to manufacture the electric component.

In such a manufacturing device of electronic component, since the above-described diaphragm pump capable of accurately transferring a trace quantity of liquid is employed, the trace quantity of liquid can be accurately discharged from the discharge nozzle. Further, liquid containing silver powder, silica power or the like can be discharged without crushing particles. Accordingly, by applying the technology to the manufacturing process such as bonding the semiconductor chip, sealing the LED chip or the like, defective products can be reduced and manufacturing efficiency can be improved.

BEST MODE FOR CARRYING OUT THE INVENTION

Embodiments of the present invention will be described in more detail by referring to the accompanying drawings.

First Embodiment

Figure 1:
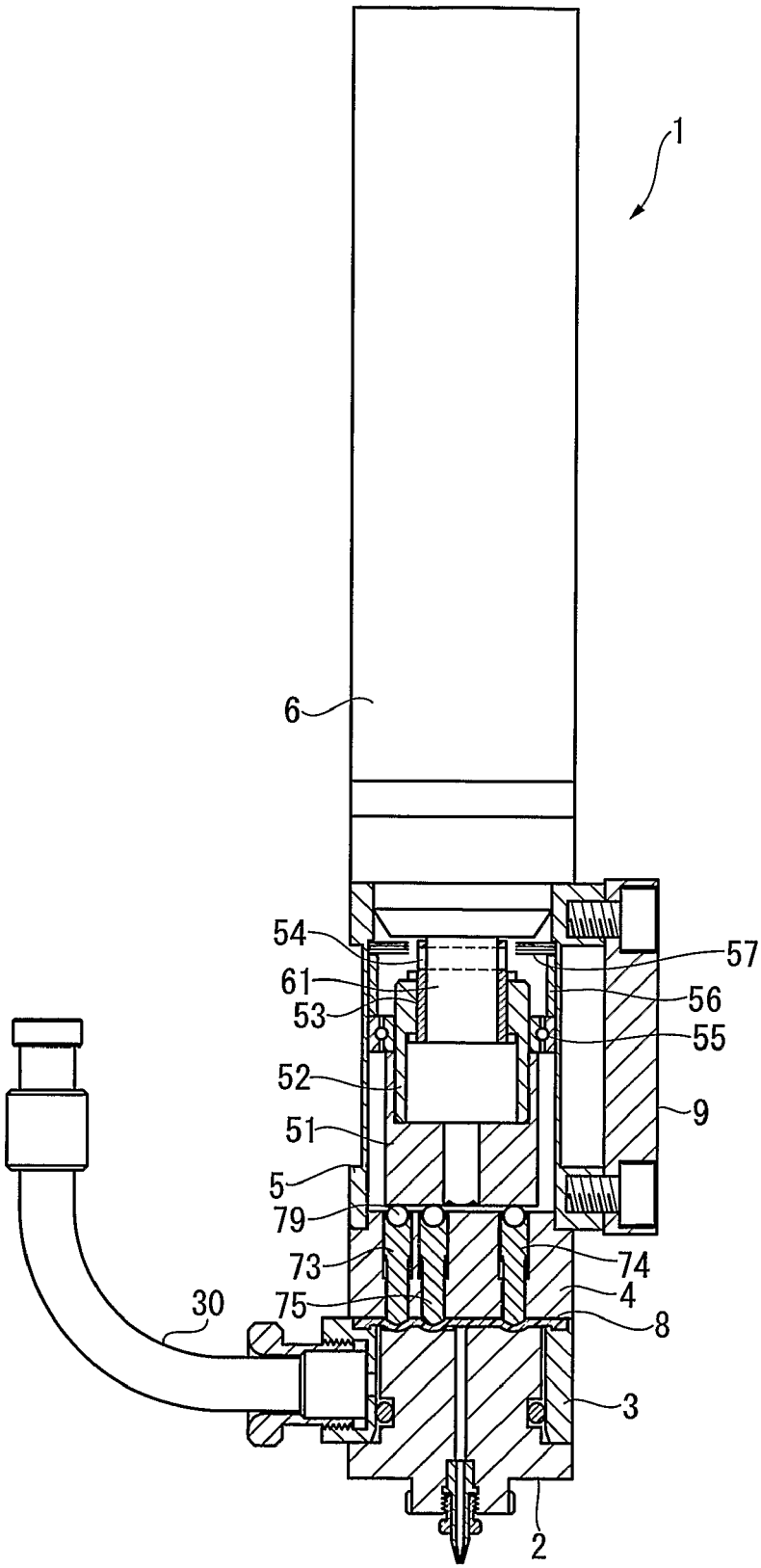
FIG. 1 is an illustration showing a first embodiment of the present invention.

FIG. 1 is a schematic view of the first embodiment of a diaphragm pump 1 according to the present invention.

The diaphragm pump 1 has a base block 2, a holder ring block 3, a guide block 4, a fitting block 5 and a drive unit 6.

Each of the blocks 2 through 5 is provided with through holes (not shown) at the four corners thereof. Each of the blocks 2 through 5 is assembled by means of a coupling bolt penetrating through the base block 2 and the holder ring block 3 to be screwed into the guide block 4, a coupling bolt screwed into the guide block 4 via the fitting block 5, a coupling bolt screwed into the drive unit 6 via the fitting block 5 and so on. Positioning pins are also used to align the blocks.

Figure 2:
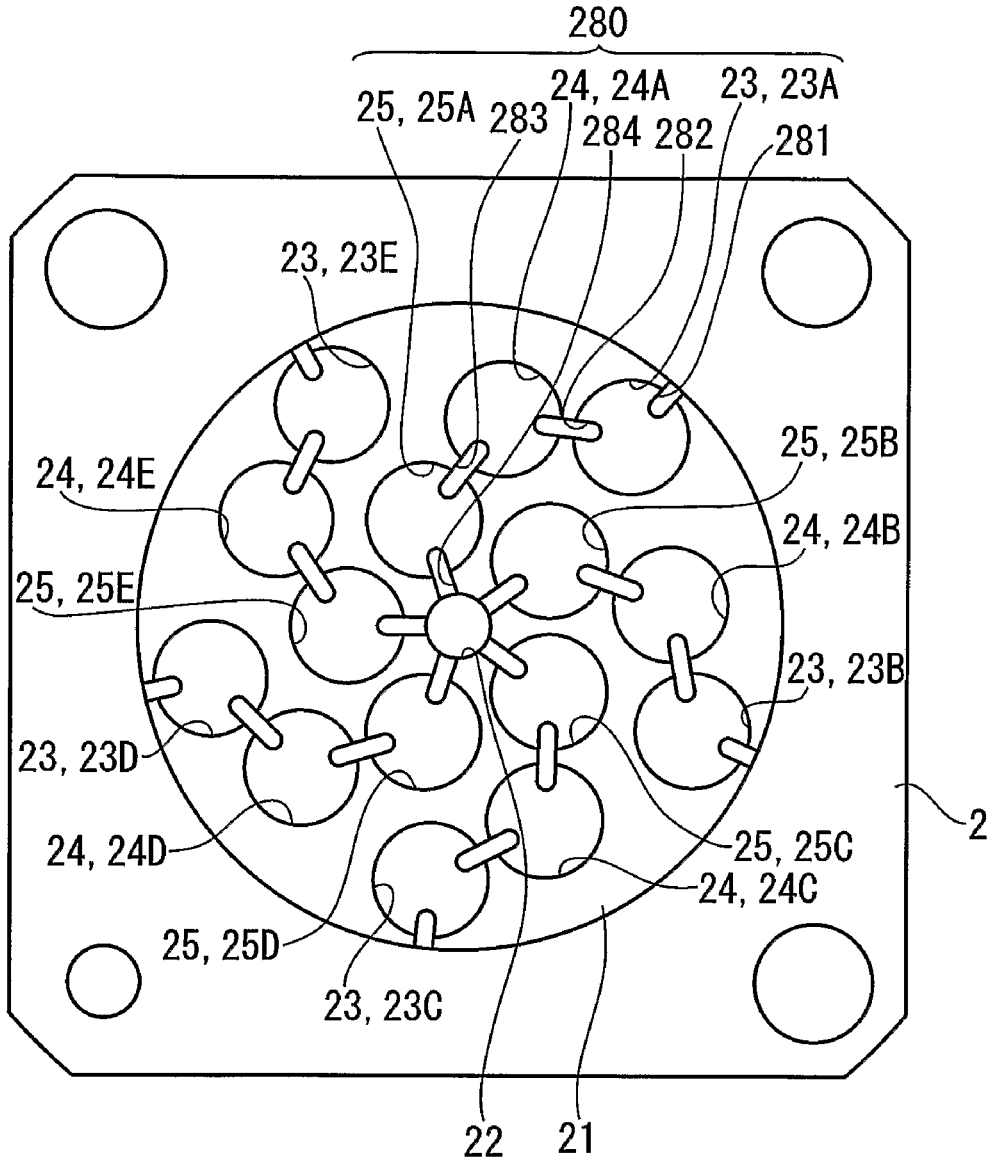
FIG. 2 is a plan view of a recess forming surface of a base block of the embodiment.
Figure 3:
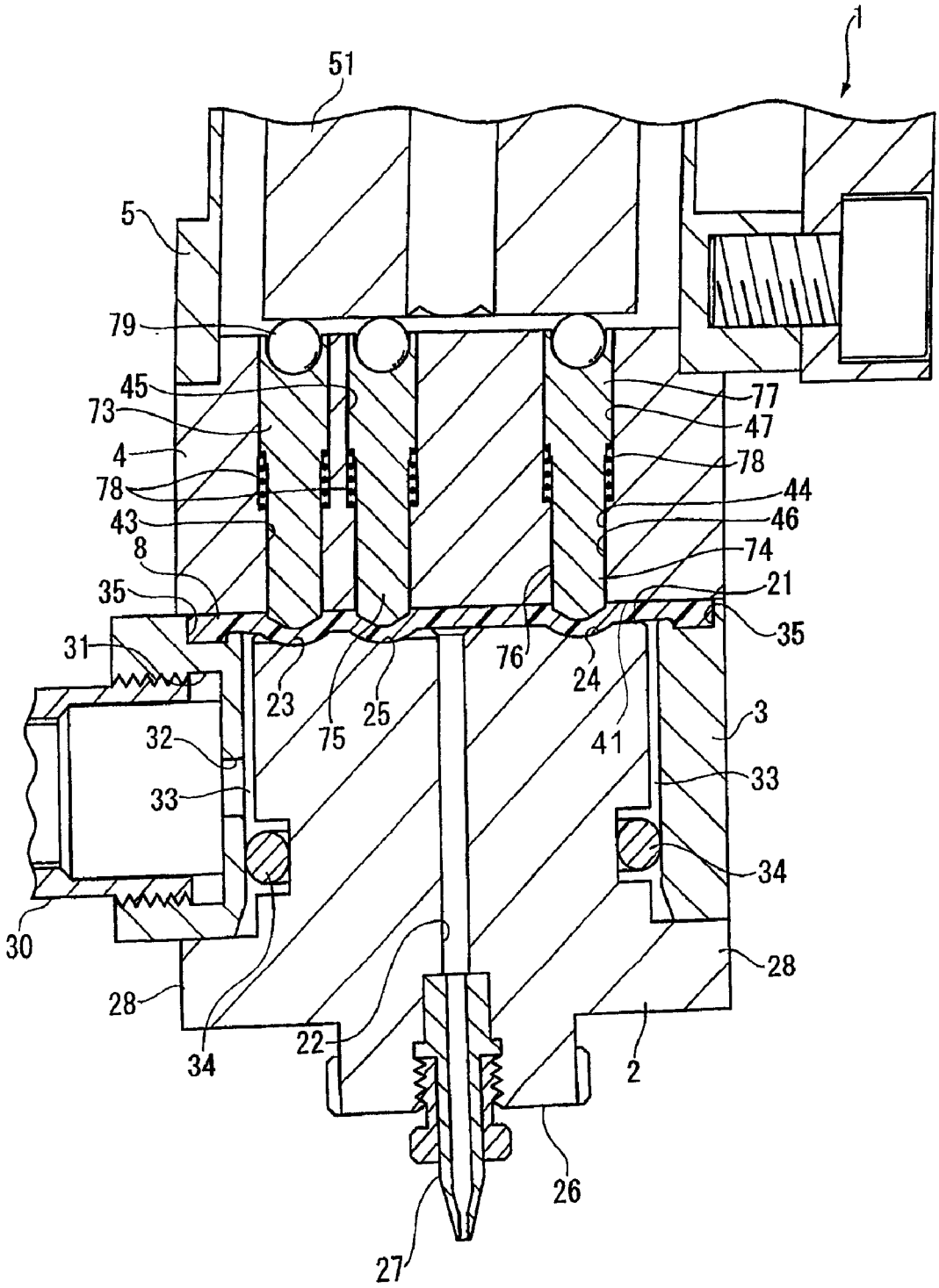
FIG. 3 is a cross section of a principal part of the embodiment.

As shown in FIGS. 2 and 3, the base block 2 has a recess forming surface 21 that is a diaphragm-contacting surface opposed to the guide block 4. The recess forming surface 21 is formed by a planar area defined to show a substantially circular boundary. A port 22 is formed around the central axis of the recess forming surface 21 so as to define a discharge flow path or suction flow path of liquid and a plurality of recesses 23 through 25 are formed around it.

The port 22 penetrates from the center of the recess forming surface 21 to the opposite surface 26 of the base block 2.

In the present embodiment, a nozzle member 27 is fitted to the opening at an end of the port 22 on the side of surface 26 and the port 22 is utilized as discharge port (discharge flow path).

The recess forming surface 21 is provided with first recess 23 formed along the outer circumference of the recess forming surface 21, second recess 24 formed on an inner side relative to the first recess 23 and third recess 25 arranged inside relative to the second recess 24 and hence around the port 22. Each of recesses 23 through 25 is a recess formed in a semispherical profile. The first recess 23 intercommunicates with the outside of the outer circumference of the recess forming surface 21 via a communication groove 281. The second recess 24 intercommunicates with the first recess 23 via a communication groove 282 and with the third recess 25 via a communication groove 283. The third recess 25 intercommunicates with the port 22 via a communication groove 284.

In other words, recessed grooves formed on the diaphragm-contacting surface include the first recess 23, the second recess 24, the third recess 25 and the communication grooves 281 through 284 formed on the recess forming surface 21, which is the diaphragm-contacting surface of the base block 2. Liquid flow paths 280 are formed by the spaces defined by the recessed grooves and a diaphragm 8. A total of five sets of liquid flow paths 280 are provided in the present embodiment.

More specifically, the first recess 23 includes five recesses 23A through 23E and the second recess 24 includes five recesses 24A through 24E, while the third recess 25 includes five recesses 25A through 25E.

Figure 4:
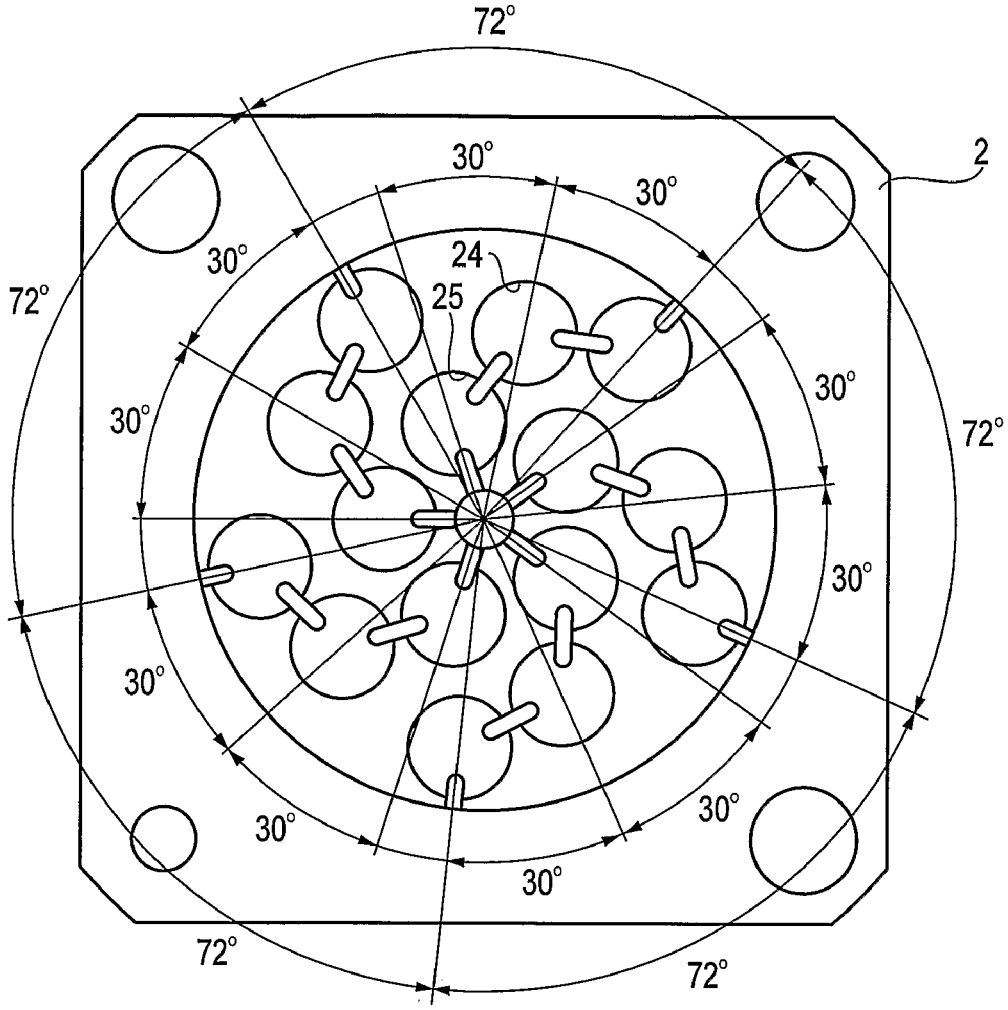
FIG. 4 is an illustration of the disposition of a recess on the recess forming surface.

In the present embodiment, the first recesses 23 (23A through 23E) and the second recesses 24 (24A through 24E) are arranged in such a way that the lines connecting the centers of the recesses 23, 24 and the center of the port 22 form an angle of intersection of a first defined angle, which is equal to 30° as shown in FIG. 4. Similarly, the second recesses 24 (24A through 24E) and the third recesses 25 (25A through 25E) are arranged in such a way that the lines connecting the centers of the recesses 24, 25 and the center of the port 22 form an angle of intersection of the first defined angle, which is equal to 30°.

Additionally, the recesses 23, 24, 25 are arranged in such a way that the length of the lines connecting the center of the port 22 and the centers of the recesses 23, the length of the lines connecting the center of the port 22 and the centers of the recesses 24, and the length of the lines connecting the center of the port 22 and the centers of the recesses 25 become smaller in the mentioned order.

Thus, as a result, the recesses 23A through 23E, 24A through 24E and 25A through 25E are arranged to extend spirally from the center of the port 22.

In the present embodiment, a total of five sets of recesses 23 through 25 are provided and the first recesses 23A through 23E are arranged around the port 22 at an angular pitch of 360/5=72° (a second defined angle). Similarly, the second recesses 24A through 24E are arranged at an angular pitch of 72° (the second defined angle) and so are the third recesses 25A through 25E.

The holder ring block 3 has a substantially hollow cylindrical profile and fitted to the outer periphery of the base block 2. More specifically, the holder ring block 3 is pinched between the flange 28 of the base block 2 and the guide block 4. The holder ring block 3 is provided with a port 31 that operates as liquid supply hole or discharge hole. In the present embodiment, the port 31 is threaded and a liquid transfer tube 30 is attached thereto.

The port 31 of the holder ring block 3 intercommunicates with a space 33 that is formed at the inner periphery side of the holder ring block 3, or between the holder ring block 3 and the base block 2, by way of a through hole 32.

A seal member 34 that is typically an O-ring is arranged in the space 33 at a position closer to the flange 28 than the through hole 32 in order to prevent liquid in the space 33 from leaking to the outside through the abutting surfaces of the flange 28 and the holder ring block 3.

The diaphragm 8 is fitted to an end surface of the holder ring block 3 that faces the guide block 4. More specifically, a ring-shaped recessed groove 35 is formed on the end surface of the holder ring block 3 and the peripheral edge of the diaphragm 8 is fitted to the recessed groove 35. The peripheral edge of the diaphragm 8 is pinched between the holder ring block 3 and the guide block 4.

Thus, the space 33 is defined by the seal member 34 and the diaphragm 8 so that liquid in the space is prevented from leaking to the outside. In the present embodiment, a suction flow path of liquid is formed by the space 33 and a flow path block is formed by the base block 2 and the holder ring block 3.

Therefore, in the present embodiment, the first recess 23 operate as suction valve chamber recess and the second recess 24 operate as metering chamber recess, while the third recess 25 operate as discharge valve chamber recess.

The diaphragm 8 is made of elastically deformable rubber (synthetic rubber, natural rubber) or the like and has a substantially disk-shaped profile. The flow-path-block-contacting surface of the diaphragm 8 that is closely contacted to the base block 2 shows a planar profile. Pressing-rod-abutting surface of the diaphragm 8 that abuts on pressing rods 73 through 75 also shows a planar profile. In the present embodiment, the diaphragm 8 has a thickness of about 1 mm.

The gap between the recess forming surface 21 and an end surface 41 of the guide block 4 that faces the recess forming surface 21 is 0.9 mm, which is slightly smaller than the thickness of the diaphragm 8. Thus, when the blocks 2 through 5 are assembled, the diaphragm 8 is pinched between the planar area other than the recesses 23 through 25 and the guide block 4 and pressed against the recess forming surface 21 by a predetermined pressure. Therefore, each of the recesses 23 through 25 is defined by the diaphragm 8 that is closely contacted to the recess forming surface 21 so as to intercommunicate with all the other recesses 23 through 25 only by way of the communication grooves 281 through 284. With this arrangement, the space defined by the first recess 23 and the diaphragm 8 operates as suction valve chambers and the space defined by the second recess 24 and the diaphragm 8 operates as valve chambers, while the space defined by the third recess 25 and the diaphragm 8 operates as discharge valve chambers. Additionally, the spaces defined by the communication grooves 281 through 284 and the diaphragm 8 operate as communication paths. The liquid flow paths 280 include the respective valve chambers, the metering chamber and the communication paths.

Figure 5:
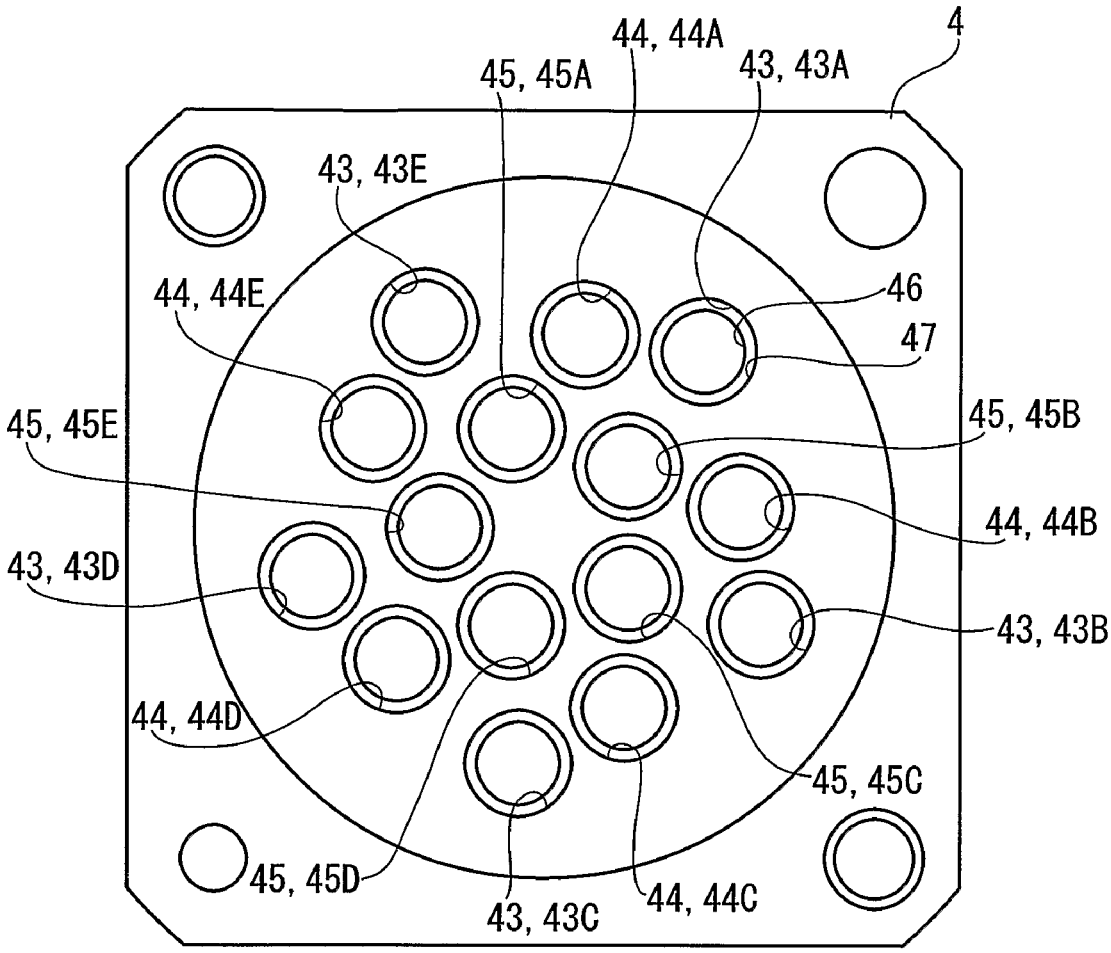
FIG. 5 is a plan view of a guide block of the embodiment.

As shown also in FIG. 5, the guide block 4 is provided with guide holes 43 through 45 penetrating in an axial direction at respective positions corresponding to the recesses 23 through 25 of the base block 2. More specifically, first guide holes 43A through 43E are arranged so as to be coaxial respectively with the first recesses 23A through 23E and second guide holes 44A through 44E are arranged so as to be coaxial respectively with the second recesses 24A through 24E, while third guide holes 45A through 45E are arranged so as to be coaxial respectively with the third recesses 25A through 25E.

Each of the guide holes 43 through 45 is provided with a step at an axially intermediate position to have different diameters. The guide hole has a small diameter hole section 46 at the side of the end surface 41 and a large diameter hole section 47 at the side of the fitting block 5. The large diameter hole section 47 has a diameter larger than the small diameter hole section 46.

Pressing members, or pressing rods 73 through 75, are inserted into the respective guide holes 43 through 45. More specifically, the first pressing rods 73 are inserted respectively into the first guide holes 43A through 43E and the second pressing rods 74 are inserted respectively into the second guide holes 44A through 44E, while the third pressing rods 75 are inserted respectively into the third guide holes 45A through 45E. The first pressing rods 73 that are arranged to correspond to the suction valve chambers operate as suction side pressing members and the second pressing rods 74 that are arranged to correspond to the metering chambers operate as metering-chamber pressing members, while the third pressing rods 75 that are arranged to correspond to the discharge valve chambers operate as discharge side pressing members.

The pressing rods 73 through 75 respectively have small diameter sections 76 that are inserted into the small diameter hole sections 46 and large diameter sections 77 that are inserted into the large diameter hole sections 47 of the respective guide holes 43 through 45. The axial length of the small diameter sections 76 is larger than the axial length of the small diameter hole sections 46, so that a space is produced between the step formed by the small diameter hole section 46 and the large diameter hole section 47 and the step formed by the small diameter section 76 and the large diameter section 77 as shown in FIG. 3. A coil spring 78 is arranged in the spaces to bias the pressing rods 73 through 75 in a direction away from the diaphragm 8.

The end surface of each of the pressing rods 73 through 75 facing the diaphragm 8 is formed in a semispherical profile. Thus, as the pressing rods 73 through 75 are driven to move toward the diaphragm 8, the diaphragm 8 are closely contacted to the semispherical surfaces of the recesses 23 through 25. However, since the communication grooves 281 through 284 have a small width, the diaphragm 8 do not enter the communication grooves 281 through 284 and hence the communication grooves 281 through 284 always intercommunicate with each other.

On the other hand, a substantially semispherical recess is formed on the other end surface of each of the pressing rods 73 through 75 and a ball 79 is housed in the recess.

The fitting block 5 shows a hollow cylindrical profile with a through hole running inside. The through hole has a substantially circular cross section and a cam 51 that is driven to rotate by the drive unit 6 is provided therein. The cam 51 may be directly attached to an output shaft 61 of the drive unit 6, although it is attached to the output shaft 61 via a spline boss 52 and a spline shaft 53 in the present embodiment. More specifically, the spline shaft 53 is attached to the output. Shaft 61 by means of a pin 54 so that it can rotate integrally with the output shaft 61. The spline boss 52 is pressed into the cam 51. The spline boss 52 and the cam 51 are arranged in such a way that they can slide relative to the spline shaft 53 in an axial direction of the output shaft 61 and rotate integrally with the spline shaft 53 and the output shaft 61.

The cam 51 and the spline boss 52 are rotatably supported by a ball bearing 55 relative to the fitting block 5. The ball bearing 55 and the cam 51 are biased toward the guide block 4 by a coned disk spring 57 and via a spacer ring 56 while the pressing rods 73 through 75 are biased toward the cam 51 by the respective coil springs 78. Thus, cam face 511 of the cam 51 constantly abuts the ball 79. In other words, the coned disk spring 57 and the coil springs 78 operate as biasing unit that forces the balls 79 of the pressing rods 73 through 75 to respectively abut the corresponding cam faces 511 of the cam 51.

Figure 6A:
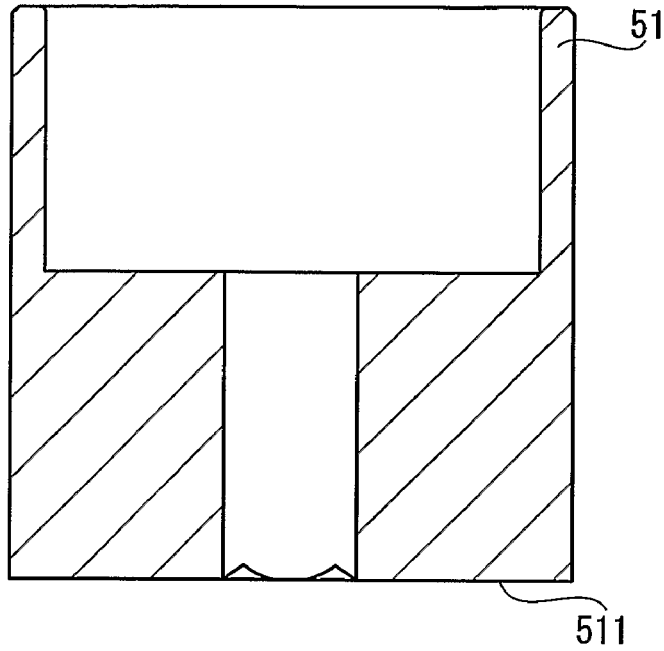
FIG. 6A is a cross section of a cam of the embodiment.
Figure 6B:
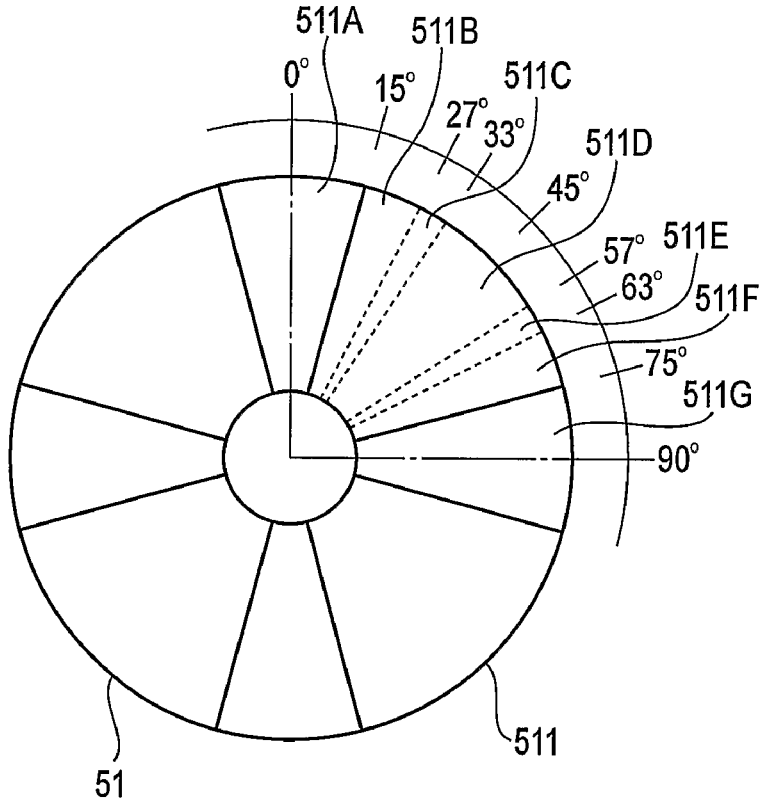
FIG. 6B is a plan view of a cam face of the embodiment.

As shown in FIGS. 6A and 6B, the cam 51 is an end cam (solid cam) having end surface that operates as cam face 511. The cam face 511 has a profile as illustrated in the cam diagram of FIG. 7. More specifically, the cam 51 has a through hole at the central axis thereof and the cam face 511 is formed around the through hole to show a ring-shaped profile.

Figure 7:
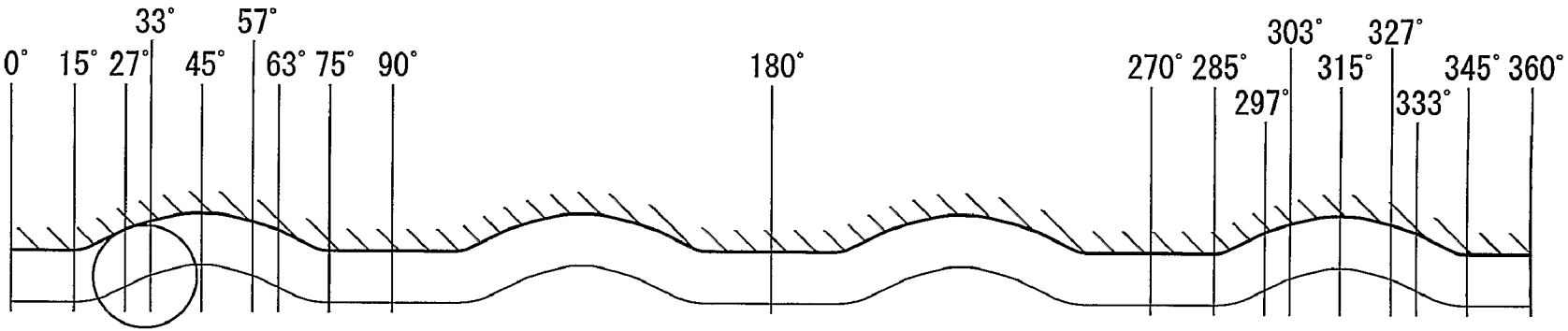
FIG. 7 is a cam diagram of the cam of the embodiment.

FIG. 7 shows a cam diagram illustrating the profile of the cam face 511. The y-axis of the cam diagram is so selected as to define the lowest position of the cam (y=0) where the cam face 511 is located closest to the diaphragm 8 and the highest position of the cam (e.g., y=0.5 mm in the present embodiment) where the cam face 511 is located remotest from the diaphragm 8. On the other hand, the x-axis of the cam diagram defining a state where the ball 79 of the first pressing rod 73 abuts the lowest positions of the cam (y=0) as 0° shows the rotation angle of the cam 51, or the rotation angle of the cam face 511 relative to the ball 79 from the position. Note that the cam diagram also illustrates the locus of movement of the center position of the ball 79.

In the present embodiment, the cam face 511 operates with a cycle of 90° and the above operation is repeated for every 90°, or from 90° to 180°, from 180° to 270° and from 270° to 360°. Therefore, only the cycle from 0° to 90° will be described below.

When the rotation angle of the cam 51 is between 0° and 15°, a cam face 511A remains at the lowest position (y=0). In other words, the cam face 511A is formed by a plane orthogonal to the rotary shaft of the cam 51.

When the rotation angle of the cam 51 is between 15° and 27°, the radial profile of a cam face 511B is expressed, for instance, by a quadratic curve of $y=(x-15)^2/864$.

When the rotation angle of the cam 51 is between 27° and 33°, the radial profile of a cam face 511C is expressed, for instance, by a straight line of $y=x/36-7/12$.

When the rotation angle of the cam 51 is between 33° and 57°, the radial profile of a cam face 511D is expressed, for instance, by a quadratic curve of $y=0.5-(x-45)^2/864$.

When the rotation angle of the cam 51 is between 57° and 63°, the radial profile of a cam face 511E is expressed, for instance, by a straight line of $y=-x/36+23/12$.

When the rotation angle of the cam 51 is between 63° and 75°, the radial profile of a cam face 511F is expressed, for instance, by a quadratic curve of $y=(x-75)^2/864$.

When the rotation angle of the cam 51 is between 75° and 90°, the radial profile of a cam face 511G is a plane same as that of the cam face 511A.

The cam faces 511A through 511G are radially arranged from the central axis of the cam faces 511. In other words, the boundary lines of the cam faces 511A through 511G are straight lines extending radially from the central axis of the cam face 511.

Thus, as the spline shaft 53, the spline boss 52 and the cam 51 are rotated by the drive unit 6, the ball 79 and the pressing rods 73 through 75 axially advance and retract along the profile of the cam face 511. Then, as the pressing rods 73 through 75 move toward the respective recesses 23 through 25, the volumes of the respective valve chambers and the metering chamber defined by the portions of the diaphragm 8 that correspond to the recesses 23 through 25 (portions of the diaphragm 8 corresponding to the recesses on which the pressing rods 73 through 75 respectively abut) and the recesses 23 through 25 decrease until the portions of the diaphragm 8 corresponding to the recesses closely contacts the inner surfaces of the respective recesses 23 through 25. In other words, the pressing rods 73 through 75 operate for volume decrease.

Then, as the pressing rods 73 through 75 move away from the respective recesses 23 through 25, the portions of the diaphragm 8 corresponding to the recesses detach from the inner surfaces of the respective recesses 23 through 25, to which they have been closely attached, to consequently increase the volumes of the respective valve chambers and the metering chamber defined between the recesses 23 through 25 and the diaphragm 8. In other words, the pressing rods 73 through 75 operate for volume increase.

The materials of the pressing rods 73 through 75, the ball 79 and the cam 51 are selected and the surfaces of any of them may or may not be coated by a selected coating method so as to make the coefficient of friction between each of the pressing rods 73 through 75 and the ball 79 lower than the coefficient of friction between the ball 79 and the cam face 511.

More specifically, the ball 79 is hard ball made of a super hard alloy such as tungsten carbide. The cam 51 is also made of metal such as carbon tool steel processed by quenching and polishing, so that the cam face 511 is very hard.

On the other hand, the pressing rods 73 through 75 and the spline boss 52 may be made of plastic (synthetic resin). The pressing rod 73 is normally made of a resin material and hence softer than the ball 79, but the surface may be finished with DLC coating or the like to provide as hard surface as that of the ball 79. In short, the materials of the related components may be so selected that the coefficient of friction between each of the pressing rods 73 through 75 and the ball 79 becomes lower than the coefficient of friction between the cam face 511 and the ball 79. However, it should be noted that, although each of the pressing rods 73 through 75 is mentioned to be softer compared to the ball 79, but is should be hard enough not to be deformed in abutting the ball 79 because the displacement of the cam face 511 have to be transmitted to the diaphragm 8 via the ball 79 and each of the pressing rods 73 through 75.

The drive unit 6 may take any form so long as it is a drive source that can rotate the output shaft 61, and various motors may be used. In the present embodiment, a servo motor provided with a reduction gear is employed.

A fitting plate 9 is secured to the fitting block 5 by means of screws. The diaphragm pump 1 can be fitted to any of various manufacturing devices or robot arms by way of the fitting plate 9.

Since liquid is transferred through each of the liquid flow paths 280 in the present embodiment, each of the liquid flow paths 280 operates as pump. More specifically, in the present embodiment, the respective valve chambers, the metering chamber (recesses 23 through 25), the pressing rods 73 through 75, the communication paths (communication grooves 281 through 284) and the diaphragm 8 arranged along the liquid flow paths 280 form a plurality of pumps for transferring liquid and these plurality of pumps constitute the diaphragm pump 1 so that the pump 1 can continuously transfer liquid at a constant rate with minimal pulsation.

Additionally, in the present embodiment, a pressing member drive controller is formed by the cam 51, the spline boss 52, the spline shaft 53, the coned disk spring 57, the drive unit 6 and the coil springs 78 to control the operation of driving the pressing rods 73 through 75 and a drive unit for driving the diaphragm 8 to reciprocate is formed by the pressing member drive controller and the pressing rods 73 through 75.

Next, an operation of the embodiment will be described with reference to FIGS. 8A through 12.

[Operation of Pressing Rods]

Firstly, the operation of the pressing rods 73 through 75 will be described. Each of the pressing rods 73 through 75 performs operation corresponding to the profile of the cam face 511 of the cam 51.

As described above, when the rotation angle of the cam 51 is between 0° and 15°, the cam face 511 remains at the lowest position (y=0) so that the balls 79 and the pressing rods 73 through 75 do not move axially with the diaphragm 8 being closely contacted to the inner surfaces of the recesses 23 through 25.

With the cam face 511 in the rotation angle between 15° and 27°, the balls 79 and the pressing rods 73 through 75 move away from the diaphragm 8 at a constant acceleration.

With the cam face 511 in the rotation angle between 27° and 33°, the balls 79 and the pressing rods 73 through 75 move away from the diaphragm 8 at a constant speed.

With the cam face 511 in the rotation angle between 33° and 45°, the balls 79 and the pressing rods 73 through 75 move away from the diaphragm 8 at a constant acceleration.

With the cam face 511 in the rotation angle between 45° and 57°, the balls 79 and the pressing rods 73 through 75 move toward the diaphragm 8 at a constant acceleration.

With the cam face 511 in the rotation angle between 57° and 63°, the balls 79 and the pressing rods 73 through 75 move toward the diaphragm 8 at a constant speed.

With the cam face 511 in the rotation angle between 63° and 75°, the balls 79 and the pressing rods 73 through 75 move away from the diaphragm 8 at a constant acceleration.

When the rotation angle of the cam 51 is between 75° and 90°, the cam face 511 remains at the lowest position (y=0), so that the balls 79 and the pressing rods 73 through 75 do not move axially with the diaphragm 8 being closely contacted to the inner surfaces of the recesses 23 through 25.

The cam faces 511 operate with a cycle of 90° and the above operation is repeated for every 90°, namely, from 90° to 180°, from 180° to 270° and from 270° to 360°.

Therefore, each of the pressing rods 73 through 75 axially reciprocate as the ball 79 abuts on the respective cam faces 511 and revolves to move (rotate) along the cam faces 511. By the time when the cam 51 makes a full turn, each of the pressing rods 73 through 75 finishes four cycles of reciprocation. The stroke of each cycle is 0.5 mm in the present embodiment.

As each of the pressing rods 73 through 75 reciprocates, the diaphragm 8 moves in a direction contacting the recesses 23 through 25 to decrease the volume of the respective valve chambers and the metering chamber and then moves in a direction away from the recesses 23 through 25 to increase the volume of the respective valve chambers and the metering chamber. As a result, liquid is sucked into and discharged from the respective valve chambers and the metering chamber.

[Operation of Pumps (Three Pressing Rods)]

Now, the operation of the pumps of the diaphragm pump 1 will be described by exemplifying the operation of the first pressing rod 73, the second pressing rod 74 and the third pressing rod 75 that are inserted respectively into the first guide hole 43A, the second guide hole 44A and the third guide hole 45A.

In the following description, the cam 51 rotates counterclockwise relative to the recess forming surface 21 shown in FIG. 2 (or clockwise if the cam 51 is viewed from the side of the cam face 511) so that the liquid is sucked from the space 33 at the outer circumference side of the recess forming surface 21 and discharged from the central port 22.

Figure 8A:
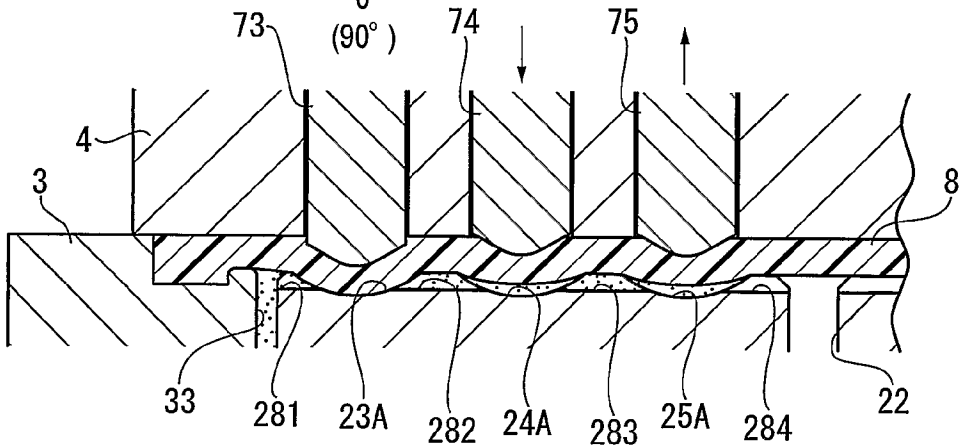
FIG. 8A is a cross section showing a state where a first pressing rod of the embodiment is at the 0° position of the cam face.
Figure 8B:
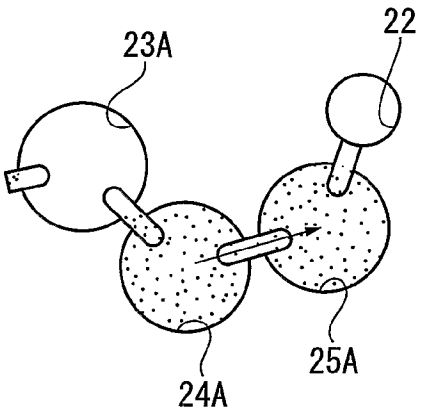
FIG. 8B is a plan view showing the state of FIG. 8A.

FIGS. 8A, 8B illustrate a state where the ball 79 of each of the first pressing rods 73 is at the 0° position of the cam face 511. In this state, the second pressing rod 74 is located at a position behind the first pressing rod 73 by 30° and hence the ball 79 thereof is located at 330° position of the cam faces 511. Similarly, in this state, the third pressing rod 75 is located at a position behind the second pressing rod 74 by 30° and hence the ball 79 thereof is located at 300° position of the cam face 511.

Thus, the first pressing rod 73 is at the position of displacement 0, where it presses the diaphragm 8 against the first recess 23A in a closely-contacted manner, and hence the suction valve chamber defined by the first recess 23A and a portion of the diaphragm 8 corresponding to the recess 23A is held to a hermetically sealed condition. The second pressing rod 74 is at the position of displacement of 0.25, or the position of a half of the stroke of movement. The third pressing rod 75 is also at the position of displacement of 0.25, namely, the position of a half of the stroke of movement. Since the pressing rods 74, 75 are located respectively at those positions, the volume of metering chamber and the discharge valve chamber defined by the second recess 24A, the third recess 25A and portions of the diaphragm 8 corresponding to the recesses 24A, 25A reflect the respective positions of the pressing rods 74, 75.

Figure 8C:
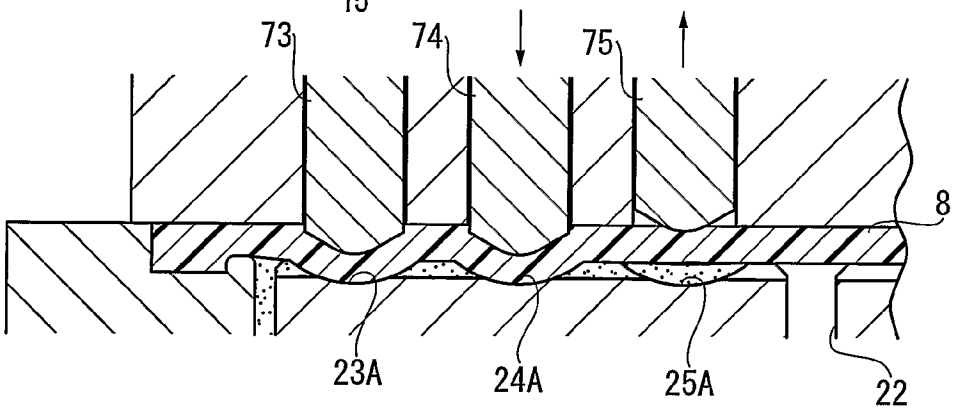
FIG. 8C is a cross section showing a state where the first pressing rod of the embodiment is at the 15° position of the cam face.
Figure 8D:
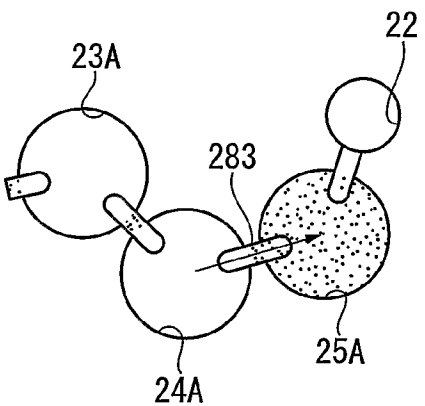
FIG. 8D is a plan view showing the state of FIG. 8C.

As the cam 51 is rotated by 15° from the state of FIGS. 8A, 8B, a state of FIGS. 8C, 8D arises. More specifically, the ball 79 of the first pressing rod 73 reaches to the position of 15° of the cam face 511 but, since the cam face 511A is a plane in this phase of operation, the first pressing rod 73 is not displaced and keeps the suction valve chamber to a hermetically sealed condition.

At this time, the ball 79 of the second pressing rod 74 moves from the 330° to 345° of the cam face 511 and the second pressing rod 74 moves from the position of displacement 0.25 mm to the position of displacement 0 mm to come closer to the diaphragm 8. As a result of this movement, the volume of the metering chamber is gradually decreased so that the liquid in the metering chamber is transferred to the discharge valve chamber via the communication groove 283.

Similarly, the ball 79 of the third pressing rod 75 moves from 300° to 315° of the cam face 511 and the third pressing rod 75 moves from the position of displacement 0.25 mm to the position of displacement 0.5 mm to be away from the diaphragm 8. As a result, the volume of the discharge valve chamber is gradually increased, so that the liquid transferred from the metering chamber is sucked into the discharge valve chamber. In this way, the second transfer step is carried out between the state of FIG. 8A and that of FIG. 8D.

Figure 9A:
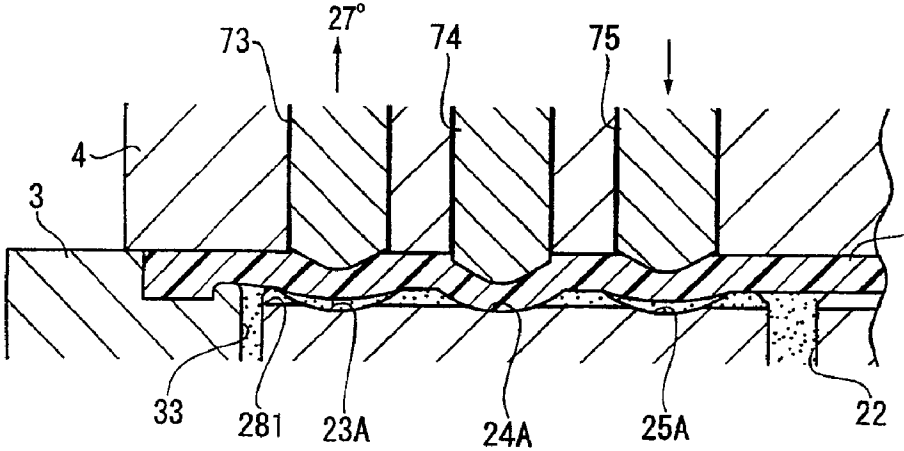
FIG. 9A is a cross section showing a state where the first pressing rod of the embodiment is at the 27° position of the cam face.
Figure 9B:
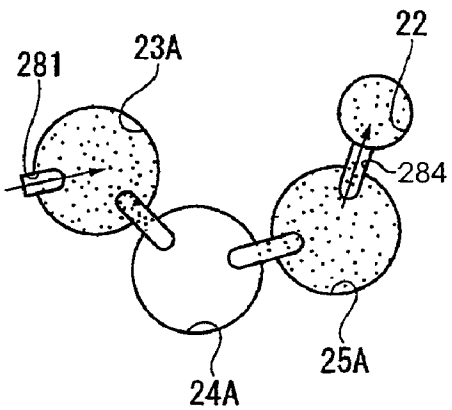
FIG. 9B is a plan view showing the state of FIG. 9A.

As the cam 51 is rotated by 12° from the state of FIGS. 8C, 8D, a state of FIGS. 9A, 9B arises. More specifically, the ball 79 of the first pressing rod 73 moves from 15° to 27° of the cam face 511 and the first pressing rod 73 moves away from the diaphragm 8 from the position of displacement 0 mm to the position of displacement ⅙ mm. As a result of the movement, the volume of the suction valve chamber is gradually increased, so that the liquid is sucked into the suction valve chamber from the space 33 at the outer circumference of the recess forming surface 21 via the communication groove 281.

At this time, the ball 79 of the second pressing rod 74 moves from 345° to 357° of the cam face 511 but the second pressing rod 74 remains at the position of displacement 0 mm without moving axially. Thus, the diaphragm 8 keeps in close contact with the second recess 24A and hence the metering chamber is held to a hermetically sealed condition, so that no liquid is moved via the metering chamber.

On the other hand, the ball 79 of the third pressing rod 75 moves from 315° to 327° of the cam face 511 and the third pressing rod 75 moves toward the diaphragm 8 from the position of displacement 0.5 mm to the position of displacement ⅓ mm. As a result of the movement, the volume of the discharge valve chamber is gradually decreased, so that the liquid in the discharge valve chamber is transferred to the port 22 via the communication groove 284. Thus, liquid is discharged from the nozzle member 27 at the end of the port 22 at a rate corresponding to the rate of decreasing the volume of the discharge valve chamber.

Thus, the liquid suction step and the liquid discharge step are carried out simultaneously between the state of FIG. 8C and that of FIG. 9B.

Although not shown in the drawings, as the ball 79 of the first pressing rod 73 moves from 27° to 33° of the cam face 511 in response to the rotation of the cam 51, the first pressing rod 73 moves further away from the diaphragm 8 from the position of displacement ⅙ mm to the position of displacement ⅓ mm. As a result of this movement, the volume of the suction valve chamber is gradually increased, so that the liquid is sucked into the suction valve chamber from the outer circumference of the recess forming surface 21 via the communication groove 281 to continue the suction step.

At this time, the ball 79 of the second pressing rod 74 moves from 357° to 3° of the cam face 511 but the second pressing rod 74 remains at the position of displacement 0 mm without moving axially. Thus, the diaphragm 8 is kept in close contact with the second recess 24A and hence the metering chamber is held to a hermetically sealed condition, so that no liquid is transferred via the metering chamber.

On the other hand, the ball 79 of the third pressing rod 75 moves from 327° to 333° of the cam face 511 and the third pressing rod 75 further moves toward the diaphragm 8 from the position of displacement ⅓ mm to the position of displacement ⅙ mm. As a result of the movement, the volume of the discharge valve chamber is gradually decreased, so that the transfer of the liquid in the discharge valve chamber to the port 22 and the discharge of liquid from the nozzle member 27 are continued, and the discharge step is continued.

Figure 9C:
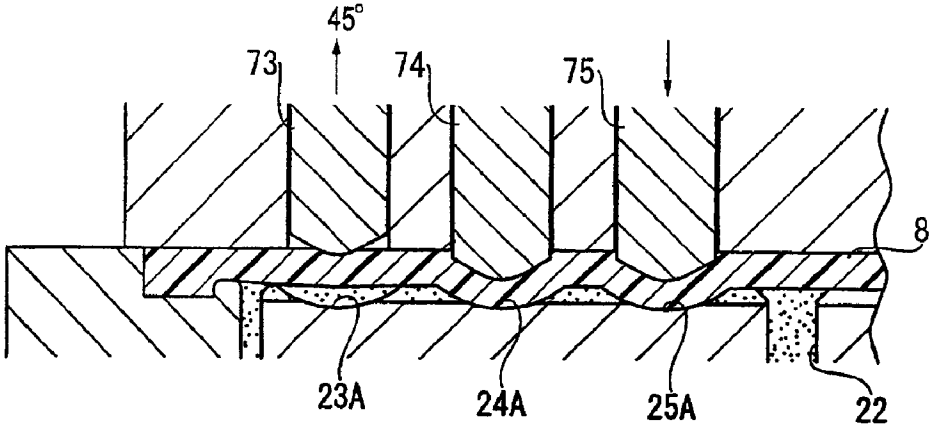
FIG. 9C is a cross section showing a state where the first pressing rod of the embodiment is at the 45° position of the cam face.
Figure 9D:
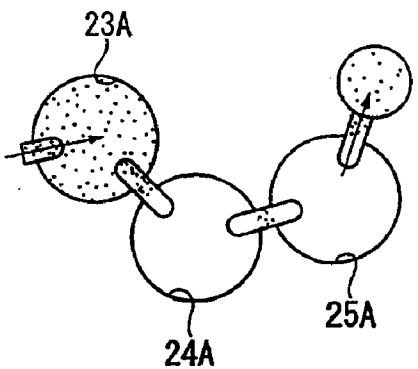
FIG. 9D is a plan view showing the state of FIG. 9C.

As the cam 51 is further rotated and the ball 79 of the first pressing rod 73 reaches 45° from 33° of the cam face 511, a state of FIGS. 9C, 9D arises.

More specifically, the first pressing rod 73 moves away from the diaphragm 8 from the position of displacement ⅓ mm to the position of displacement 0.5 mm. As the first pressing rod 73 reaches the position of 0.5 mm, the stroke of movement toward the cam 51 comes to an end and the volume of the suction valve chamber is maximized, so that the liquid suction step of sucking liquid from the space 33 into the suction valve chamber is completed.

At this time, the ball 79 of the second pressing rod 74 moves from 3° to 15° of the cam face 511 but the second pressing rod 74 remains at the position of displacement 0 mm without moving axially. As a result, the metering chamber is held to a hermetically sealed condition.

On the other hand, the ball 79 of the third pressing rod 75 moves from 333° to 345° of the cam face 511 and the third pressing rod 75 moves toward the diaphragm 8 from the position of displacement ⅙ mm to the position of displacement 0 mm. As a result, the volume of the discharge valve chamber is further decreased, so that the transfer of liquid from the discharge valve chamber to the port 22 and the discharge of liquid from the nozzle member 27 are continued until the third pressing rod 75 reaches 345° of the cam face 511. As the third pressing rod 75 moves to 345° of the cam face 511, the diaphragm 8 closely contacts to the third recess 25A to hermetically close the discharge valve chamber, so that the discharge of liquid from the discharge valve chamber, namely, the liquid flow path 280, to the port 22 stops to complete the liquid discharge step.

Therefore, the liquid suction step and the liquid discharge step are continued between the state of FIG. 8C and that of FIG. 9D.

Figure 10A:
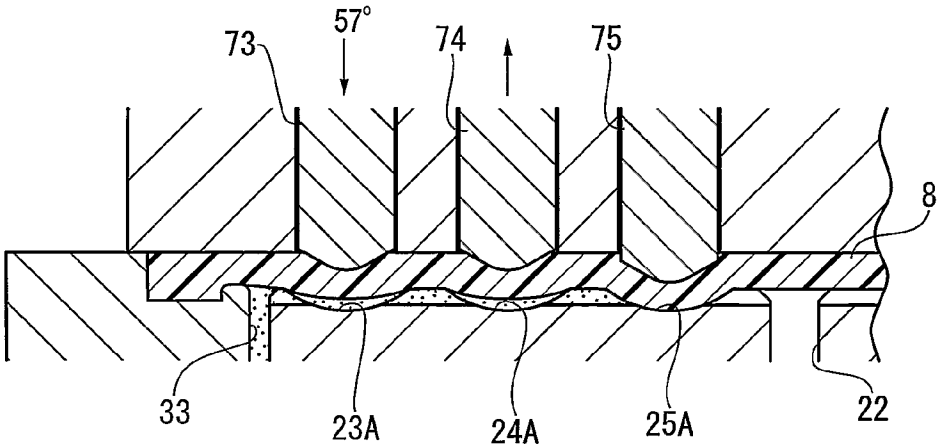
FIG. 10A is a cross section showing a state where the first pressing rod of the embodiment is at the 57° position of the cam face.
Figure 10B:
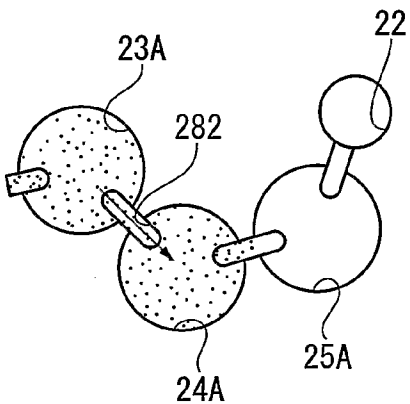
FIG. 10B is a plan view showing the state of FIG. 10A.

As the cam 51 is further rotated and the ball 79 of the first pressing rod 73 reaches 57° from 45° of the cam face 511, a state of FIGS. 10A, 10B arises.

More specifically, the first pressing rod 73 moves toward the diaphragm 8 from the position of displacement 0.5 mm to the position of displacement ⅓ mm. As a result of this movement, the volume of the suction valve chamber is gradually decreased so that liquid is transferred from the suction valve chamber to the metering chamber by way of the communication groove 282.

At this time, the ball 79 of the second pressing rod 74 moves from 15° to 27° of the cam face 511 and the second pressing rod 74 moves away from the diaphragm 8 from the position of displacement 0 mm to the position of displacement ⅙ mm. As a result of this movement, the volume of the metering chamber is increased gradually, so that liquid is sucked into the metering chamber from the suction valve chamber by way of the communication groove 282. In this way, the first transfer step is carried out.

On the other hand, the ball 79 of the third pressing rod 75 moves from 345° to 357° of the cam face 511 but the third pressing rod 75 remains at the position of displacement 0 mm without moving axially. Thus, the discharge valve chamber is held to a hermetically sealed condition and the suspension of the discharge of liquid from the discharge valve chamber to the port 22 is maintained.

Although not shown in the drawings, as the ball 79 of the first pressing rod 73 moves from 57° to 63° of the cam face 511 in response to the rotation of the cam 51, the first pressing rod 73 moves further closer to the diaphragm 8 from the position of displacement ⅓ mm to the position of displacement ⅙ mm. As a result of this movement, the volume of the suction valve chamber is further decreased, so that the transfer of liquid from the suction valve chamber to the metering chamber (first transfer step) continues.

At this time, the ball 79 of the second pressing rod 74 moves from 27° to 33° of the cam face 511 and the second pressing rod 74 moves away from the diaphragm 8 from the position of displacement ⅙ mm to the position of displacement ⅓ mm. As a result of this movement, the volume of the metering chamber is gradually increased and hence the suction of liquid from the suction valve chamber into the metering chamber (first transfer step) continues.

On the other hand, the ball 79 of the third pressing rod 75 moves from 357° to 3° of the cam face 511 but the third pressing rod 75 remains at the position of displacement 0 mm without moving axially. Thus, the discharge valve chamber is held to a hermetically sealed condition, so that the suspension of discharge of liquid from the discharge valve chamber to the port 22 is maintained.

Figure 10C:
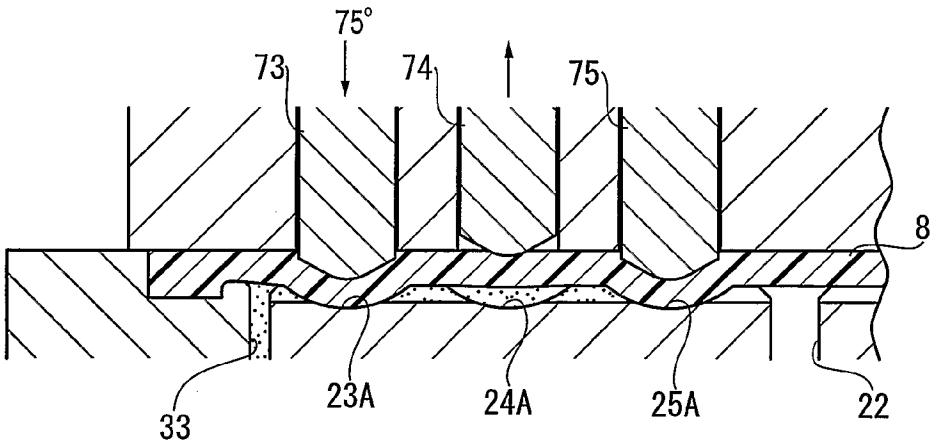
FIG. 10C is a cross section showing a state where the first pressing rod of the embodiment is at the 75° position of the cam face.
Figure 10D:
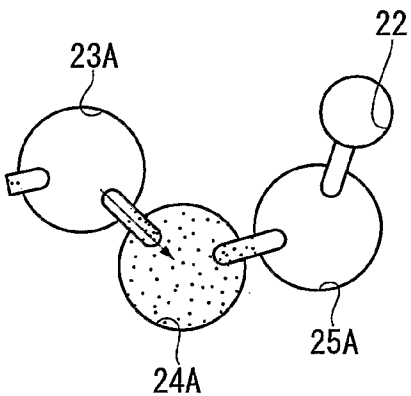
FIG. 10D is a plan view showing the state of FIG. 10C.

As the cam 51 is further rotated and the ball 79 of the first pressing rod 73 reaches 75° from 63° of the cam face 511, a state of FIGS. 10C, 10D arises.

More specifically, the first pressing rod 73 moves further closer to the diaphragm 8 from the position of displacement ⅙ mm to the position of displacement 0 mm. As a result of this movement, the volume of the suction valve chamber is decreased further, so that the transfer of liquid from the suction valve chamber to the metering chamber continues. When the first pressing rod 73 is moved to the position of displacement 0 mm, the diaphragm 8 is brought into the close contact with the first recess 23A to hermetically seal the suction valve chamber, and the transfer of liquid is stopped to complete the first transfer step.

At this time, the ball 79 of the second pressing rod 74 moves from 33° to 45° of the cam face 511 and the second pressing rod 74 moves away from the diaphragm 8 from the position of displacement ⅓ mm to the position of displacement 0.5 mm. As a result of this movement, the suction of liquid from the suction valve chamber into the metering chamber continues until the second pressing rod 74 moves to the position of displacement 0.5 mm and the first transfer step is completed when the second pressing rod 74 reaches the position of 0.5 mm.

On the other hand, the ball 79 of the third pressing rod 75 moves from 3° to 15° of the cam face 511 but the third pressing rod 75 remains at the position of displacement 0 mm without moving axially. Thus, the discharge valve chamber is held to a hermetically sealed condition so that the suspension of discharge of liquid from the discharge valve chamber to the port 22 is maintained.

In this way, the first transfer step is carried out between the state of FIG. 9C and that of FIG. 10D. When the state of FIGS. 10C, 10D arises, both the suction valve chamber and the discharge valve chamber are hermetically sealed and the liquid is held to the metering chamber and hence metered by the volume of the metering chamber so that the metering step is carried out at this time.

As the cam 51 is further rotated and the ball 79 of the first pressing rod 73 reaches 90° from 75° of the cam face 511, the state of FIGS. 8A, 8B is restored. In other words, the first pressing rod 73 remains at the position of displacement 0 mm without moving. Therefore, both the hermetically sealed condition of the suction valve chamber and the suspension of liquid transfer to the metering chamber are maintained At this time, the ball 79 of the second pressing rod 74 moves from 45° to 60° of the cam face 511 and the second pressing rod 74 moves toward the diaphragm 8 from the position of displacement 0.5 mm to the position of displacement 0.25 mm. As a result of this movement, the volume of the metering chamber is gradually decreased, so that liquid is transferred from the metering chamber to the discharge valve chamber.

On the other hand, the ball 79 of the third pressing rod 75 moves from 15° to 30° of the cam face 511 and the third pressing rod 75 moves away from the diaphragm 8 from the position of displacement 0 mm to the position of displacement 0.25 mm. As a result of this movement, the volume of the discharge valve chamber is gradually increased, so that the liquid transferred from the metering chamber is sucked into the discharge valve chamber. In this way, the second transfer step is carried out between the state of FIG. 10D and that of FIG. 8C.

The shapes of the cam face 511 from 90° to 180°, from 180° to 270° and from 270° to 360° are identical with the shape of from 0° to 90°. In other words, the state where the ball 79 of the first pressing rod 73 is at 90° of the cam face 511 is identical with the state illustrated in FIGS. 8A, 8B and hence the above-described operation is repeated from that state. Therefore, the description will be omitted.

Figure 11:
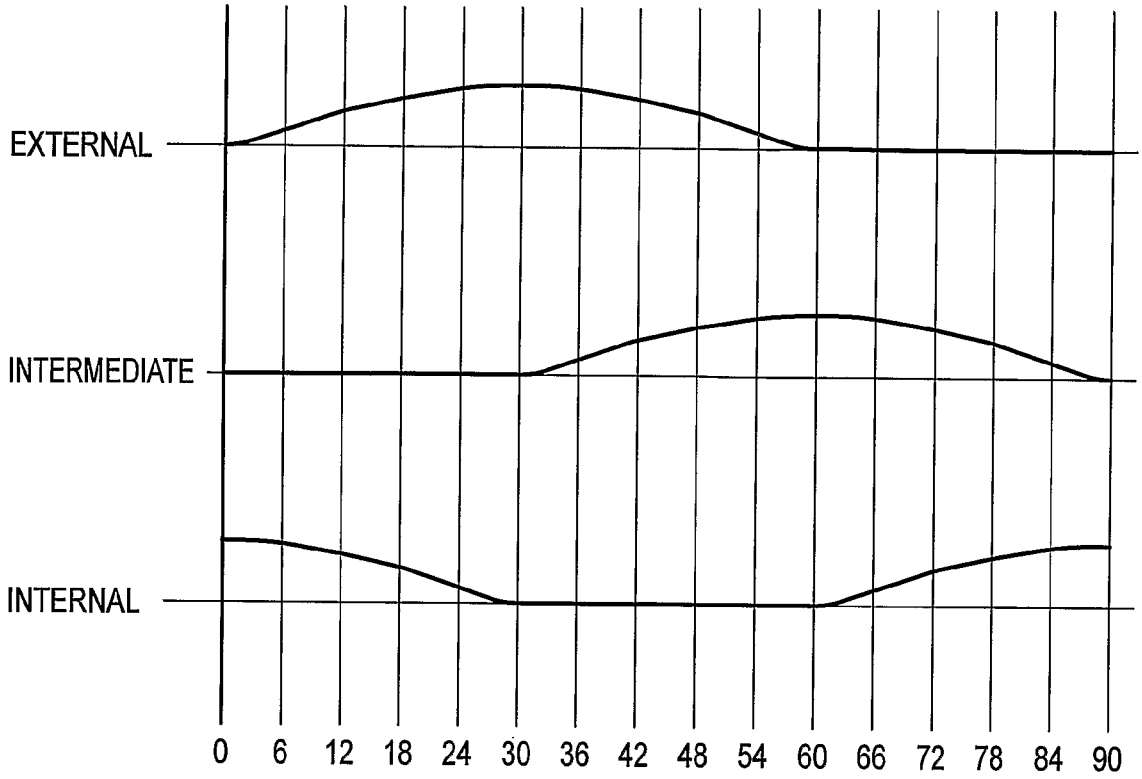
FIG. 11 is a graph showing the displacements of the first through third pressing rods relative to rotation angle of the cam of the embodiment.

FIG. 11 is a graph illustrating the change of displacement relative to the rotation angle of each of the pressing rods 73 through 75.

Note that in FIG. 11, the above-described range of 90° from 15° to 105° is shown as a range of 90° from 0° to 90° for convenience of description. Additionally, in FIG. 11, the first pressing rod 73 disposed on the outer circumferential side of the recess forming surface 21 is referred to as "EXTERNAL", the third pressing rod 75 disposed on the inner circumferential side is referred to as "INTERNAL" and the second pressing rod 74 disposed between the pressing rods 74, 75 is referred to as "INTERMEDIATE".

As shown in FIG. 11, the first pressing rod 73 moves away from the diaphragm 8 between 0° and 12° (between 15° and 27° in the above description) at a constant acceleration. The change per unit angle (e.g., 1°) of displacement during this period is so defined as to gradually increase.

Subsequently, the first pressing rod 73 moves away from the diaphragm 8 between 12° and 18° (between 27° and 33° in the above description) at a constant speed. The change per unit angle of displacement during this period is so defined as to be constant.

Then, the first pressing rod 73 moves away from the diaphragm 8 between 18° and 30° (between 33° and 45° in the above description) at a constant acceleration. The change per unit angle of displacement during this period is so defined as gradually decrease.

Then, the first pressing rod 73 moves toward the diaphragm 8 between 30° and 42° (between 45° and 57° in the above description) at a constant acceleration. The change per unit angle of displacement during this period is so defined as to gradually increase.

Then, the first pressing rod 73 moves toward the diaphragm 8 between 42° and 48° (between 57° and 63° in the above description) at a constant speed. The change per unit angle of displacement during this period is so defined as to be constant.

Then, the first pressing rod 73 moves toward the diaphragm 8 between 48° and 60° (between 63° and 75° in the above description) at a constant acceleration. The change per unit angle of displacement during this period is so defined as to gradually decrease.

Then, the first pressing rod 73 is at halt with displacement 0 between 60° and 90° (between 75° and 105° in the above description).

On the other hand, the second pressing rod 74 moves in the same manner with a delay of 30° relative to the first pressing rod 73. In other words, the second pressing rod 74 is at halt between 0° and 30° but moves between 30° and 90° just like the first pressing rod 73 between 0° and 60°.

Similarly, the third pressing rod 75 moves in the same manner with a delay of 30° relative to the second pressing rod 74 (and with a delay of 60° relative to the first pressing rod 73). In other words, the third pressing rod 75 is at halt between 30° and 60° but moves between 60° and 30° just like the first pressing rod 73 between 0° and 60°.

While the pressing rods operate in the above-described manner, liquid is discharged into the port 22 during the period where the third pressing rod 75 moves from the position of displacement 0.5 mm to the position of displacement 0 mm (between 0° and 30° in FIG. 11).

Figure 12:
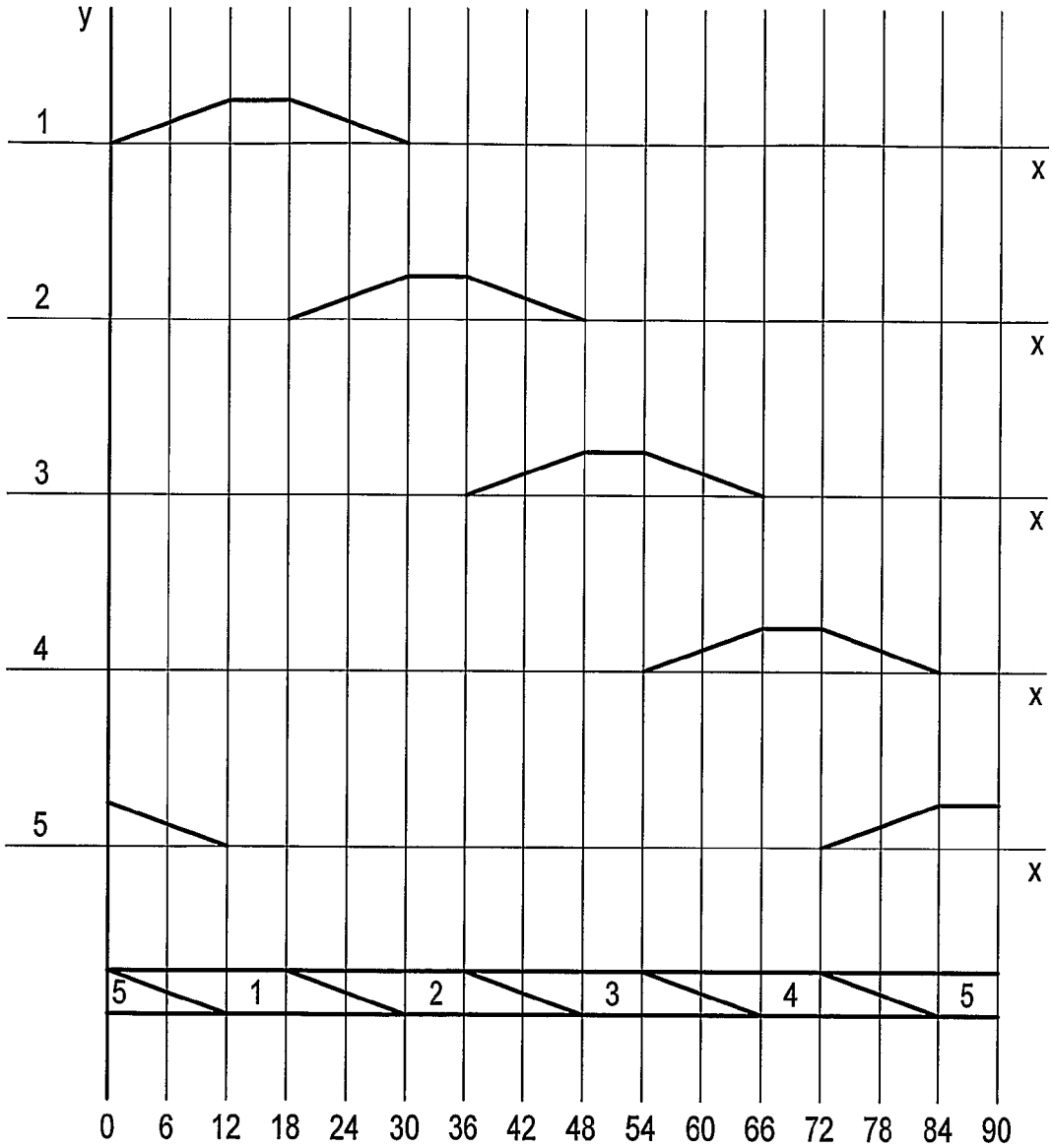
FIG. 12 is a graph showing changes in liquid transfer rate of the embodiment.

FIG. 12 is a graph illustrating the change in the liquid discharge rate from each of the discharge valve chambers (third recesses 25A through 25E) during the period where the cam 51 is rotated by 90°. In FIG. 12, the liquid discharge rates from the discharge valve chambers (third recesses 25A through 25E) are denoted respectively by numbers 1 through 5.

Between 0° and 12°, the third pressing rod 75 that corresponds to the third recess 25A moves at a constant acceleration so as to gradually increase the displacement amount per unit angle. Therefore, the liquid discharge rate also gradually increases as shown in FIG. 12. Thus, a discharge rate increasing step is carried out.

Between 12° and 18°, since the third pressing rod 75 moves while maintaining the displacement amount per unit angle at a constant value, discharge rate of the liquid is also constant. Thus, a constant discharge rate step is carried out.

Between 18° and 30°, the third pressing rod 75 moves at a constant acceleration so as to gradually decrease the displace amount per unit angle. Therefore, the liquid discharge rate also gradually decreases. Thus, a discharge rate decreasing step is carried out.

On the other hand, as shown in FIG. 12, liquid is discharged from the discharge valve chamber (third recess 25B) between 18° and 48° as in the case of the third recess 25A because the third pressing rods 75 are angularly displaced from each other by 72° and the cam face 511 of the cam 51 cyclically changes at every 90°. The cam face 511 are defined in such a way that, while the liquid discharge rate of the third recess 25A gradually decreases (discharge rate decreasing step), the liquid discharge rate of the third recess 25B gradually increases (discharge rate increasing step) so that the sum of the discharge rates is kept at a constant level. The sum of the discharge rate is so selected as to be equal to the discharge rate that is observed when the third pressing rod 75 is moving at a constant speed (for example, the discharge rate of the third recess 25A between 12° and 18°).

Since the other discharge valve chambers (the third recesses 25C through 25E) operate to discharge liquid with the same mutual phase difference of 18°, the liquid is discharged from the diaphragm pump 1 at a constant rate.

Since the diaphragm pump 1 has five liquid flow paths 280 that operate as pumps and the cam face 511 is adapted to make a single cycle of reciprocation during the time it rotates by 90°, which is equal to that a total of 20 pumps operates when the cam 51 makes a full turn. During this time period, a predetermined volume of liquid is continuously discharged and sucked. In other words, the liquid is sucked and discharged continuously without pulsation.

Since a constant volume is always discharged for a full turn of the cam 51, the volume of the liquid to be discharged per unit time can be controlled by adjusting the rotation speed of the cam 51.

The above-described embodiment provides the following advantages.

(1) The plurality of recesses 23A through 23E, 24A through 24E, 25A through 25E are formed on the recess forming surface 21 and the diaphragm 8 is arranged to cover the recesses 23A through 23E, 24A through 24E, 25A through 25E, while the plurality of pressing rods 73, 74, 75 are arranged to correspond to the respective recesses 23A through 23E, 24A through 24E, 25A through 25E so as to produce five pumps, and the operations of the pressing rods 73 through 75 are defined by way of a cam 51. Thus, liquid can be sucked and discharged, or transferred, at a constant rate in response to the rotation of the cam 51, so that the liquid can be transferred continuously without pulsation by rotating of the drive unit 6 at a constant speed.

Particularly, since a metering step where the suction valve chamber and the discharge valve chambers are hermetically sealed and the liquid is dividedly isolated in the metering chamber, it is possible to accurately transfer even a very small amount of liquid.

Additionally, since the rate at which the liquid is transferred per unit time by the diaphragm pump 1 can be adjusted only by adjusting the rotation speed of the drive unit 6, the operation of the diaphragm pump can be controlled very easily.

(2) Since a pulsation-free continuous pump can be formed by using a diaphragm 8, the limitation to the types of liquid that can be discharged from the pump is minimized and hence the diaphragm pump can be widely used in various applications. In other words, since only the base block 2, the holder ring block 3 and the diaphragm 8 contact liquid, liquid of various different types can be transferred when appropriate materials are selected for those components. Additionally, since the diaphragm 8 is made of an elastically deformable material such as rubber, liquid such as silver paste or solder paste can be discharged without crushing particles contained therein so that liquid can be transferred without being damaged.

As in the case with a plunger pump or the like, when a seal member is applied to the plunger to prevent leakage of liquid, the plunger is forced to slide on the seal member so that friction occurs between liquid and the plunger and the seal member. Then, if a liquid that can be easily polymerized as a result of friction with the seal member such as an ultraviolet curing adhesive or an aerophobic adhesive is transferred, the liquid can often be damaged as it is partly polymerized and set. To the contrary, the present embodiment employs a diaphragm 8 and hence eliminates the use of a seal member, which eliminates portions of liquid subjected to friction. Therefore, liquid such as the ultraviolet curing adhesive or the aerophobic adhesive can be transferred without any damage.

Therefore, the diaphragm pump 1 can transfer liquid of various different types, which can be used in various industrial fields including the chemical industry, the semiconductor industry and the printing industry.

(3) Since at least one of the respective suction valve chambers and the metering chamber of the respective liquid flow paths 280 is hermetically sealed as the diaphragm 8 closely contacts to the recesses 23 through 25, the liquid is prevented from flowing back even without a check valve. Therefore, the liquid can be transferred from the port 22 to the space 33 at the outer circumferential side of the recess forming surface 21 by rotating the cam 51 in the opposite direction. In short, according to the present invention, the diaphragm pump 1 that allows liquid to flow back can be formed without difficulty.

Additionally, if a check valve is provided, the liquid can leak out from the check valve when the liquid supply side and the liquid discharge side of the check valve have a pressure difference so that it is not possible to apply pressure to the liquid supply side in order to pressure-feed the liquid. To the contrary, with the present embodiment, since the recesses 23 through 25 are hermetically sealed without necessity of the use of a check value the embodiment operates properly even in a condition having pressure difference, where the pressure is applied to the liquid supply side and/or the liquid discharge side is under negative pressure. In other words, the liquid can be supplied by applying pressure thereto and transferred while filing up the liquid flow paths 280 with the liquid without any space, so that the accuracy of the liquid discharge rate can be improved. Additionally, highly viscous liquid can also be transferred, further increasing types of liquid that can be transferred. In other words, the present embodiment can be used as a dispenser for a variety of liquids.

(4) The drive side including the pressing rods 73 through 75, the cam 51 and the like and the pump side for transferring the liquid are separated by the diaphragm 8 so that it is not necessary to additionally provide a seal member that prevents liquid from leaking to the drive side. Additionally, the pressing rods 73 through 75 are only required to simply reciprocate with a stroke of 0.5 mm so that the overall arrangement of the embodiment can be simplified and downsized. Therefore, it is possible to provide a small diaphragm pump 1 that can discharge a very small quantity of liquid. Then, it can be attached to a robot arm on a semiconductor manufacture line.

(5) The recesses 23A through 23E, 24A through 24E, 25A through 25E and the pressing rods 73 through 75 are arranged to extend spirally from the port 22, so that the area of the recess forming surface 21 can be made compact. Then, the diaphragm pump 1 can be downsized.

(6) The first pressing rods 73, the second pressing rods 74 and the third pressing rods 75 needs to be operated with phase differences. Such phase differences can be realized by shifting the areas that correspond to the respective pressing rods 73 through 75 on the cam face 511. However, such an arrangement makes the cam manufacturing process a cumbersome one. To the contrary, with the present embodiment, the first recesses 23A through 23E, the second recesses 24A through 24E and the third recesses 25A through 25E are shifted from each other by 30° around the port 22 in the rotation direction. With this arrangement, it is not necessary to shift the areas that correspond to the respective pressing rods 73 through 75 on the cam face 511 of the cam 51 and the cam face 511 can be formed linearly, which facilitates manufacturing of the cam 51.

(7) A single diaphragm 8 that covers the recess forming surface 21 is required, so that the diaphragm 8 can manufactured easily at low cast In conventional diaphragm pumps, the entire diaphragm 8 is reciprocated in order to discharge liquid, so that discharge errors may occur because the diaphragm 8 is deformed. Then, it is difficult to accurately transfer a very small quantity of liquid.

To the contrary, in the present embodiment, not the entire diaphragm 8 is reciprocated but only the portions of the diaphragm 8 that correspond respectively to the first recesses 23A through 23E, the second recesses 24A through 24E and the third recesses 25A through 25E (recess-corresponding portions) are reciprocated so that the diaphragm 8 can be moved with high accuracy by following the respective motions of the pressing rods 73 through 75. Additionally, since the liquid is transferred by moving small portions of the diaphragm 8 that correspond to the respective recesses 23 through 25, transfer rate can also be small. In other words, it is possible to realize a pump that can transfer a very small amount of liquid, which can be utilized as a device for discharging a very small amount of liquid (dispensers).

Additionally, the diaphragm 8 can be manufactured at low cost because both the flow-path-block contacting surface and the pressing-rod-abutting surface have a simple planar profile. In other words, when the diaphragm 8 is worn, it can be replaced at low cost.

(8) Since the cam followers that abut the cam face 511 include the pressing rods 73 through 75 and the balls 79 held respectively by the pressing rods 73 through 75 in the present embodiment, it is possible to downsize the drive section of the embodiment that is formed by the cam face 511 and the cam followers. If rollers are used instead of the balls 79, rotary shafts need to be provided so as to project in a radial direction in order to rotatably support the rollers. Then, the diameters of tracks of the rollers moving (rotating) along the cam become large. To the contrary, since the balls 79 are used in the present embodiment, no roller shafts are needed and hence the diameters of the tracks of the rollers can be small accordingly. Thus, the diaphragm pump 1 can be downsized.

(9) When the rollers are used, the planar cam has to be made of oil-impregnated resin in order to reduce worn because side slips may occur between the planar cam and the rollers. Then, the oil-impregnated resin of the planar cam is deformed when it is pressed against the rollers, which generates an error in the stroke of the plunger and consequently reduces the discharge accuracy of the liquid.

To the contrary, in the present embodiment, the balls 79 are abuts on the cam faces 511 and the coefficient of friction between the pressing rods 73 through 75 and the balls 79 is set to lower than the coefficient of friction between the cam faces 511 and the balls 79. Therefore, if radial force is applied to the rotating balls 79, the force is absorbed as the balls 79 slide on the respective pressing rods 73 through 75. Thus, no side slip occurs between the cam faces 511 and the balls 79, and the balls 79 can rotate and move without slipping on the cam faces 511. Therefore, it is no longer necessary to consider friction and use oil-impregnated resin for the cam faces 511, and the cam 51 can be made of a hard material such as metal and the balls 79 can also be made of a hard material, which can reduce the error in the stroke of the pressing rods 73 through 75 and improve the accuracy of liquid discharge.

Additionally, since the reciprocating motions of the pressing rods 73 through 75 are unequivocally defined by the profile of the cam faces 511, it is possible to accurately control the motions of the pressing rods 73 through 75 by appropriately setting the profile of the cam faces 511. Thus, accurate discharge liquid can be realized without pulsation.

(10) Still additionally, while the pressing rods 73 through 75 are made of a resin material that is softer than the material of the balls 79, each of the balls 79 is held in the semispherical recess that is adapted to house about a half of the ball 79. Therefore, if the ball 79 slides in the recess, the force generated by the slide can be absorbed by the large area of the recess. Thus, the pressing rods 73 through 75 are prevented from being deformed.

As a result, no error occurs in the movements of the pressing rods 73 through 75 so that the pressing rods 73 through 75 can be accurately controlled for their movements and hence it is possible for the embodiment to accurately transfer a very small amount of liquid.

(11) The coil springs 78 are provided to bias the respective pressing rods 73 through 75 toward the cam faces 511 so that the pressing rods 73 through 75 reliably follow the cam faces 511. Additionally, since the entire cam 51 is biased toward the diaphragm 8 by the coned disk spring 57, the positions of displacement 0 of the pressing rods 73 through 75, where they press the diaphragm 8 against the respective recesses 23 through 25, can be automatically aligned to a certain extent. In other words, as the pressing rods 73 through 75 are pressed against the diaphragm 8 by a certain force, the diaphragm 8 closely contacts to the recesses 23 through 25 and the positions of the pressing rods 73 through 75 are determined when the diaphragm 8 is compressed to a certain extent and the repulsive force of the diaphragm 8 is balanced with the force being applied to the pressing rods 73 through 75. Therefore, when the cam 51 is placed approximately at the designed position by referring to the height or the like of the spacer ring 56, the positions of the pressing rods 73 through 75 and hence the position of the cam 51 are automatically adjusted as the cam 51 is pressed against the diaphragm 8 by the coned disk spring 57. Thus, the cam 51 is accurately placed in a position when the diaphragm pump 1 is assembled without requiring accurate machining for the related components. In other words, the efficiency of machining the components can be improved to relatively reduce the manufacturing cost of the diaphragm pump.

(12) Only by rotating the cam 51 with the drive unit 6 as a rotary drive source, each of the pressing rods 73 through 75 can reciprocate by following the cam face. The pressing member drive controller can be formed in compact size, realizing the diaphragm pump 1 with reduced size and weight. Thus, when used in dispensing adhesives, various pastes and the like in production lines of various products, the diaphragm pump 1 can be attached to robot arms and moved by high speed and high acceleration, so that the takt time of the production lines can be shortened, which enhances productivity.

(13) In the present invention, only by rotating the cam 51 by the drive unit 6 including a motor and the like, each of the pressing rods 73 through 75 can be repeatedly operated with a predetermined timing. Since the liquid transfer rate can be set to constant for each one cycle of operation for each of the pressing rods 73 through 75, the liquid transfer rate per unit of time can be adjusted only by adjusting rotation speed of the cam 51.

Thus, the liquid transfer rate of the diaphragm pump 1 can be controlled easily, so that the diaphragm pump 1 (dispenser) with high convenience can be realized.

Second Embodiment

Next, the second embodiment of the present invention will be described by referring to FIGS. 13 and 14A through 14C.

A diaphragm pump 1A of the second embodiment differs from the diaphragm pump 1 of the first embodiment in arrangements of a base block 2A and a diaphragm 8A. More specifically, of the base block 2A of the second embodiment, a diaphragm-contacting surface 21A that closely contacts to the diaphragm 8A is planar without grooves and recesses formed thereon, which is different from the recess forming surface 21 of the first embodiment where the recesses 23 through 25 and the communication grooves 281 through 284 are formed.

The diaphragm 8A shows a substantially disk-like profile, which include a flow-path-block-contacting surface 81 that faces the base block 2A and a pressing-rod-abutting surface 82 that faces the pressing rods 73 through 75.

Figure 14A:
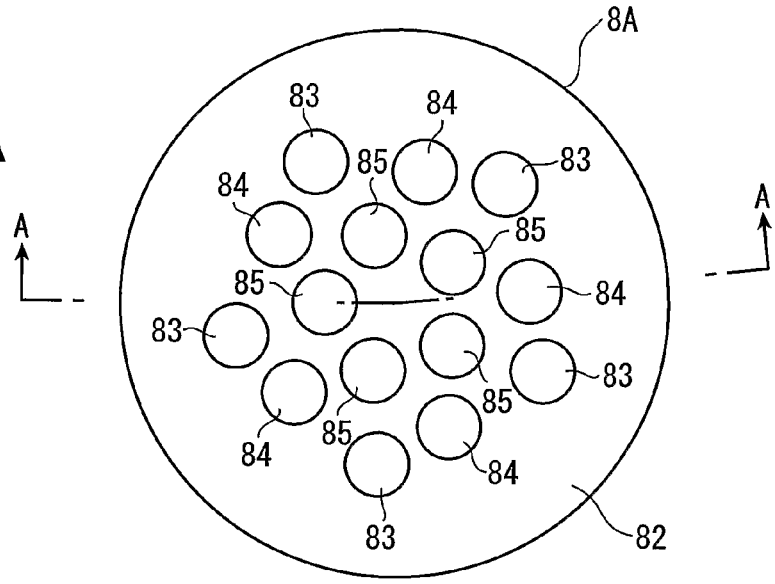
FIG. 14A is a plan view of a pressing-rod-abutting surface of the diaphragm of the second embodiment.
Figure 14B:
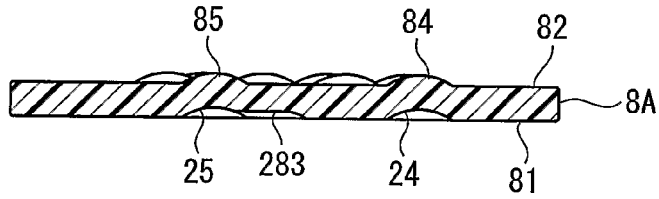
FIG. 14B is a cross section taken along line A-A in FIG. 14A.
Figure 14C:
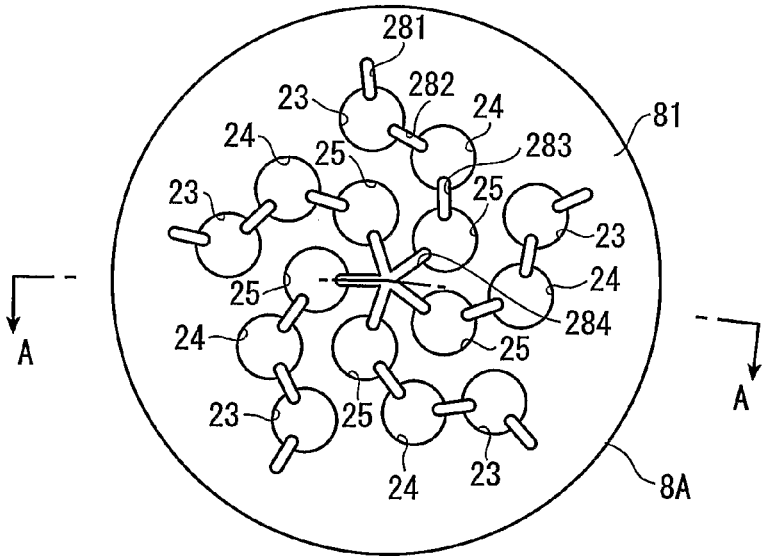
FIG. 14C is a plan view of a flow-path-block-contacting surface of the diaphragm of the second embodiment.

The flow-path-block-contacting surface 81 is not planar unlike the diaphragm 8 of the first embodiment, and the recesses 23 through 25 and the communication grooves 281 through 284 are formed thereon, as shown in FIGS. 14B and 14C. In other words, like the recess forming surface 21 of the first embodiment, the recesses 23 through 25 and the communication grooves 281 through 284 are formed on the flow-path-block-contacting surface 81.

On the other hand, as shown in FIG. 14A, spherical projections 83 through 85 are formed on the pressing-rod-abutting surface 82 at positions corresponding to the respective recesses 23 through 25. With this arrangement, the portions where the recesses 23 through 25 are formed have substantially the same thickness as the thickness of the remaining portions as shown in FIG. 14B. The diaphragm 8A is made of rubber and can be molded by means of a rubber die (rubber molding metal mold).

Figure 13:
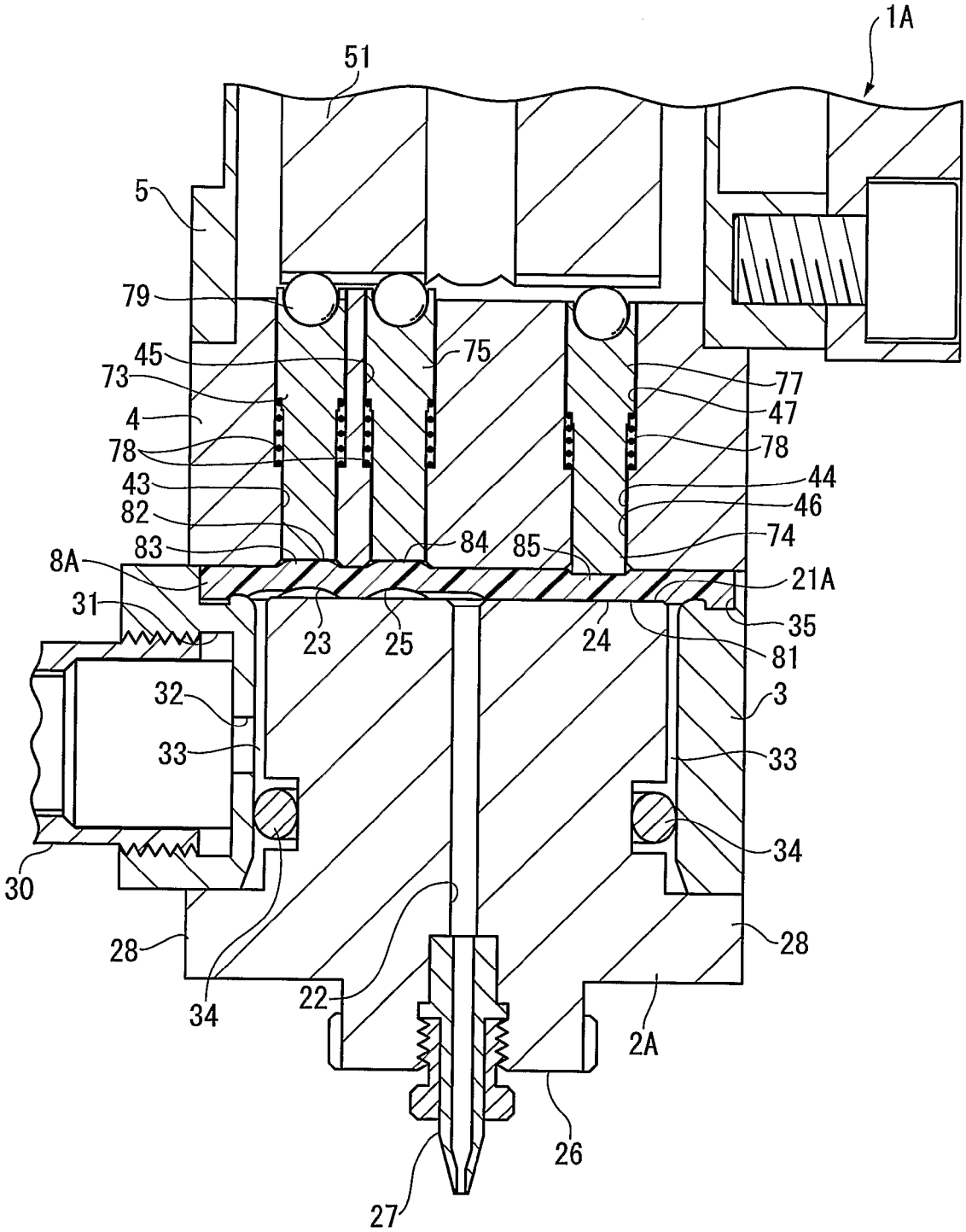
FIG. 13 is a cross section of a principal part of a second embodiment of the present invention.

As shown in FIG. 13, the diaphragm 8A is pinched between a flow path block that is formed by the base block 2A and a holder ring block 3 and a guide block 4. The projections 83 through 85 are arranged at the positions corresponding to respective guide holes 43 through 45 of the guide block 4 and adapted to abut respective pressing rods 73 through 75.

Thus, the suction valve chamber, the metering chamber and the discharge valve chamber are formed by the spaces defined respectively by the recesses 23 through 25 of the diaphragm 8A and the diaphragm-contacting surface 21A of the base block 2A. Additionally, communication paths are formed by the spaces defined respectively by the communication grooves 281 through 284 and the diaphragm-contacting surface 21A.

The end surface of each of the pressing rods 73 through 75 on a side of the diaphragm 8A is formed in a planar profile, into which each of the projections 83 through 85 can be pressed efficiently, although pressing rods 73 through 75 having a semispherical profile like those of the first embodiment may alternatively be used.

Thus, the present embodiment is identical with the first embodiment in terms of that it is provided with the respective valve chambers, the metering chamber and the communication paths between the diaphragm 8A and the base block 2A and the volume of each of the valve chambers and the metering chamber changes in accordance with reciprocation of the pressing rods 73 through 75. Therefore, the liquid is transferred by the present embodiment just like the first embodiment.

The present embodiment provides the following advantages in addition to the advantages of the first embodiment.

Since the recesses 23 through 25 and the communication grooves 281 through 284 are not formed in the base block 2A but in the diaphragm 8A, the cost of initial investment can be reduced further, so that the manufacturing cost can be lowered when the manufacturing number of the diaphragm pumps 1A is relatively small and a very small volume of liquid can be transferred with ease. More specifically, the metal base block 2 having recesses 23 through 25 of the first embodiment is formed by using a metal mold or by using machine tools. If a metal mold is used, the manufacturing cost of the base block 2 is reduced but the cost of preparing the metal mold is high, and thus the cost of initial investment is raised. If, on the other hand, machine tools are used, the machining cost is high and it is difficult to reduce the volumes of the recesses 23 through 25 for machining reasons.

To the contrary, when the recesses 23 through 25 and the communication grooves 281 through 284 are formed in the diaphragm 8A, the rubber diaphragm 8A is molded by using a rubber die. Such a rubber die is less expensive if compared with a metal mold for forming metal products so that by turn the cost of initial investment is reduced. Additionally, the metering chambers and the flow paths can be dimensionally reduced when a rubber die is used. Then, the manufactured diaphragm pump is adapted to transfer a very small amount of liquid without difficulty.

Third Embodiment

Next, a third embodiment of the present invention will be described with reference to FIGS. 15 through 24.

A diaphragm pump 1B of the third embodiment differs from the diaphragm pump 1 of the first embodiment in arrangements of a flow path block 130 and a cam 150. The flow path block 130 includes a metal base 131 and an abutment 132 made of synthetic resin such as polypropylene.

The abutment 132 includes a recess forming surface 132A as a diaphragm-contacting surface for the diaphragm 8 to be closely attached thereto. Formed on the recess forming surface 132A are the recesses 23 through 25 and communication grooves 281 through 284, as with the recess forming surface 21 of the first embodiment shown in FIG. 2.

A plurality of protrusions 132B are formed on the abutment 132, the protrusions 132B inserted into a fitting hole 131A of the base 131 for positioning.

A through hole being the port 22 is formed at a central axis portion of the abutment 132. A nozzle connector 133 is pressed into the port 22 made of stainless steel or the like.

The nozzle connector 133 is fixed to the flow path block 130 by the nozzle member 27 that is screwed on the flow path block 130. Since the nozzle connector 133 is pressed into the port 22 of the abutment 132 the abutment 132 is fixed to the base 131 in a closely contacted manner.

An O-ring for preventing leakage is provided between the nozzle connector 133 and the abutment 132.

The liquid discharged from the port 22 of the abutment 132 as a discharge flow path is then discharged to the outside of the pump via the nozzle connector 133 and the nozzle member 27.

A connector 160 is fixed to the flow path block 130 with a cap nut, to which a tube for supplying the liquid and a container is attached. The flow path block 130 is provided with the through hole 32 intercommunicating with a liquid supply path 161 of the connector 160 and the ring-shaped space 33 intercommunicating with the through hole 32 and formed along the outer periphery of the diaphragm 8.

A communication groove 281 formed by a notched groove for intercommunicating the space 33 and the recess 23 is formed on the outer periphery side of the abutment 132, and the suction flow path is formed by the space 33 in the present embodiment.

The diaphragm 8 is held between the base 131 and a case block 10. A through hole is formed at a central axis portion of the case block 10, and the guide block 4 is held in the through hole. Since the arrangement of the guide block 4 is the same as the one in the first embodiment, description thereof will be omitted.

Incidentally, the guide block 4 is biased by a coned disk spring 11 toward the flow path block 130 via a cylindrical pressing member 12 located in the inner through hole of the fitting block 5, so that the guide block 4 abuts on the diaphragm 8 with a predetermined pressure.

The spline shaft 53 is fixed to the output shaft 61 of the drive unit 6, and the spline boss 52 is engaged with the spline shaft 53. The spline boss 52 is rotatably supported relative to the pressing member 12 via the boll bearing 55. The spline boss 52 is pressed into the cam 150 so as to rotate in conjunction with the cam 150.

The cam 150 is biased by the coned disk spring 57 toward the guide block 4 via the spline boss 52 and the ball bearing 55.

On the other hand, the pressing rods 73 through 75 guided by the guide block 4 are biased toward the cam 150 by the coil spring 78. Thus, the ball 79 functioning as the cam follower disposed on the pressing rods 73 through 75 constantly abuts on the cam face of the cam 150 with a predetermined pressure.

Figure 16A:
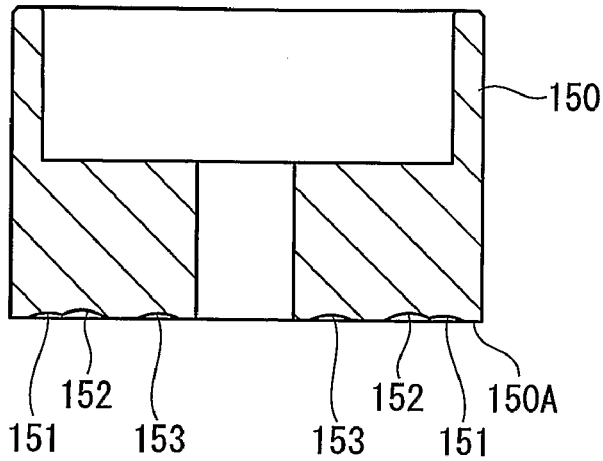
FIG. 16A is a cross section of a cam of the third embodiment.
Figure 16B:
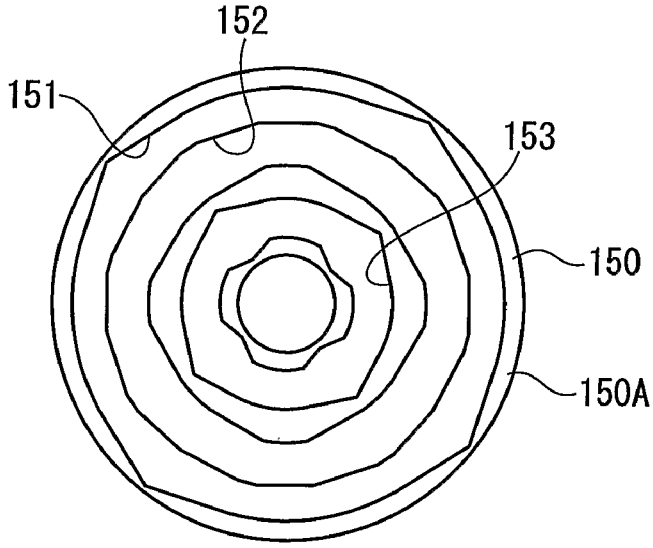
FIG. 16B is a plan view of a cam face of the third embodiment.

As shown in FIGS. 16A and 16B, three cam grooves 151 through 153 are substantially concentrically formed around the central axis on the end surface 150A orthogonal to the rotary shaft of the cam 150

Figure 17A:
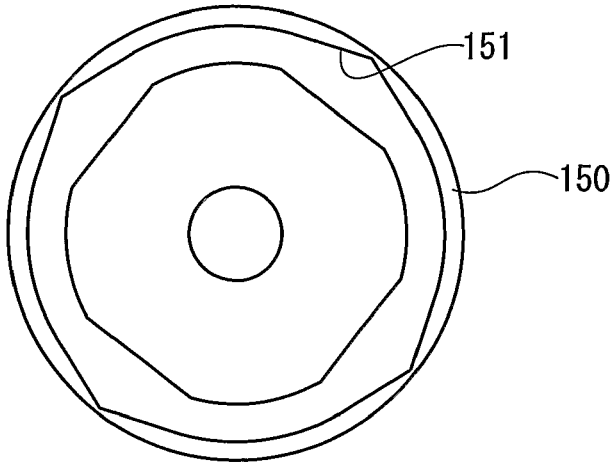
FIG. 17A is an illustration showing a first cam groove of the third embodiment.

The first cam groove 151 is a cam groove for guiding the ball 79 of the first pressing rod 73, which is formed on an outermost circumferential side of the cam 150 as shown in FIG. 17A.

Figure 17B:
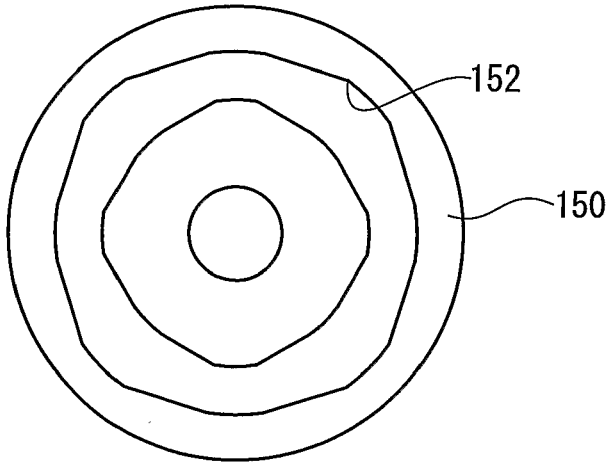
FIG. 17B is an illustration showing a second cam groove of the third embodiment.

The second cam groove 152 is a cam groove for guiding the ball 79 of the second pressing rod 74, which is formed on an inner circumferential side of the cam groove 151 as shown in FIG. 17B.

Figure 17C:
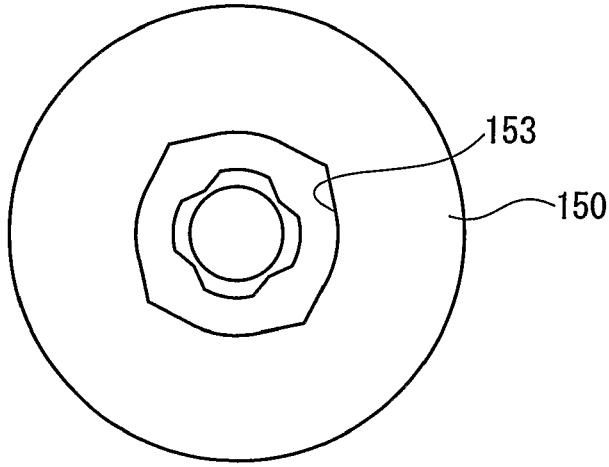
FIG. 17C is an illustration showing a third cam groove of the third embodiment.

The third cam groove 153 is a cam groove for guiding the ball 79 of the third pressing rod 75, which is formed on an inner circumferential side of the cam groove 152 (i.e. innermost circumferential side of the cam 150) as shown in FIG. 17C.

Figure 18:
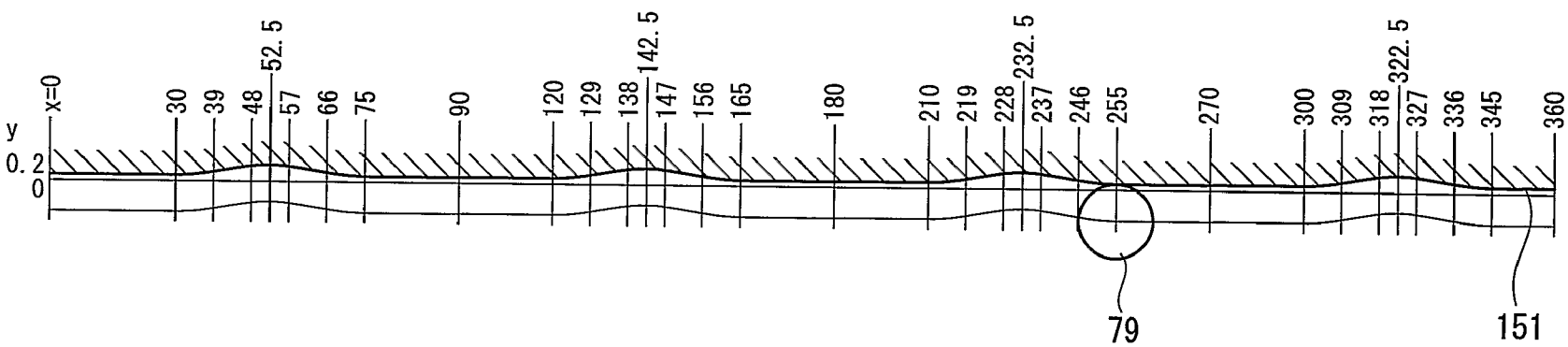
FIG. 18 is a cam diagram of the first cam groove of the cam of the third embodiment.
Figure 19:
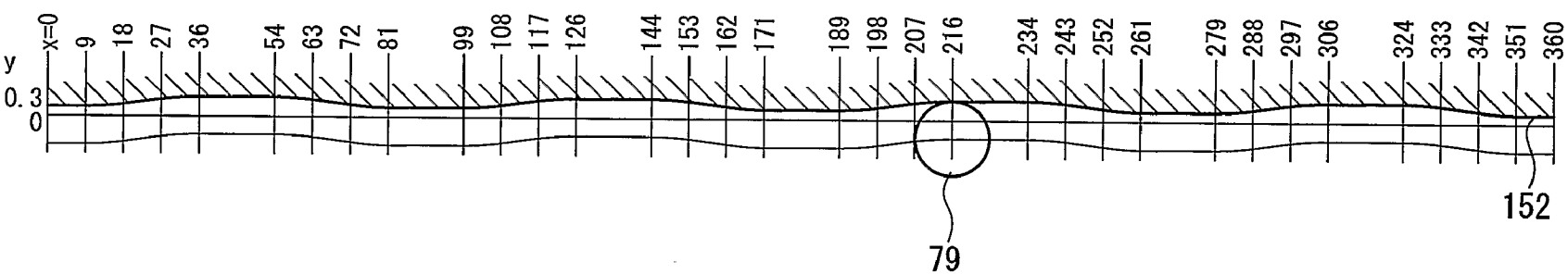
FIG. 19 is a cam diagram of the second cam groove of the cam of the third embodiment.
Figure 20:
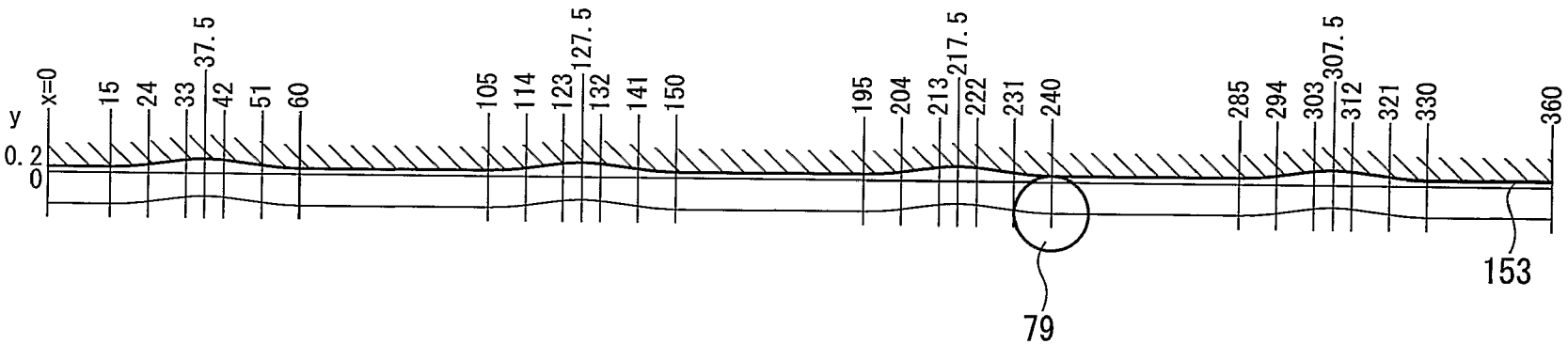
FIG. 20 is a cam diagram of the first cam groove of the cam of the third embodiment.

Cam diagrams of the respective cam grooves 151 through 153 are shown in FIGS. 18 through 20. The y-axis of the cam diagram shows bottom side portions on which the ball 79 abuts in the cam grooves 151 through 153, in other words, height position (depth) of the cam face, when the flat portion of the end surface of the cam 150 is defined as y=0, where a portion closest to the diaphragm 8 (shallowest portion in the groove) is defined as the lowest position of the cam (y=0.2) and a portion remotest to the diaphragm 8 (deepest portion in the groove) is defined as the highest positions of the cam (e.g., y=0.7 mm in the present embodiment) in the bottom sides of the cam grooves 151 through 153. On the other hand, the x-axis, defining a state where the ball 79 of the first pressing rod 73 abuts on the lowest positions of the cam (y=0.2) as 0°, shows a rotation angle of the cam 150 from the aforesaid position, i.e. a relative rotation angle of the cam face relative to the ball 79. Note that the cam diagram also illustrates loci of movements of the center positions of the balls 79.

In this embodiment, the cam faces of the respective cam grooves 151 through 153 operate with a cycle of 90° and the operation is repeated from 90° to 180°, from 180° to 270° and from 270° to 360°. Therefore, only the cycle from 0° to 90° will be described below.

As shown in FIG. 18, the cam diagram of the cam groove 151 shows that the cam face remains at the lowest position (y=0.2) when the rotation angle of the cam 150 is between 0° and 30°. In other words, the cam face is formed by a plane orthogonal to the rotary shaft of the cam 150.

When the rotation angle of the cam 150 is between 30° and 39°, the cam face is expressed, for instance, by a quadratic curve of $y=(x-30)^2/810+1/5$.

When the rotation angle of the cam 150 is between 39° and 48°, the cam face is expressed, for instance, by a straight line of $y=x/45-17/30$.

When the rotation angle of the cam 150 is between 48° and 57°, the cam face is expressed, for instance, by a quadratic curve of $y=-(x-52.5)^2/405+11/20$.

When the rotation angle of the cam 150 is between 57° and 66°, the cam face is expressed, for instance, by a straight line of $y=x/45+53/30$.

When the rotation angle of the cam 150 is between 66° and 75°, the cam face is expressed, for instance, by a quadratic curve of $y=(x-75)^2/810+1/5$.

When the rotation angle of the cam 150 is between 75° and 90°, the cam face remains at the lowest position (y=0.2).

As shown in FIG. 19, the cam diagram of the cam groove 152 shows that the cam face remains at the lowest position (y=0.3) when the rotation angle of the cam 150 is between 0° and 9°.

When the rotation angle of the cam 150 is between 9° and 18°, the cam face is expressed, for instance, by a quadratic curve of $y=(x-9)^2/810+3/10$.

When the rotation angle of the cam 150 is between 18° and 27°, the cam face is expressed, for instance, by a straight line of $y=x/45$.

When the rotation angle of the cam 150 is between 27° and 36°, the cam face is expressed, for instance, by a quadratic curve of $y=-(x-36)^2/810+7/10$.

When the rotation angle of the cam 150 is between 36° and 54°, the cam face is expressed, for instance, by a straight line of $y=0.7$.

When the rotation angle of the cam 150 is between 54° and 63°, the cam face is expressed, for instance, by a quadratic curve of $y=-(x-54)^2/810+7/10$.

When the rotation angle of the cam 150 is between 63° and 72°, the cam face is expressed, for instance, by a straight line of $y=-x/45+2$.

When the rotation angle of the cam 150 is between 72° and 81°, the cam face is expressed, for instance, by a quadratic curve of $y=(x-81)^2/810+3/10$.

When the rotation angle of the cam 150 is between 81° and 90°, the cam face remains at the lowest position (y=0.3).

As shown in FIG. 20, the cam diagram of the cam groove 153 shows that the cam face remains at the lowest position (y=0.2) when the rotation angle of the cam 150 is between 0° and 15°.

When the rotation angle of the cam 150 is between 15° and 24°, the cam face is expressed, for instance, by a quadratic curve of $y=(x-15)^2/810+1/5$.

When the rotation angle of the cam 150 is between 24° and 33°, the cam face is expressed, for instance, by a straight line of $y=x/45-7/30$.

When the rotation angle of the cam 150 is between 33° and 42°, the cam face is expressed, for instance, by a quadratic curve of $y=-(x-37.5)^2/405+11/20$.

When the rotation angle of the cam 150 is between 42° and 51°, the cam face is expressed, for instance, by a straight line of $y=-x/45+43/30$.

When the rotation angle of the cam 150 is between 51° and 60°, the cam face is expressed, for instance, by a quadratic curve of $y=(x-60)^2/810+1/5$.

When the rotation angle of the cam 150 is between 60° and 90°, the cam face is expressed, for instance, by a straight line of $y=0.2$.

Accordingly, when the spline shaft 53, the spline boss 52 and the cam 150 are rotated by the drive unit 6, the balls 79 and the pressing rods 73 through 75 advance and retract in axes direction along the shape of the cam faces of the respective cam grooves 151 through 153.

When the pressing rods 73 through 75 moves toward the side of the recesses 23 through 25, the volumes of the valve chambers and the metering chambers defined by the parts of the diaphragm 8 that correspond to the recesses 23 through 25 (parts of the diaphragm 8 corresponding to the recesses on which the pressing rods 73 through 75 abut) and by the recesses 23 through 25 decrease, volume decrease operation is performed. When the ball 79 abuts on the position of y=0.2 (reference depth), the parts corresponding to the recesses closely contact with inner surfaces of the recesses 23 through 25, and sealing operations for the respective valve chambers or the like are performed.

As the pressing rods 73 through 75 move away from the respective recesses 23 through 25, the parts of the diaphragm 8 corresponding to the recesses detach from the inner surfaces of the respective recesses 23 through 25, to which they have been closely contacted, opening operations are performed of the respective valve chambers is performed. When the pressing rods 73 through 75 move away from the recesses 23 through 25, volume increase operations are performed for the respective valve chambers and metering chambers defined between the recesses 23 through 25 and the diaphragm 8.

Next, advantages of a third embodiment of the present invention will be described with reference to FIGS. 21 through 24D.

[Operation of Pressing Rod]

Firstly, the operation of the respective pressing rods 73 through 75 will be described. The pressing rods 73 through 75 operate in correspondence with the profile of the cam respective cam grooves 151 through 153. At this time, the respective pressing rods 73 through 75 are respectively displaced by a first predefined angle (30°) as in the first embodiment. When the ball 79 of the pressing rod 73 is at 60° position in FIG. 18, the ball 79 of the pressing rod 74 is at 30° position in FIG. 19 and the ball 79 of the pressing rod 75 is at 0° position in FIG. 20.

Figure 21:
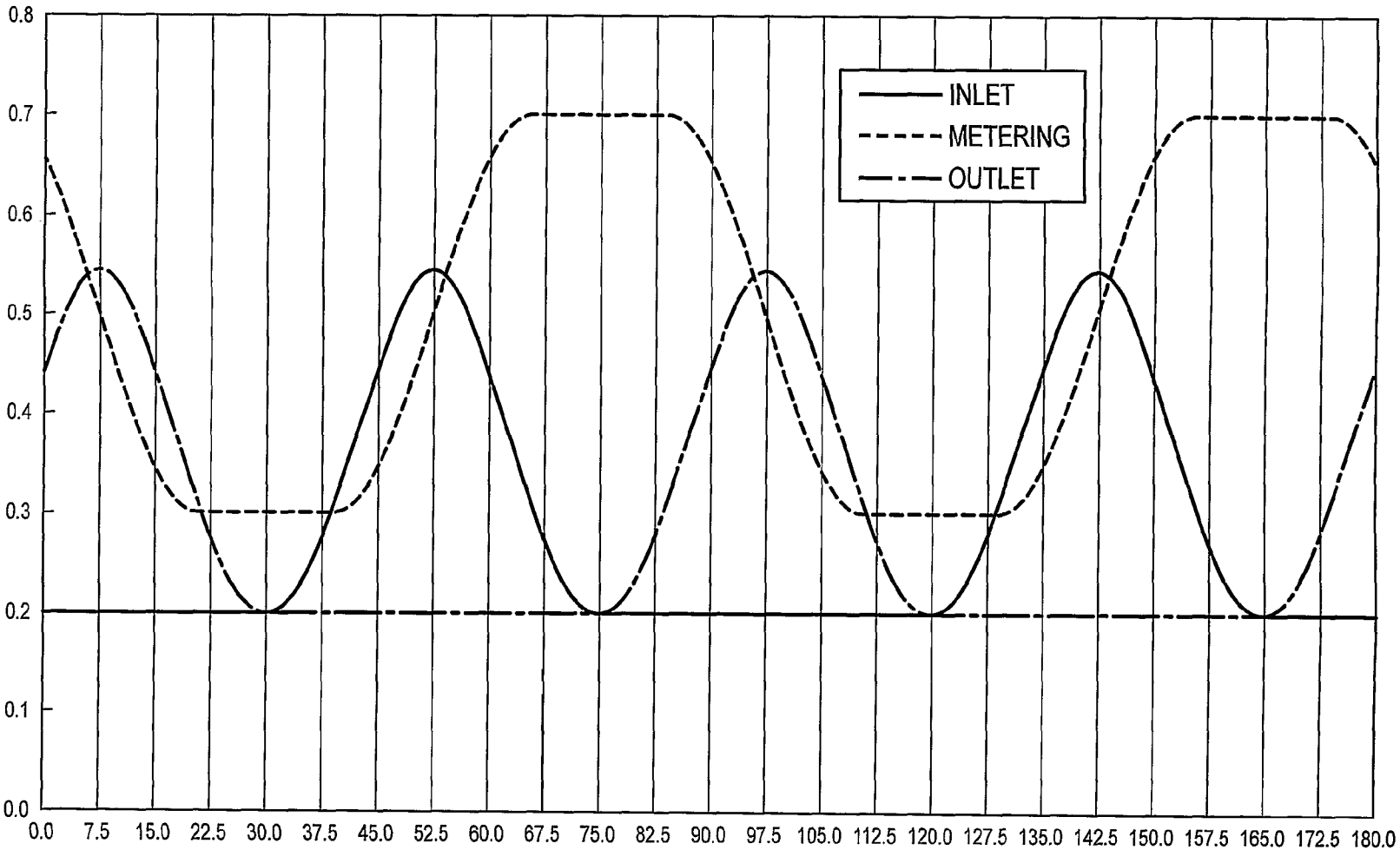
FIG. 21 is a graph showing the displacements of a first through third pressing rods relative to rotation angle of the cam of the third embodiment.

A graph of the displacements of the respective pressing rods 73 through 75 is shown in FIG. 21. In FIG. 21, the displacement of the first pressing rod 73 is indicated as "INLET", the displacement of the second pressing rod 74 as "METERING", and the displacement of the third pressing rod 75 as "OUTLET".

[Operation of Respective Pumps (Three Pressing Rods)]

Next, operations of the respective pumps included in the diaphragm pump 1 will be described by exemplifying operations of the first pressing rod 73, the second pressing rod 74 and the third pressing rod 75 inserted into the first guide hole 43A, the second guide hole 44A and the third guide hole 45A.

It is to be noted that, in the description below, the cam 150 rotates counterclockwise relative to the recess forming surface 132A (or clockwise if the cam 150 is viewed from the side of the cam face) and operates so as to suck the liquid from the space 33 at the outer circumferential side of the recess forming surface 21 and discharge the liquid from the central port 22, as with the first embodiment.

Figure 22A:
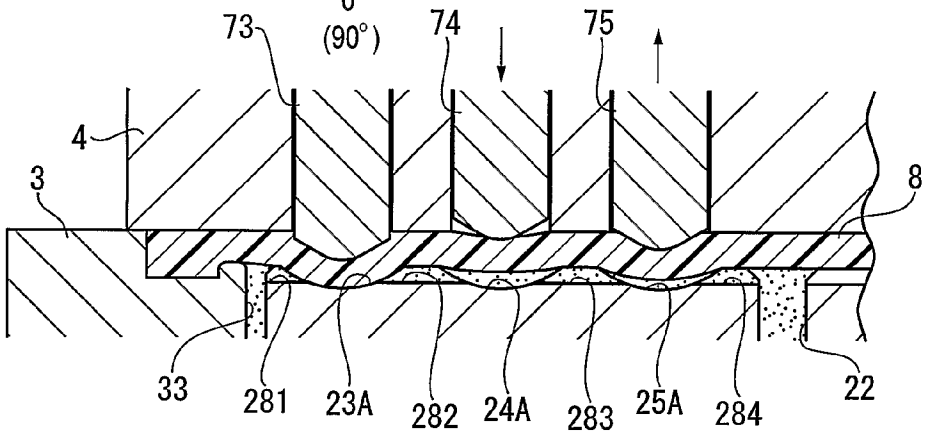
FIG. 22A is a cross section showing a state where a first pressing rod of the third embodiment is at the 0° position of the cam face.
Figure 22B:
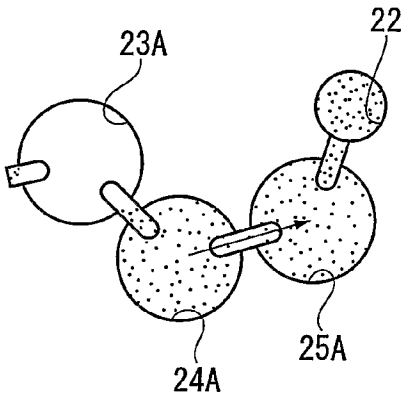
FIG. 22B is a plan view showing the state of FIG. 22A.

FIGS. 22A, 22B show a state where the ball 79 of the first pressing rod 73 is at 0° position of the cam face. At this time, since the second pressing rod 74 is located behind the first pressing rod 73 by 30°, the ball 79 is at 330° position of the cam face. Since the third pressing rod 75 is located behind the second pressing rod 74 by 30°, the ball 79 is at 300° position of the cam face.

Thus, the first pressing rod 73 is at the position of displacement y=0.2, where it presses the diaphragm 8 against the recess 23A in a closely-contacted manner, and hence the suction valve chamber defined by the first recess 23A and the part of the diaphragm 8 corresponding to the recess 23A is held to a hermetically sealed condition. The second pressing rod 74 is moved to a position of displacement 0.6556. The third pressing rod 75 is moved to a position of displacement 0.4333. Since the pressing rods 74, 75 are located respectively at the positions described above, the volume of metering chamber defined by the second recess 24A and the part of the diaphragm 8 corresponding to the recess 24A and the volume of the discharge valve chamber defined by the third recess 25A and the part of the diaphragm 8 corresponding to the recess 25A reflect the respective positions of the pressing rods 74, 75. The metering chamber and the suction valve chamber are communicated with the port 22 via the communication grooves 283 and 284.

Figure 22C:
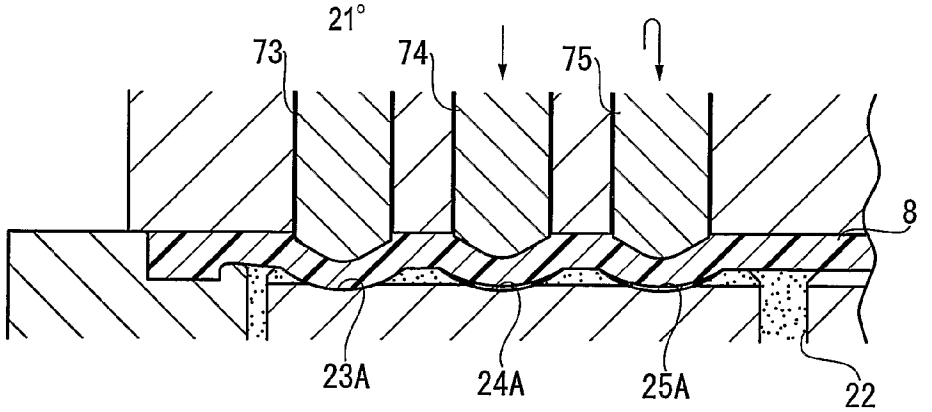
FIG. 22C is a cross section showing a state where the first pressing rod of the third embodiment is at the 21° position of the cam face.
Figure 22D:
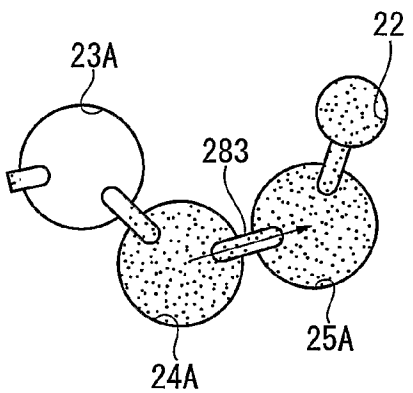
FIG. 22D is a plan view showing the state of FIG. 22C.

As the cam 150 is rotated by 21° from the state of FIGS. 22A, 22B, a state as shown in FIGS. 22C, 22D arises. More specifically, the ball 79 of the first pressing rod 73 reaches 21° position of the cam face, but since the cam face is a plane, the first pressing rod 73 is not displaced and keeps the suction valve chamber in a hermetically sealed condition.

At this time, the ball 79 of the second pressing rod 74 moves from 330° to 351° of the cam face and the second pressing rod 74 moves from the position of displacement 0.6556 mm to the position of displacement 0.3 mm to come closer to the diaphragm 8. As a result of this movement, the volume of the metering chamber is gradually decreased, so that the liquid in the metering chamber is transferred to the discharge valve chamber via the communication groove 283.

Similarly, the ball 79 of the third pressing rod 75 moves from 300° to 321° of the cam face and the third pressing rod 75 moves from the position of displacement 0.4333 mm to the position of displacement 0.55 mm to be away from the diaphragm 8 and further moves to the position of displacement 0.3 mm back to the diaphragm 8. As a result, the volume of the discharge valve chamber is once increased to suck the liquid from the metering chamber. Then, since the volume of the discharge valve chamber is gradually decreased, the liquid is discharged from the discharge valve chamber to the port 22. Incidentally, when the volume of the discharge valve chamber is decreased, the volume of the metering chamber is also gradually decreased so as to be constantly smaller than the volume of the discharge valve chamber while the suction valve chamber kept in closed condition, so that, when the volume of the discharge valve chamber is decreased, the liquid is gradually discharged to the port 22 without flowing back to the metering chamber.

Figure 23A:
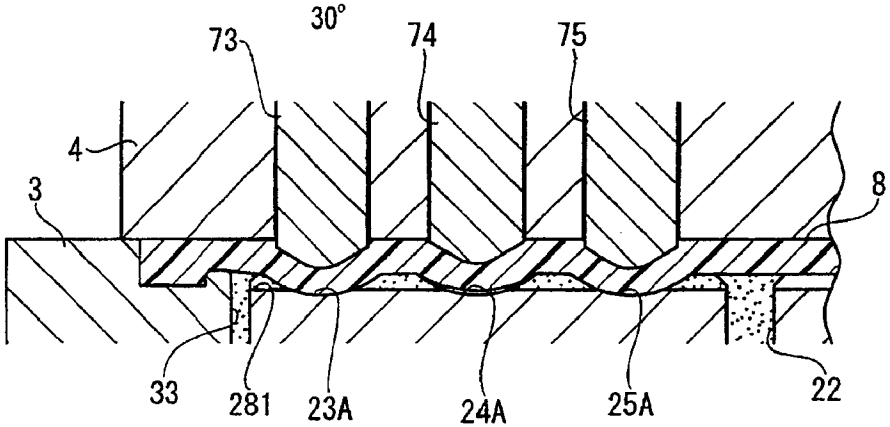
FIG. 23A is a cross section showing a state where the first pressing rod of the third embodiment is at the 30° position of the cam face.
Figure 23B:
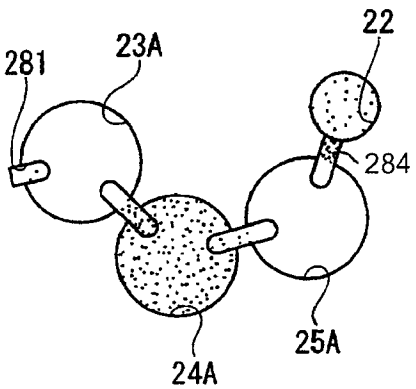
FIG. 23B is a plan view showing the state of FIG. 23A.

As the cam 150 is rotated by 9° from the state of FIGS. 22C, 22D, a state of FIGS. 23A, 23B arises. More specifically, the ball 79 of the first pressing rod 73 moves from 21° to 30° of the cam face. The first pressing rod 73 is kept at the displacement 0.2 mm until 30° while the suction valve chamber is maintained in the hermetically sealed condition.

More specifically, the ball 79 of the second pressing rod 74 moves from 351° to 360° of the cam face. At this time, the second pressing rod 74 is kept at the displacement 0.3 mm. In the displacement of 0.3 mm, the diaphragm 8 does not closely contact the second recess 24A and a gap is formed therebetween, so that the metering chamber is maintained at a predefined volume.

At this time, the ball 79 of the third pressing rod 75 moves from 321° to 330° of the cam face and the third pressing rod 75 moves from the position of displacement 0.3 mm to the position of displacement 0.2 mm to come closer to the diaphragm 8. As a result of the movement, the discharge valve chamber is hermetically sealed.

Thus, since the liquid is gradually discharged from the port 22 from a state of FIGS. 22A, 22B to a state of FIGS. 23A, 23B, the discharge step is performed. In the state of FIG. 23, since the discharge valve chamber is sealed, the discharge step ends.

Figure 23C:
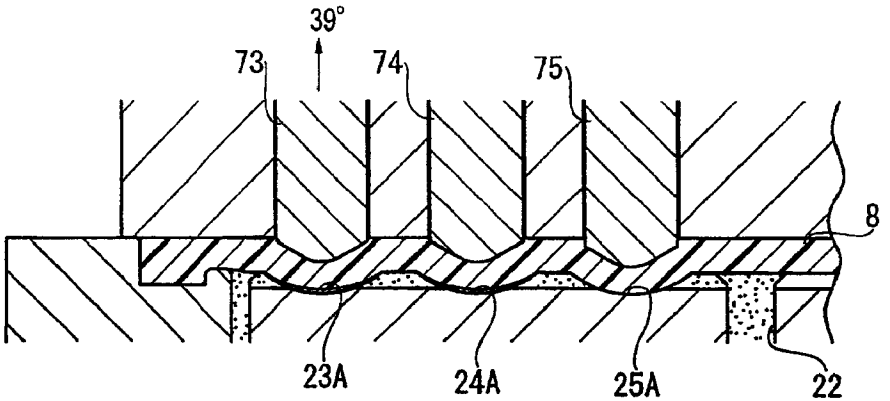
FIG. 23C is a cross section showing a state where the first pressing rod of the third embodiment is at the 39° position of the cam face.
Figure 23D:
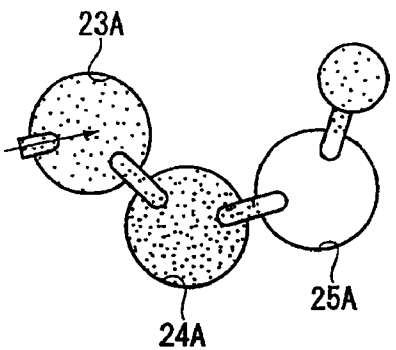
FIG. 23D is a plan view showing the state of FIG. 23C.

As the cam 150 is rotated by 9° from the state of FIGS. 23A, 23B, a state as shown in FIGS. 23C, 23D arises. More specifically, the ball 79 of the first pressing rod 73 moves from 30° to 39° of the cam face. The first pressing rod 73 moves from position of displacement 0.2 mm to 0.3 mm to be away from the diaphragm 8, the volume of the suction valve chamber is increased. In accordance with the increase in the volume, the liquid is sucked from the space 33 to the suction valve chamber via the communication groove 281.

At this time, the ball 79 of the second pressing rod 74 moves from 360° to 9° of the cam face and the second pressing rod 74 is maintained at the position of displacement 0.3 mm. Accordingly, the metering chamber is maintained with a predefined volume.

At this time, the ball 79 of the third pressing rod 75 moves from 330° to 339° of the cam face and the third pressing rod 75 is maintained at the position of displacement 0.2 mm. As a result of the movement, the discharge valve chamber is maintained in the hermetically sealed condition.

Figure 24A:
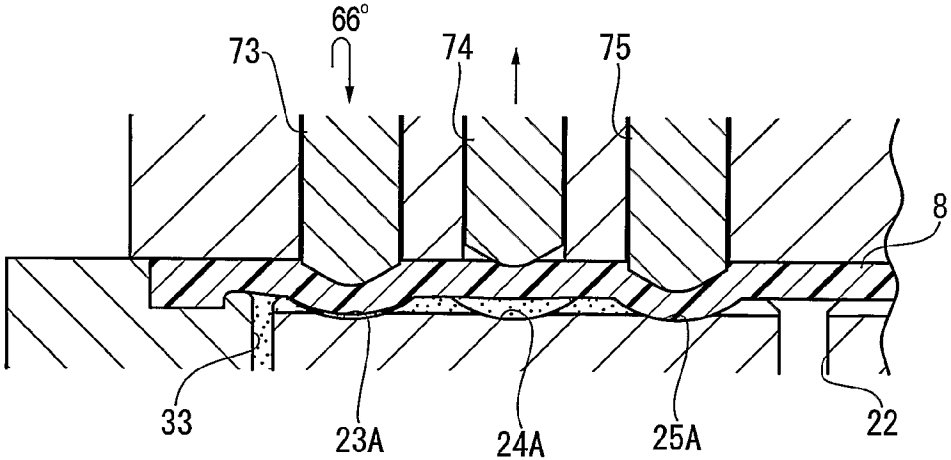
FIG. 24A is a cross section showing a state where the first pressing rod of the third embodiment is at the 66° position of the cam face.
Figure 24B:
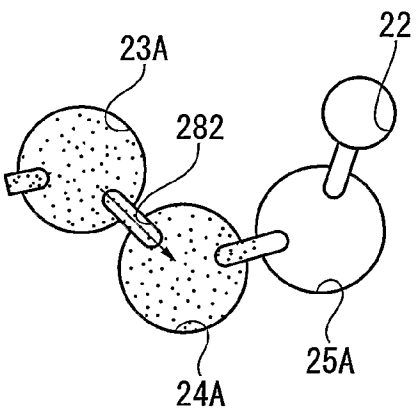
FIG. 24B is a plan view showing the state of FIG. 24A.

As the cam 150 is rotated by 27° from the state of FIGS. 23C, 23D, a state as shown in FIGS. 24A, 24B arises. More specifically, the ball 79 of the first pressing rod 73 moves from 39° to 66° of the cam face. At this time, when the first pressing rod 73 once moves from the position of displacement 0.3 mm to the position of displacement 0.5 mm (52.5°) to be away from the diaphragm 8, and again moves back to the position of displacement 0.3 mm so as to come closer to the diaphragm 8.

At this time, the ball 79 of the second pressing rod 74 moves from 9° to 36° of the cam face and the second pressing rod 74 moves from the position of displacement 0.3 mm to the position of displacement 0.7 mm to come closer to the diaphragm 8. As a result of the movement, the volume of the metering chamber is gradually increased.

The volume of the suction valve chamber once increases and then decreases. Thus, the liquid is sucked from the space 33 into the suction valve chamber, and then discharged from the suction valve chamber. At this time, since the volume of the metering chamber is gradually increased, the liquid discharged from the suction valve chamber is sucked into the metering chamber.

At this time, the ball 79 of the third pressing rod 75 moves from 339° to 6° of the cam face and the third pressing rod 75 is maintained at the position of displacement 0.2 mm. Thus, the discharge valve chamber is maintained in the hermetically sealed condition.

Figure 24C:
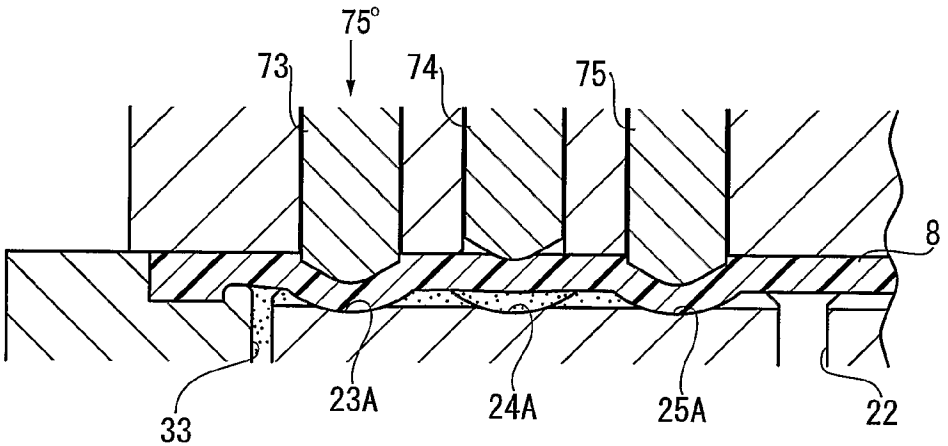
FIG. 24C is a cross section showing a state where the first pressing rod of the third embodiment is at the 75° position of the cam face.
Figure 24D:
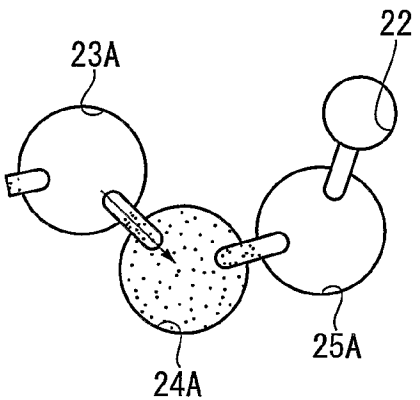
FIG. 24D is a plan view showing the state of FIG. 24C.
Figure 25:
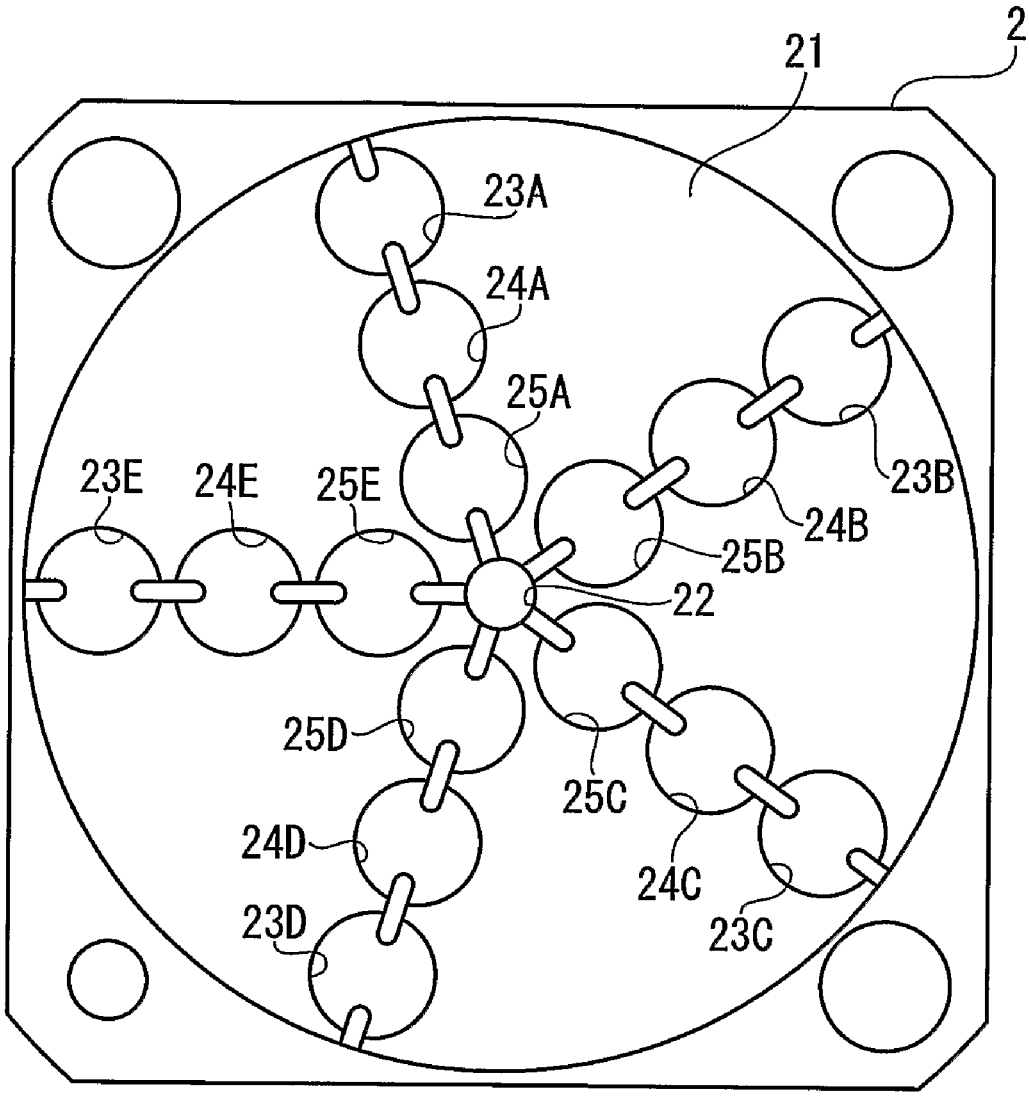
FIG. 25 is a plan view of a principal part of a modification of the present invention.

As the cam 150 is rotated by 9° from the state of FIGS. 24A, 24B, a state as shown in FIGS. 24C, 24D arises. More specifically, the ball 79 of the first pressing rod 73 moves from 66° to 75° of the cam face. At this time, since the first pressing rod 73 is moved from the position of displacement 0.3 mm to the position of displacement 0.2 mm to come closer to the diaphragm 8, the suction valve chamber is hermetically sealed.

At this time, the ball 79 of the second pressing rod 74 moves from 36° to 45° of the cam face and the second pressing rod 74 is maintained at the position of displacement 0.7 mm. Thus, the volume of the metering chamber does not change.

At this time, the ball 79 of the third pressing rod 75 moves from 6° to 15° of the cam face and the third pressing rod 75 is maintained at the position of displacement 0.2 mm. Thus, the discharge valve chamber is maintained in the hermetically sealed condition.

Therefore, as the ball 79 of the first pressing rod 73 moves form the state of FIGS. 23A, 23B to the state of 24D, in other words, from 30° to 75° of the cam face, the volume of the suction valve chamber is gradually increased from the hermetically sealed condition and then deceased, where the suction process for sucking the liquid is performed until the suction valve chamber is hermetically sealed again.

In the state of FIGS. 24C, 24D, in other words, when the suction valve chamber is sealed, the suction process ends.

Further in the state of FIGS. 24C, 24D, since the suction valve chamber and the discharge valve chamber are hermetically sealed, the liquid is dividedly isolated in the suction valve chamber and the discharge valve chamber, more specifically, in the spaces with predefined volume of the metering chamber and the communication grooves 282, 283. Thus, the metering process for dividedly isolating the liquid in the spaces with predefined volume for metering is performed.

As the cam 150 is rotated by 15° from the state of FIGS. 24C, 24D, a state is returned to the state of FIGS. 22A, 22B. More specifically, the ball 79 of the first pressing rod 73 moves from 75° to 90° of the cam face. The first pressing rod 73 is kept at the displacement 0.2 mm while the suction valve chamber is maintained in the hermetically sealed condition.

At this time, the ball 79 of the second pressing rod 74 moves from 45° to 60° of the cam face and the second pressing rod 74 is moved from the position of displacement 0.7 mm to the position of displacement 0.6556 mm. Thus, the volume of the metering chamber is gradually decreased.

At this time, the ball 79 of the third pressing rod 75 moves from 15° to 30° of the cam face and the second pressing rod 75 is moved from the position of displacement 0.2 mm to the position of displacement 0.4333 mm. Thus, the suction valve chamber is in the opened condition and the volume thereof is gradually increased, so that the liquid is sucked from the metering chamber into the discharge valve chamber.

Shapes of 90° through 180°, 180° through 270° and 270° through 360° of the cam face are the same as the shape of 0° through 90°. In other words, the state where the ball 79 of the first pressing rod 73 is at 90° position of the cam face is the same as the state of FIGS. 22A, 22B, the operation is repeated. Therefore, the description thereof will be omitted.

In the present embodiment, as with the first embodiment, since the liquid is discharged from the discharge valve chamber (third recess 25B) because the third pressing rods 75 are angularly displaced from each other by 72° and the cam faces of the cam 150 cyclically change at every 90°, liquid discharge is operated with the mutual phase difference of 18°. Thus, the liquid is discharged from the diaphragm pump 1B at a constant rate.

Since the diaphragm pump 1B has five liquid flow paths 280 that operate as pumps and the cam face is adapted to make a single cycle of back and forth movement during the time it rotates by 90°, which is equal to that a total of 20 pumps operate when the cam 150 makes a full turn. During this time period, a predefined volume of liquid is continuously discharged and sucked, and liquid is sucked and discharged continuously with little pulsation.

Since a discharge volume is also constant for every full turn of the cam 150 in the diaphragm pump 1B, the volume of liquid to be discharged per unit time can be controlled by adjusting the rotation speed of the cam 150.

The present embodiment is the same as the first embodiment in points that: the respective valve chambers, the metering chamber and communication groove are formed between the diaphragm 8 and the abutment 132; and the volumes of the respective valve chambers and metering chambers change in accordance with advancement and retraction of the pressing rods 73 through 75, transfer operation of the liquid is performed by the operation same as that in the first embodiment.

The present embodiment provides the following advantages, in addition to the same functions and advantages of the first embodiment.

In other words, since the flow path block 130 includes the base 131 and the abutment 132, the abutment 132 made of synthetic resin such as polypropylene and provided with the recesses 25 through 25 and the communication grooves 281 through 284. Thus, the abutment 132 can be made of resin molding, so that production cost can be reduced as compared with the case in which the recesses and the communication grooves are formed on a metal block.

Even when the second pressing rod 74 comes closest to the flow path block 130, the diaphragm 8 is not closely contacted to the second recess 24, so that abrasion or the like of the diaphragm 8 and the abutment 132 can be reduced, extending life of the diaphragm pump 1B.

Further, since one of the respective valve chambers is always hermetically sealed condition, while the metering chamber is not sealed, direct communication between the suction flow path and the discharge flow path can be securely prevented, so that the function as a pump (dispenser) can be securely maintained.

Since the ball 79 is used as a cam follower, the cam grooves 151 through 153 of the cam 150 can be round grooves with the bottom side thereof being rounded, and thus can be processed with a ball end mill. Therefore, production cost of the cam 150 can also be reduced, enabling production of the diaphragm pump 1B at low cost.

Incidentally, the scope of the present invention is not restricted to the above-described embodiments, but includes modifications and improvements as long as an object of the present invention can be achieved.

Figure 15:
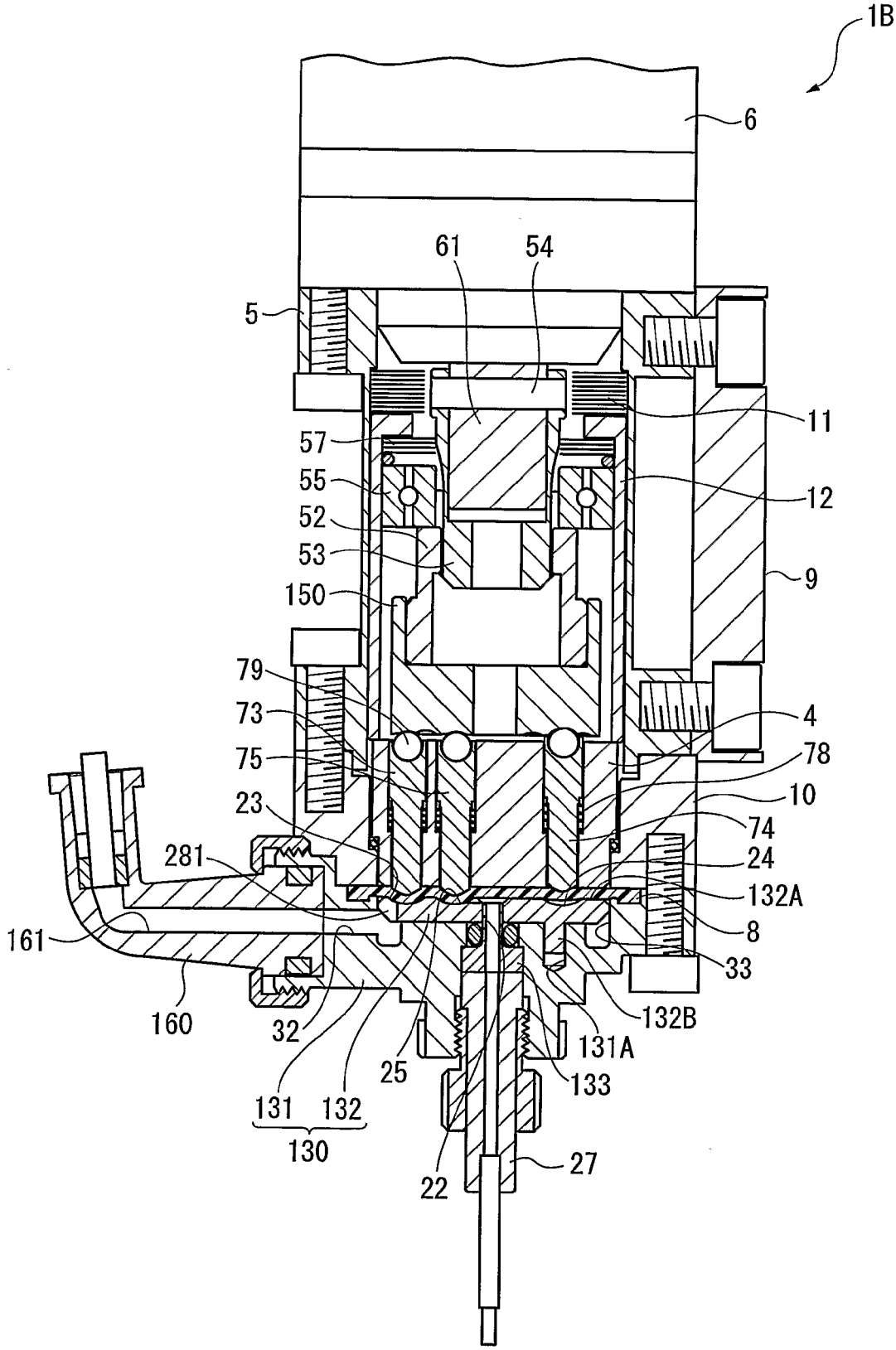
FIG. 15 is a cross section of a principal part of a third embodiment of the present invention.

For instance, in the aforesaid embodiments, while a plurality of sets of recesses 23A through 23E, 24A through 24E, 25A through 25E are arranged to extend spirally, they may alternatively be arranged radially as shown in FIG. 15. With such an arrangement, the first cam face that corresponds to the first recesses 23A through 23E, the second cam face that corresponds to the second recesses 24A through 24E and the third cam face that corresponds to the third recesses 25A through 25E are shifted by 30° from each other. For example, the cam faces may be formed in a ring-shaped profile and combined so as to be displaced by 30° from each other. When, as with the third embodiment, the cam groove is formed on the cam 150, the cam groove may be formed by displacing the phase.

However, the above-described embodiments are advantageous in that the diameter of the recess forming surface 21 can be made to have a small diameter and hence the diaphragm pump 1 can be downsized. While the sets of recesses 23A through 23E, 24A through 24E, 25A through 25E that are arranged spirally in each of the above-described embodiments may require a complicated processing operation if compared with those that are arranged radially, it is in reality not difficult to prepare such sets of recesses when an advanced numerically controlled machine is used. Further, the recesses 23A through 23E, 24A through 24E, 25A through 25E have curved surfaces and are slight dent, and therefore can be formed by using a metal mold. They can be easily by preparing a metal mold.

Additionally, it may be so arranged that the recesses 23 through 25 are formed in the diaphragm or the flow path block and the communication grooves 281 through 284 are formed in the flow path block or the diaphragm. In short, it is only necessary that the diaphragm and the flow path block are so configured as to define liquid flow paths including the respective valve chambers, the metering chamber and communication paths.

The number of the liquid flow paths 280, or the individual pumps, is not limited to five of the above-described embodiments as long as it is three or more. More specifically, each of the individual pumps is adapted to show any of three states including a state where transfer of liquid is stopped, a state where the liquid transfer rate is gradually decreasing and a state where the liquid transfer rate is gradually increasing so that the transfer of liquid is accompanied by pulsation if a diaphragm pump has only a single individual pump. Such pulsation cannot be eliminated if a diaphragm pump has two individual pumps because they cannot be used to transfer liquid simultaneously. In other words, at least three individual pumps are indispensable. If, on the other hand, a large number of individual pumps are involved, the influence of the increase and that of the decrease in the liquid transfer rate can be minimized because a plurality of pumps can be driven to operate simultaneously in order to transfer liquid. Then, it is possible to minimize pulsation and transfer liquid at a constant rate. However, as the number of individual pumps increases, the number of recesses 23 through 25 and that of pressing rods 73 through 75 also increase to consequently increase the dimensions of the diaphragm pump 1. Thus, the use of five pumps as in the case of the above-described embodiments is advantageous because it possible to relatively reduce the dimensions of the pump and realize a constant liquid transfer rate with minimal pulsation.

The number of recesses 23 through 25 arranged in each of the liquid flow paths 280 is not limited to 3 and may alternatively be 4 or more than 4. However, a diaphragm pump that can effectively prevent liquid from flowing back can be realized by arranging three recesses in each of the liquid flow paths. Therefore, the use of three recesses in each of the liquid flow path is advantageous from the viewpoint of forming a compact diaphragm pump.

Additionally, the first defined angle of intersection and the second defined angle of intersection of the recesses 23 through 25 are not limited to the above-described respective values 30° and 72° and other values may be appropriately selected depending on the number of recesses and the number of liquid flow paths 280.

The profile of the cam faces 511 of the cams 51, 150 is not limited to those illustrated by the cam diagrams of the above-described embodiments. For instance, the portions of the cam faces that are used for the respective pressing rods 73 through 75 to move at a constant acceleration may be modified to show a profile of sinusoidal curves. In short, it is only necessary to design the cam faces in such a way that the total liquid transfer rate produced by the pressing rods 73 through 75 is held to a constant level.

The combinations of the arrangement of the flow path block and the respective cams 51, 150 are not limited to the ones in the embodiments described above. For instance, the cam 150 including the cam grooves 151 through 153 of the third embodiment may be used in the first embodiment, or the cam 51 of the first embodiment may be used in the third embodiment.

The drive mechanism for driving the cams 51, 150 is not limited to the one that is used in the above-described embodiments. For instance, the cams 51, 150 may be directly and rigidly secured to the output shaft without using a spline boss 52 and a spline shaft 53. The cams 51, 150 may be aligned without using a coned disk spring 57 or the like.

The motor that can be used for a diaphragm pump according to the present invention may be selected from stepping motors, servo motors, synchronous motors, DC motors, induction motors, reversible motors, air motors and other motors.

Further, as with the third embodiment, a biasing section for biasing the guide block 4 toward the diaphragm 8 can also be provided in the first and second embodiments. The biasing section can be arranged as appropriate. One example of the arrangement of the biasing section is shown in FIG. 16 in which the guide block 4 is axially movably provided on the inner side of the case block 10, and the guide block 4 is biased toward the diaphragm 8 by a biasing section constituted of the coned disk spring 11 and a cylindrical pressing member 12.

Figure 26:
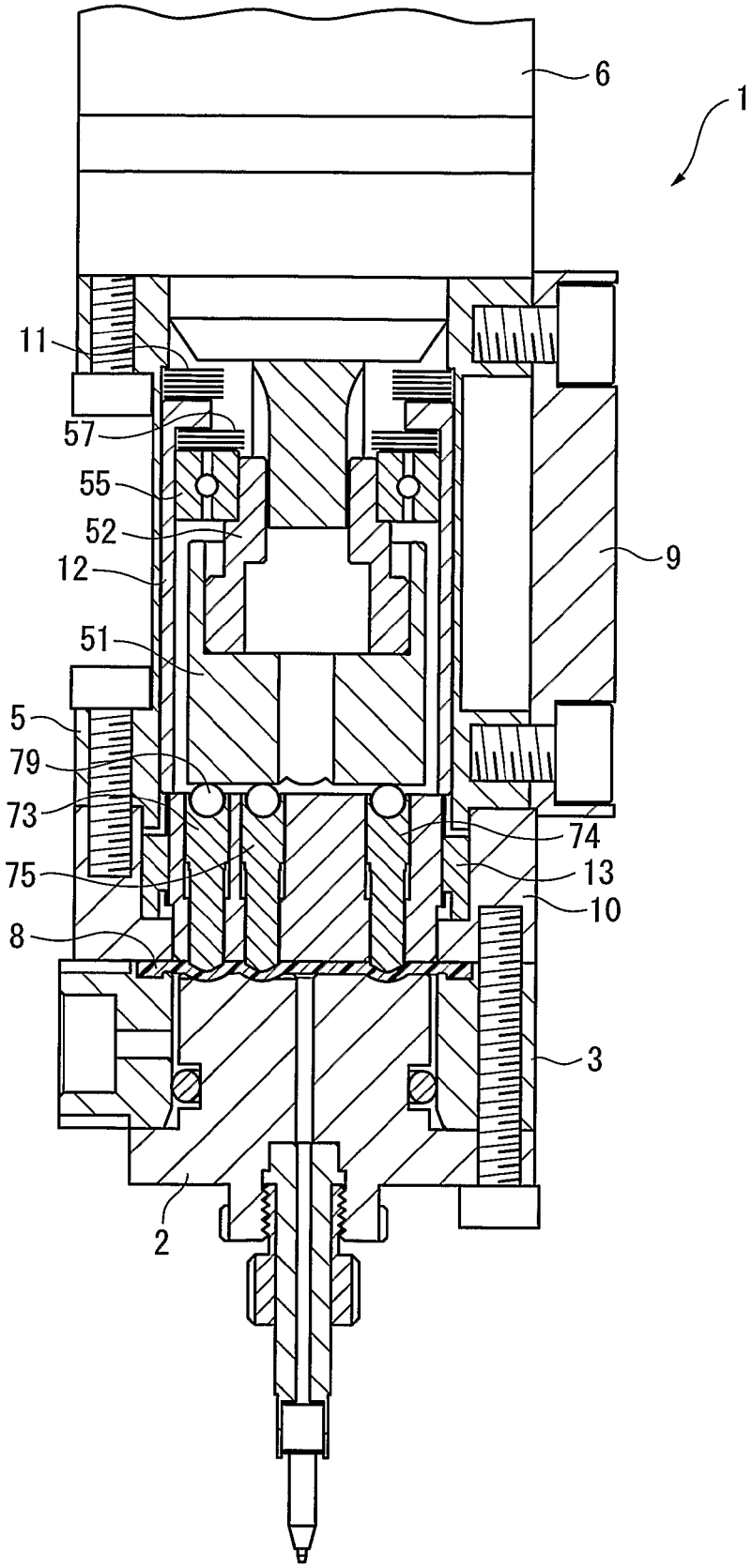
FIG. 26 is a cross section of a principal part of another modification of the present invention.

Incidentally, in the case as shown in FIG. 26, a resin-made guide ring 13 is pressed into the inner periphery side of the case block 10, the teeth formed on the inner periphery surface of the guide ring 13 is engaged with the teeth formed on the outer periphery surface of the guide block 4. By such arrangement, the guide block 4 is movable in the axial direction without rotating. Further, the cam 51, 150, the spline boss 52, the ball bearing 55 and the coned disk spring 57 are provided on the inner periphery side of the pressing member 12.

By providing a biasing section for biasing the guide block 4 toward the diaphragm 8, even in the case that the base block 2 and the guide block 4 have relatively low processing accuracy, the accuracy of the liquid transfer rate can be prevented from being dropped. In other words, in the first and second embodiments, since the diaphragm 8 is disposed in the space between the base block 2 and the guide block 4, and the width of the space is determined depending on processing accuracy of the base block 2, the holder ring block 3 and the guide block 4, if the dimension of the space is larger than that of the diaphragm 8, the liquid may leak out due to the unclosed contact between the diaphragm 8 and the recess forming surface 21, thereby the accuracy of the liquid transfer rate is dropped. Also, if the dimension of the space is smaller than that of the diaphragm 8, then the diaphragm 8 may be excessively pressed, so that a portion of the diaphragm 8 may protrude into the recesses 23 through 25 or communication grooves 281 through 284 so as to clog the liquid flow paths 280 and thereby rise possibility that the transfer of the liquid cannot be continued. Therefore, in the first and second embodiment, high processing accuracy for both the base block 2 and the guide block 4 is necessary to get an accurate dimension of the space between the base block 2 and the guide block 4.

In contrast, by providing a biasing section for biasing the guide block 4 toward the diaphragm 8, even in the case that the base block 2 and the guide block 4 do not have very high processing accuracy, the diaphragm 8 can be kept in close contact with the recess forming surface 21, and the diaphragm 8 can be prevented from being excessively pressed to clog the liquid flow paths 280, thereby the accuracy of the liquid transfer rate can be prevented from being dropped, and liquid can be transferred without failure.

In the aforesaid embodiment, the width dimensions of the communication grooves 281 through 284 are specified to ⅙ of the width dimensions (diameters) of the recesses 23 through 25, but the width dimensions of the communication grooves 281 through 284 also can be optionally specified to ½ of the width dimensions (diameters) of the recesses 23 through 25 or even be specified as the same as the width dimensions (diameters) of the recesses 23 through 25 according to the kind of the liquid to be transferred. Incidentally, in the case that the width dimensions of the communication grooves 281 through 284 are specified wide, if the diaphragm 8 is excessively pressed, the diaphragm 8 may protrude into the communication grooves 281 through 284 to possibly clog the liquid flow paths 280. Accordingly, if the width dimensions of the communication grooves 281 through 284 are needed to be specified wide, it is preferred to either get a high processing accuracy for both the base block 2 and the guide block 4 to obtain an accurate dimension of the space between the base block 2 and guide block 4, or provide a biasing section for biasing the guide block 4 toward the diaphragm 8.

The profiles, the structures and the materials of any other components are not limited to those described above by referring to the preferred embodiments, which may be modified and/or altered appropriately.

Since a diaphragm pumps 1 through 1B according to the present invention is adapted to drive liquid to flow reversely by reversely rotating the cam 51, 150. Therefore, a diaphragm pumps 1 through 1B according to the present invention can find applications where liquid is sucked through the port 22 in addition to those where liquid is discharged through the port 22.

In addition to that a diaphragm pumps 1 through 1B according to the present invention can find applications in the field of apparatus for discharging a small amount of liquid (dispensers) as described above by referring to the preferred embodiments having the nozzle member 27, it can also be used for discharging a minute amount of liquid into a production line, where a predetermined liquid is flowing, to form a mixture according to the reading of a flow meter installed at the line and/or sampling liquid from the line.

Additionally, a diaphragm pumps 1 through 1B according to the present invention may be installed to intervene somewhere in a production line, where a predetermined liquid is flowing, and operate the drive unit 6 so as to establish an equilibrated state between the pressure of the line upstream relative to the pump and the pressure of the line downstream relative to the pump and meter the flow rate of the liquid from the number of revolutions or pulses per unit time of the drive unit 6 in the equilibrated state. Particularly, a diaphragm pump 1 through 1B according to the present invention is suited for sucking and discharging a very small amount of liquid and hence it can be utilized as a flow meter for metering a very low flow rate.

The material of the diaphragm 8 is not limited to rubber and the diaphragm 8 may be formed by a multilayer material prepared by laying fluorine resin and rubber. With such an arrangement, the surface layer of the diaphragm 8 that is brought to contact liquid may be formed by fluorine resin that is highly resistive against chemicals to remarkably broaden the number of types of liquid that can be used with the diaphragm 8 and consequently find a broader scope of applications. In short, any resiliently deformable material may be used for the diaphragm 8 so long as it can be deformed by the pressure applied by the pressing rods 73 through 75 and resiliently restore the original state when the pressure of the pressing rods 73 through 75 is removed.

When fluorine resin or the like that is less deformable than rubber is used for the diaphragm 8, it may be necessary to reduce the depth of the recesses 23 through 25 to about 0.1 mm and design the profile in a specific way so that the less deformable diaphragm 8 may closely contact to the recesses 23 through 25. In short, it is only necessary to appropriately design the profile and select the dimensions of the recesses 23 through 25 depending on the material of the diaphragm 8 and the liquid transfer rate of the diaphragm pump.

Figure 27:
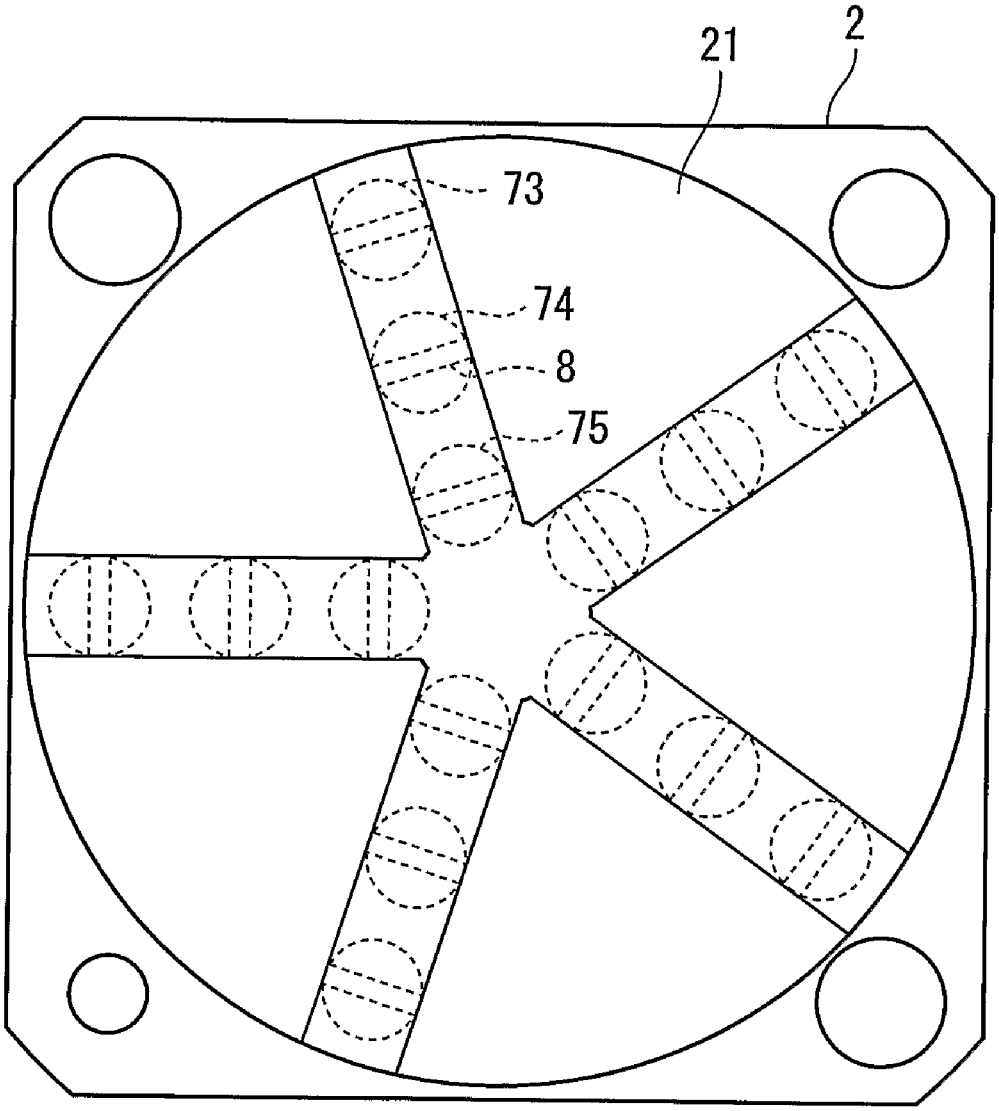
FIG. 27 is a plan view of a principal part of still another modification of the present invention.

While the recesses 23 through 25 are formed in a width larger than the width of the communication grooves 281 through 284 in the above-described embodiments, they may alternatively be formed in the width same as that of the communication grooves. For instance, as shown in FIG. 27, the recessed grooves may be formed radially from the port 22 formed at the central axis of the flow path block. The recessed groove may have a substantially arcuate cross section with constant width. In such arrangement, by disposing the respective pressing rods 73 through 75 so as to align with the recessed grooves and moving the pressing rods 73 through 75 toward the recessed grooves (flow path block), the diaphragm 8 can be closely contacted to the recessed grooves, thereby closing the recessed grooves. On the other hand, by moving the pressing rods 73 through 75 away from the recessed grooves, the diaphragm 8 detaches from the recessed groove, thereby opening the recessed grooves. Therefore, even with the recessed grooves with constant width, the respective recesses 23 through 25, the communication grooves 281 through 284 (the respective valve chambers, the metering chamber and the communication grooves) are substantially formed.

With such arrangement, it is only required to form a plurality of recessed grooves having constant width on the flow path block, so that processing can be simple and the cost can be reduced. Further, since the groove widths of the liquid flow paths are relatively large and constant, even a liquid with high viscosity can be discharged. However, as shown in FIG. 27, since the diaphragms 8 closely contact with the recessed grooves linearly in a direction orthogonal to the longitudinal direction of the grooves, close-contact areas are smaller as compared to the embodiments described above. Therefore, the respective embodiments described above advantageously have higher sealing performance of the liquid flow path.

The diaphragm pump according to the present invention can be incorporated into a manufacturing device of electronic component. The manufacturing device of electronic component is preferred to have the diaphragm pump, a liquid feeder for supplying the liquid to the suction flow path of the diaphragm pump, an discharge nozzle provided to discharge flow path, and a controller for controlling the drive section of the diaphragm pump, in which liquid supplied by the liquid feeder is discharged from the discharge nozzle through the diaphragm pump to manufacture electric component.

In such a manufacturing device of electronic component, since the diaphragm pump capable of accurately transferring a trace quantity of liquid is employed, a trace quantity of liquid is enable to be accurately discharged by the discharge nozzle, and even particle-containing liquid with silver powder, silica powder or the like contained therein can be discharged without crushing and particles contained. Thus, the diaphragm pump not only can be used as a dispenser for discharging every kinds of liquid such as adhesive and resin, but can be used to every kinds of manufacturing device of electronic component in which such a dispenser is incorporated. In particular, since a trace quantity of particle-containing liquid can be accurately transferred, it is most suitable to the manufacturing devices of electronic components such as a die bonder, in which a semiconductor chip is fixed to the substrate by the adhesive such as silver paste, or a manufacturing device for manufacturing LED, in which the LED chip is sealed by the resin with silica powder contained.

INDUSTRIAL AVAILABILITY

The present invention is applicable to diaphragm pumps that can transfer liquid at a constant rate without pulsation. Further, the present invention is applicable to manufacturing devices of electronic component such as a die bonder, in which a semiconductor chip is fixed to the substrate by the adhesive such as silver paste discharged from a diaphragm pump, or a manufacturing device for manufacturing light-emitting diode (LED), in which the LED chip is sealed by the resin with silica powder contained discharged from a diaphragm pump.

The invention claimed is:

1. A diaphragm pump comprising:

a flow path block;

a diaphragm arranged so as to closely contact the flow path block;

a drive unit for reciprocating the diaphragm; and at least three liquid flow paths defined by the flow path block and the diaphragm, the liquid flow paths intercommunicating a suction flow path and a discharge flow path of a liquid, wherein the flow path block is provided with either one of the suction flow path and the discharge flow path on a central axis portion of a diaphragm-contacting surface to which the diaphragm is closely contacted, and the other one of the suction flow path and the discharge flow path on an outer circumferential side of the diaphragm-contacting surface, a suction valve chamber intercommunicating with the suction flow path, a discharge valve chamber intercommunicating with the discharge flow path, and a metering chamber formed between the suction valve chamber and the discharge valve chamber so as to intercommunicate therewith are provided respectively on the middle of the respective flow paths of the liquid, the drive unit comprises:

a suction pressing member arranged in correspondence with the suction valve chamber with the diaphragm interposed therebetween;

a discharge pressing member arranged in correspondence with the discharge valve chamber with the diaphragm interposed therebetween;

a metering-chamber pressing member arranged in correspondence with the metering chamber with the diaphragm interposed therebetween; and a pressing member drive controller for controlling drives of the respective pressing members, wherein the pressing member drive controller comprises a rotary drive source, a cam rotated by the rotary drive source, and a biasing unit for biasing the pressing members to abut on cam faces of the cam, and the pressing member drive controller performs operations by a predetermined timing set for each of the pressing members by rotating the cam with the rotary drive source to reciprocate the respective pressing members to follow the cam faces, the operations including:

a suction valve chamber sealing operation for moving the suction pressing member toward the flow path block to move a portion of the diaphragm corresponding to the suction valve chamber until the portion closely contacts the flow path block to hermetically seal the suction valve chamber;

a discharge valve chamber sealing operation for moving the discharge pressing member toward the flow path block to move a portion of the diaphragm corresponding to the discharge valve chamber until the portion closely contacts the flow path block to hermetically seal the discharge valve chamber;

a suction valve chamber opening operation for moving the suction pressing member in a direction away from the flow path block and detaching the portion of the diaphragm corresponding to the suction valve chamber that has closely contacted the flow path block from the flow path block to open the suction valve chamber;

a discharge valve chamber opening operation for moving the discharge pressing member in a direction away from the flow path block and detaching the portion of the diaphragm corresponding to the discharge valve chamber that has closely contacted the flow path block from the flow path block to open the discharge valve chamber;

a volume decrease operation for moving the metering-chamber pressing member toward the flow path block to move a portion of the diaphragm corresponding to the metering chamber toward the flow path block to gradually decrease the volume of the metering chamber; and a volume increase operation for moving the metering-chamber pressing member in a direction away from the flow path block to move the portion of the diaphragm corresponding to the metering chamber away from the flow path block to gradually increase the volume of the metering chamber, wherein the suction valve chamber, the metering chamber and the discharge valve chamber formed along the respective liquid flow paths are displaced from each other by a first predefined angle in a circumferential direction around a central axis of the diaphragm-contacting surface with the respective dimensions from the central axis differentiated from each other, the suction valve chambers, the metering chambers and the discharge valve chambers arranged along the respective flow paths are respectively displaced from each other by a second predefined angle in the circumferential direction around the central axis of the diaphragm-contacting surface, and the suction valve chamber, the discharge valve chamber and the metering chamber are spirally arranged from the central axis of the diaphragm-contacting surface.

2. The diaphragm pump according to claim 1, wherein the suction and discharge pressing members and the metering-chamber pressing member each have a substantially semispherical recess formed on an end surface on the cam face side and a ball disposed in the recess and adapted to abut on the cam face, and coefficient of friction between the ball and the recess is set to be smaller than coefficient of friction between the cam face and the ball.

3. The diaphragm pump according to claim 1, wherein the pressing member drive controller performs steps comprising:

a suction step for hermetically sealing the metering chamber by moving the metering-chamber pressing member provided corresponding to the metering chamber toward the flow path block to bring the portion of the diaphragm corresponding to the metering chamber into close contact with the flow path block and sucking liquid into the suction valve chamber from the suction flow path by moving the suction pressing member provided corresponding to the suction valve chamber away from the flow path block to detach the portion of the diaphragm corresponding to the suction valve chamber from the flow path block;

a first transfer step for hermetically sealing the discharge valve chamber by moving the discharge pressing member provided corresponding to the discharge valve chamber toward the flow path block to bring the portion of the diaphragm corresponding to the discharge valve chamber into close contact with the flow path block, increasing the volume of the metering chamber by moving the metering-chamber pressing member in a direction away from the flow path block to detach the portion of the diaphragm corresponding to the metering chamber from the flow path block, and decreasing the volume of the suction valve chamber by moving the suction pressing member toward the flow path block to move the portion of the diaphragm corresponding to the suction valve chamber toward the flow path block to transfer the liquid from the suction valve chamber to the metering chamber;

a metering step for hermetically sealing the suction valve chamber by moving the suction pressing member toward the flow path block to bring the portion of the diaphragm corresponding to the suction valve chamber into close contact with the flow path block while keeping the discharge valve chamber hermetically sealed, and dividedly isolating the liquid in the suction valve chamber and the discharge valve chamber to meter the volume of the liquid;

a second transfer step for transferring the liquid from the metering chamber to the discharge valve chamber by moving the metering-chamber pressing member toward the flow path block to decrease the volume of the metering chamber to move the discharge pressing member in a direction away from the flow path block to increase the volume of the discharge valve chamber while keeping the suction valve chamber hermetically sealed; and a discharge step for transferring the liquid from the discharge valve chamber to the discharge flow path by hermetically sealing the metering chamber and moving the discharge pressing member toward the flow path block to decrease the volume of the discharge valve chamber.

4. The diaphragm pump according to claim 3, wherein the pressing member drive controller performs the suction step and the discharge step while hermetically sealing the metering chamber, by moving the suction pressing member toward the flow path block to suck the liquid from the suction flow path into the suction valve chamber and moving the discharge pressing member toward the flow path block to transfer the liquid from the discharge valve chamber to the discharge flow path.

5. The diaphragm pump according to claim 1, wherein the pressing member drive controller performs steps comprising:

a suction step for sucking the liquid from the suction flow path into the metering chamber via the suction valve chamber; by moving the suction pressing member provided corresponding to the suction valve chamber in a direction away from the flow path block to detach the part of the valve chamber corresponding to the suction valve chamber from the flow path block to intercommunicate the suction flow path and the metering chamber while the discharge valve chamber is kept hermetically sealed; and by moving the metering-chamber pressing member arranged corresponding to the metering chamber away from the flow path block to detach the portion of the diaphragm corresponding to the metering chamber from the flow path block to increase the volume of the metering chamber;

a metering step for hermetically sealing the suction valve chamber by moving the suction pressing member toward the flow path block to bring the portion of the diaphragm corresponding the suction valve chamber into close contact with the flow path block while keeping the discharge valve chamber hermetically sealed, and dividedly isolating the liquid in the suction valve chamber and the discharge valve chamber to meter the volume of the liquid; and a discharge step for transferring the liquid from the metering chamber to the discharge flow path via the discharge valve chamber; by moving the discharge pressing member in a direction away from the flow path block to intercommunicate the metering chamber and the discharge flow path while keeping the suction valve chamber hermetically sealed; and by moving the metering-chamber pressing member provided corresponding to the metering chamber toward the flow path block to decrease the volume of the metering chamber.

6. The diaphragm pump according to claim 3, wherein the pressing member drive controller includes the discharge step having a discharge rate increasing step for gradually increasing the discharge rate and a discharge rate decreasing step for gradually decreasing the discharge rate and, the discharge valve chamber includes a plurality of discharge valve chambers, one of the plurality of discharge valve chambers being in the discharge-rate increasing step and at least other one of the plurality of discharge valve chambers being in the discharge-rate decreasing step, thereby keeping a constant discharge level.

7. The diaphragm pump according to claim 1, wherein the first predefined angle is 30° and the second predefined angle is 72°, and a total of five sets of the liquid flow paths, suction valve chambers, metering chambers and discharge valve chambers are provided.

8. The diaphragm pump according to claim 1, wherein a recessed groove is formed on the diaphragm-contacting surface of the flow path block in close contact with the diaphragm, a flow-path-block contacting surface of the diaphragm in close contact with the flow path block is formed to have a planar profile, and the flow path of the liquid is defined by the recessed groove of the flow path block and the flow path block contacting surface of the diaphragm.

9. The diaphragm pump according to claim 1, wherein the diaphragm-contacting surface of the flow path block in close contact with the diaphragm is formed to have a planar profile, a recessed groove is formed on the flow-path-block contacting surface of the diaphragm in close contact with to the flow path block, and the liquid flow path is defined by the diaphragm-contacting surface of the flow path block and the recessed groove of the diaphragm.

10. The diaphragm pump according to claim 8, wherein the recessed groove comprises: a suction-valve-chamber recess, a metering-chamber recess and a discharge-valve-chamber recess that respectively define the suction valve chamber, the metering chamber and the discharge valve chamber; a communication groove for intercommunicating the suction-valve-chamber recess and the suction flow path; a communication groove for intercommunicating the discharge-valve-chamber recess and the discharge flow path; and a communication groove for intercommunicating the suction valve-chamber recess/discharge-valve-chamber recess and the metering chamber-recess.

11. The diaphragm pump according to claim 1, wherein the cam face of the cam includes a plane orthogonal to a rotary shaft of the cam, the plane provided with three cam grooves concentrically arranged around the rotary shaft of the cam.

12. A manufacturing device of an electronic component comprising:

a diaphragm pump including: a suction flow path and a discharge flow path of a liquid; a flow path block; a diaphragm arranged so as to closely contact the flow path block; and a drive unit for reciprocating the diaphragm;

a liquid supplier for supplying the liquid to the suction flow path of the diaphragm pump;

a discharge nozzle provided on the discharge flow path; and a controller for controlling the drive unit of the diaphragm pump, wherein the diaphragm pump further includes at least three liquid flow paths defined by the flow path block and the diaphragm, the liquid flow paths intercommunicating the suction flow path and the discharge flow path, the flow path block is provided with either one of the suction flow path and the discharge flow path on a central axis portion of a diaphragm-contacting surface to which the diaphragm is closely contacted, and the other one of the suction flow path and the discharge flow path on an outer circumferential side of the diaphragm-contacting surface, a suction valve chamber intercommunicating with the suction flow path, a discharge valve chamber intercommunicating with the discharge flow path, and a metering chamber formed between the suction valve chamber and the discharge valve chamber so as to intercommunicate therewith are provided respectively on the middle of the respective flow paths of the liquid, the drive unit comprises:

a suction pressing member arranged in correspondence with the suction valve chamber with the diaphragm interposed therebetween;

a discharge pressing member arranged in correspondence with the discharge valve chamber with the diaphragm interposed therebetween;

a metering-chamber pressing member arranged in correspondence with the metering chamber with the diaphragm interposed therebetween; and a pressing member drive controller for controlling drives of the respective pressing members, the pressing member drive controller comprises a rotary drive source, a cam rotated by the rotary drive source, and a biasing unit for biasing the pressing members to abut on cam faces of the cam, the pressing member drive controller performs operations by a predetermined timing set for each of the pressing members by rotating the cam with the rotary drive source to reciprocate the respective pressing members to follow the cam faces, the operations including:

a suction valve chamber sealing operation for moving the suction pressing member toward the flow path block to move a portion of the diaphragm corresponding to the suction valve chamber until the portion closely contacts the flow path block to hermetically seal the suction valve chamber;

a discharge valve chamber sealing operation for moving the discharge pressing member toward the flow path block to move a portion of the diaphragm corresponding to the discharge valve chamber until the portion closely contacts the flow path block to hermetically seal the discharge valve chamber;

a suction valve chamber opening operation for moving the suction pressing member in a direction away from the flow path block and detaching the portion of the diaphragm corresponding to the suction valve chamber that has closely contacted the flow path block from the flow path block to open the suction valve chamber;

a discharge valve chamber opening operation for moving the discharge pressing member in a direction away from the flow path block and detaching the portion of the diaphragm corresponding to the discharge valve chamber that has closely contacted the flow path block from the flow path block to open the discharge valve chamber;

a volume decrease operation for moving the metering-chamber pressing member toward the flow path block to move a portion of the diaphragm corresponding to the metering chamber toward the flow path block to gradually decrease the volume of the metering chamber; and a volume increase operation for moving the metering-chamber pressing member in a direction away from the flow path block to move the portion of the diaphragm corresponding to the metering chamber away from the flow path block to gradually increase the volume of the metering chamber, and the liquid supplied by the liquid supplier is discharged from the discharge nozzle through the diaphragm pump to manufacture the electric component, wherein the suction valve chamber, the metering chamber and the discharge valve chamber formed along the respective liquid flow paths are displaced from each other by a first predefined angle in a circumferential direction around a central axis of the diaphragm-contacting surface with the respective dimensions from the central axis differentiated from each other, the suction valve chambers, the metering chambers and the discharge valve chambers arranged along the respective flow paths are respectively displaced from each other by a second predefined angle in the circumferential direction around the central axis of the diaphragm-contacting surface, and the suction valve chamber, the discharge valve chamber and the metering chamber are spirally arranged from the central axis of the diaphragm-contacting surface.

13. A diaphragm pump comprising:

a flow path block;

a diaphragm arranged so as to closely contact the flow path block;

a drive unit for reciprocating the diaphragm; and at least three liquid flow paths defined by the flow path block and the diaphragm, the liquid flow paths intercommunicating a suction flow path and a discharge flow path of a liquid, wherein the flow path block is provided with either one of the suction flow path and the discharge flow path on a central axis portion of a diaphragm-contacting surface to which the diaphragm is closely contacted, and the other one of the suction flow path and the discharge flow path on an outer circumferential side of the diaphragm-contacting surface, a suction valve chamber intercommunicating with the suction flow path, a discharge valve chamber intercommunicating with the discharge flow path, and a metering chamber formed between the suction valve chamber and the discharge valve chamber so as to intercommunicate therewith are provided respectively on the middle of the respective flow paths of the liquid, the drive unit comprises:

a suction pressing member arranged in correspondence with the suction valve chamber with the diaphragm interposed therebetween;

a discharge pressing member arranged in correspondence with the discharge valve chamber with the diaphragm interposed therebetween;

a metering-chamber pressing member arranged in correspondence with the metering chamber with the diaphragm interposed therebetween; and a pressing member drive controller for controlling drives of the respective pressing members, wherein the pressing member drive controller comprises a rotary drive source, a cam rotated by the rotary drive source, and a biasing unit for biasing the pressing members to abut on cam faces of the cam, and the pressing member drive controller performs operations by a predetermined timing set for each of the pressing members by rotating the cam with the rotary drive source to reciprocate the respective pressing members to follow the cam faces, the operations including:

a suction valve chamber sealing operation for moving the suction pressing member toward the flow path block to move a portion of the diaphragm corresponding to the suction valve chamber until the portion closely contacts the flow path block to hermetically seal the suction valve chamber;

a discharge valve chamber sealing operation for moving the discharge pressing member toward the flow path block to move a portion of the diaphragm corresponding to the discharge valve chamber until the portion closely contacts the flow path block to hermetically seal the discharge valve chamber;

a suction valve chamber opening operation for moving the suction pressing member in a direction away from the flow path block and detaching the portion of the diaphragm corresponding to the suction valve chamber that has closely contacted the flow path block from the flow path block to open the suction valve chamber;

a discharge valve chamber opening operation for moving the discharge pressing member in a direction away from the flow path block and detaching the portion of the diaphragm corresponding to the discharge valve chamber that has closely contacted the flow path block from the flow path block to open the discharge valve chamber;

a volume decrease operation for moving the metering-chamber pressing member toward the flow path block to move a portion of the diaphragm corresponding to the metering chamber toward the flow path block to gradually decrease the volume of the metering chamber; and a volume increase operation for moving the metering-chamber pressing member in a direction away from the flow path block to move the portion of the diaphragm corresponding to the metering chamber away from the flow path block to gradually increase the volume of the metering chamber, wherein the suction valve chamber, the metering chamber and the discharge valve chamber formed along the respective liquid flow paths are linearly formed in the circumferential direction around the central axis of the diaphragm-contacting surface with the respective dimensions from the central axis differentiated from each other, the suction valve chambers, the metering chambers and the discharge valve chambers formed along the respective flow paths are respectively displaced from each other by a second predefined angle in the circumferential direction around the central axis of the diaphragm-contacting surface, and the suction valve chamber, the discharge valve chamber and the metering chamber are radially arranged from the central axis of the diaphragm-contacting surface.

* * * * *

UNITED STATES PATENT AND TRADEMARK OFFICE

CERTIFICATE OF CORRECTION

PATENT NO. : 7,713,034 B2
APPLICATION NO. : 11/568932
DATED : May 11, 2010
INVENTOR(S) : Ogawa It is certified that error appears in the above-identified patent and that said Letters Patent is hereby corrected as shown below:

On the Title Page, Item (57), under "ABSTRACT", Line 14, delete "decease" and insert -- decrease --

On the Title Page, Item (57), under "ABSTRACT", Line 18, delete "decease" and insert -- decrease --

In Column 43, Line 45, in Claim 9, delete "with to" and insert -- with --

Signed and Sealed this

Twentieth Day of July, 2010

David J. Kappos

David J. Kappos
*Director of the United States Patent and Trademark Office*